US005403238A

United States Patent [19]

Baxter et al.

[11] Patent Number: 5,403,238

[45] Date of Patent: Apr. 4, 1995

[54] AMUSEMENT PARK ATTRACTION

[75] Inventors: Anthony W. Baxter, Anaheim Hills; David G. Fink, Glendale; William G. Redmann, Moorpark; Jon H. Snoddy, Pasadena; David W. Spencer, II, Saugus; Scott F. Watson, Glendale; William L. Wolf, North Hollywood, all of Calif.

[73] Assignee: The Walt Disney Company, Burbank, Calif.

[21] Appl. No.: 109,170

[22] Filed: Aug. 19, 1993

[51] Int. Cl.[6] ..... A63G 25/00

[52] U.S. Cl. ..... 472/43; 472/59; 472/65; 298/22 D; 104/78

[58] Field of Search ..... 472/43, 57, 58, 59, 472/65, 64, 135, 136, 137; 104/77, 78, 81, 83, 84, 85, 86; 434/55, 58; 298/22 D, 22 B

[56] References Cited

U.S. PATENT DOCUMENTS

| | | |
|---|---|---|
| Re. 15,244 | 12/1921 | Maynes . |
| D. 254,622 | 4/1980 | Trussler . |
| 373,439 | 11/1887 | Campbell . |
| 491,572 | 2/1898 | Libbey . |
| 717,457 | 12/1902 | Schofield . |
| 773,613 | 11/1904 | Walsh . |
| 784,345 | 3/1905 | Pepper . |
| 788,886 | 5/1905 | Citron . |
| 794,511 | 7/1905 | Knapp . |
| 858,624 | 7/1907 | Reckweg . |
| 859,604 | 7/1907 | Jossenberger . |
| 871,643 | 11/1907 | Shaw . |
| 879,615 | 2/1908 | Enochs . |
| 887,505 | 5/1908 | Nelson et al. . |
| 909,500 | 1/1909 | Woerth . |
| 1,238,151 | 8/1917 | Keefe . |
| 1,311,703 | 7/1919 | Meyer . |
| 1,352,969 | 9/1920 | Kalix . |
| 1,571,434 | 2/1926 | Ray . |
| 1,590,934 | 6/1926 | Feltner . |
| 1,712,353 | 5/1929 | Meling . |
| 1,890,137 | 12/1932 | Traver . |
| 2,010,269 | 8/1935 | Kutsukian ..... 298/22 D |
| 2,058,279 | 10/1936 | Watkins . |
| 2,135,230 | 11/1938 | Courtney . |
| 2,137,839 | 11/1938 | Hanna . |
| 2,196,093 | 4/1940 | Bartlett . |
| 2,461,780 | 2/1949 | Smith et al. . |

(List continued on next page.)

FOREIGN PATENT DOCUMENTS 455464 3/1949 Canada .

OTHER PUBLICATIONS

Doran Precision Systems, Inc., "From Roller-Coasters To Road Races . . . With SR2, You'd Swear You're Really there!".

"SR2 Specifications,".

"Doran Simulator Hydraulic Motion Systems Operational Specifications,".

Photos of Motion Base and SR2.

*Primary Examiner*—Carl D. Friedman
*Assistant Examiner*—Kien Nguyen
*Attorney, Agent, or Firm*—Pretty, Schroeder, Brueggemann & Clark

[57] ABSTRACT

An amusement park attraction having a dynamic ride vehicle for executing a sequence of distinct motion patterns and for providing unique ride experiences in the amusement park attraction or other environment. The ride vehicle includes a movable chassis and a body having a passenger seating area. A motion apparatus, including Ycomputer controlled actuators, imparts motion to the body along a plurality of axes independent of any motion of the chassis as it moves along a path in the amusement park attraction. As the vehicle travels along the path, articulation of the body and appropriate steering of the vehicle enables the vehicle to execute, in cooperation with the motion apparatus, a sequence of distinct motion patterns. Execution of the motion patterns enhances the passengers' sensation of vehicle movement that is actually taking place, as well as the sensation of a realistic moving ride vehicle experience that is actually not happening.

60 Claims, 53 Drawing Sheets

U.S. PATENT DOCUMENTS 2,620,225 12/1952 Hutchinson ..... 298/22 D
2,685,003 7/1954 Barnes et al. .
2,718,194 9/1955 Ruhlmann .
2,719,715 10/1955 Leahan .
2,861,806 11/1958 Disney .
3,006,286 10/1961 Bacon et al. .
3,067,697 12/1962 Doolittle .
3,095,827 7/1963 Chadenson .
3,113,528 12/1963 Morgan et al. .
3,283,418 11/1966 Brewer et al. .
3,345,916 10/1967 Tobias .
3,554,130 1/1971 Broggie .
3,590,743 7/1971 Larson .
3,673,308 6/1972 Segar .
3,700,060 10/1972 Keene et al. .
3,704,027 11/1972 Laudadio .
3,709,104 1/1973 Culberson .
3,734,222 5/1973 Bardwick, III .
3,747,418 7/1973 Hoffman et al. .
3,782,008 1/1974 Lloyd .
3,803,466 4/1974 Starkey .
3,805,414 4/1974 Marsh .
3,849,910 11/1974 Greenly .
3,886,334 5/1975 Cummings et al. .
3,898,746 8/1975 Seidle .
3,900,843 8/1975 Ferriss .
3,903,696 9/1975 Carman .
3,942,270 3/1976 Hoyt et al. .
3,983,640 10/1976 Cardullo et al. .
3,984,924 10/1976 Myles et al. .
3,991,485 11/1976 Golenski .
4,019,261 4/1977 Pancoe .
4,030,207 6/1977 Kron .
4,030,208 6/1977 Carver et al. .
4,034,484 7/1977 Radice .
4,057,913 11/1977 Eisenberg .
4,059,909 11/1977 Kron .
4,064,640 12/1977 Cummings et al. .
4,066,256 1/1978 Trumbull .
4,070,705 1/1978 Lockwood et al. .
4,108,077 8/1978 Laing .
4,134,217 1/1979 Neilson .
4,164,080 8/1979 Kosydar et al. .
4,213,343 7/1980 Hoffman .
4,216,473 8/1980 Goldfischer et al. .
4,236,325 12/1980 Hall et al. .
4,246,848 1/1981 Schneider .
4,246,978 1/1981 Schulz et al. .
4,251,140 2/1981 Fogerty, Jr. .
4,262,861 4/1981 Goldstein .
4,276,028 6/1981 Gwynn .
4,276,030 6/1981 Radice .
4,299,576 11/1981 Kron .
4,321,044 3/1982 Kron .
4,347,055 8/1982 Geiger .
4,349,196 9/1982 Smith, III et al. .
4,398,241 8/1993 Baker et al. .
4,423,365 12/1983 Turner .
4,451,769 5/1984 Minnich et al. .
4,457,716 7/1984 Eserhaut et al. .
4,473,876 9/1984 Minnich .
4,491,073 1/1985 Dozer .
4,504,233 3/1985 Galus et al. .
4,693,186 9/1987 Lisa .
4,752,065 6/1988 Trumbull et al. .
4,753,596 6/1988 Hart et al. .
4,798,376 1/1989 Trumbull et al. .
4,865,550 9/1989 Chu .
4,920,890 5/1990 Barber .
5,028,073 7/1991 Harms et al. .
5,127,657 7/1992 Ikezawa et al. .

AMUSEMENT PARK ATTRACTION

BACKGROUND OF THE INVENTION

The present invention relates to an amusement park attraction having a dynamic ride vehicle for enhancing the sensation of vehicle motion and travel experienced by passengers moving through the attraction in the vehicle.

Amusement park mania is a well known phenomenon of the twentieth century. Since the evolution of the amusement park ride, patrons have demanded, and gotten, greater and greater thrills—provided by bigger and better roller coasters and amusement park rides. The classic roller coaster—a man-made mechanical caterpillar which provided unmatched drama—ran furiously, climbing, dropping and turning tortuously at break neck speeds. Other types of rides, such as the Ferris wheel introduced a century ago, provided the guest with new and different experiences. To survive, though, amusement parks needed to intensify their ride experiences to compete with new inventions such as the automobile, which were becoming increasingly available to the public.

In the past, a typical ride experience was provided by a ride vehicle configured with a seating area for one or more passengers, attached to a wheeled-chassis that followed a predetermined path such as a track or rail system. This ride vehicle, although quite successful, was not without certain recognized limitations and drawbacks. For example, the passenger's sensation of vehicle motion was generally dictated by the velocity of the vehicle and the shape or contour of the path followed. To give the passenger the sensation of accelerating rapidly or turning a sharp corner very fast, the vehicle must actually accelerate rapidly or turn a sharp corner very fast. The ability to provide rapid accelerations and sharp turns at fast speeds, however, is limited by engineering design and the desire to prevent passenger exposure to unacceptable safety risks.

Since it was impossible for guests to actually fly at amusement parks without danger, every trick of the trade was used to duplicate flight, aerial acts, bicycle jumps, and other stunts. Rides began to rely on illusion; illusion, or deception, made the impossible possible at amusement parks. One ride, a large swing, was hung from a bar extending across a room near the ceiling. Guests perceived the swing gently rocking back and forth, increasing in fury until the ride completely somersaulted. Actually the swing barely moved. It was the room with furniture glued to the floor that was being rocked and turned upside-down. It worked. Passengers grabbed anything and everyone in sight to keep from falling. Thus, illusion combined with new technology opened a showcase of unbelievable ideas.

As amusement parks developed, guests wanted not only bigger thrills, guests wanted the rides to be a totally integrated experience. When it was technically impossible to increase the ride experience with clever vehicle or track use, themeing of rides was used. Themed rides from the turn of the century included elaborate dioramas and environments which adorned early roller coasters. Ride vehicles were often paraded through dark enclosures. As the ride vehicle traveled along its fixed path, it passed scenery and props designed to amuse and entertain. These scenic railways astounded passengers by giving them a simulated taste of locales most had only read about in books.

Although technological advances eventually rendered early roller coasters quaint and—eventually—obsolete, the desire for enhanced rides made possible by technology advances did not wane. At theme parks such as Disneyland® Park in Anaheim, Calif., guests thrilled to themed rides that took them on undersea voyages, soared them on trips to outer space and whisked them on adventures to the Swiss Alps.

A limitation of the themed ride vehicle was that it followed a singular, predetermined path through the attraction. As a result, there was little or no versatility in the ride experience. The guest was exposed to the same ride experience each time, giving little incentive to re-ride the attraction. Some themed ride vehicles were further enhanced by providing minor interactively by permitting the guest to direct the lateral travel of the ride vehicle by steering it within a defined range along a fixed path, and by controlling the rate of speed. However, the themed ride experience could not be substantially changed. The time and expense associated with changing the ride experience, either by altering the vehicle path or replacing the ride scenery, usually are prohibitive.

Since these ride vehicles move through an attraction that covers a great area, and since space in amusement attractions is often at a premium, and it is desirable to operate a plurality of ride vehicles simultaneously, to accommodate a large number of would-be passengers and avoid lines. Thus, many rides, including roller coasters, flumed log rides, visual tours and the like, typically operate a large number of ride vehicles at one time, with staggered departure of adjacent ride vehicles along their closed-loop path. This method of operation has created the need for control systems that are designed to ensure against collision among the ride vehicles. Electronic and other vehicle motion control systems are often employed to regulate power to ride vehicle drive mechanisms, or to control path-mounted brake mechanisms that regulate the spacing between ride vehicles.

For example, many roller coasters and log flume rides typically elevate each ride vehicle, which is thereafter motivated along the associated path by the force of gravity. The control systems of these rides may use path-mounted sensors, or alternatively, human operators positioned along the path, to control brake mechanisms to maintain vehicle spacing. Other attractions use a plurality of platen drives, having a wheel or other path-mounted drive element that contacts a platen of each ride vehicle, to drive and control speed of the ride vehicles at all locations along the path. In these systems, electronic control systems which are external to the vehicle directly control vehicle speed, and there are typically no electronics or speed devices aboard any of the vehicles.

In other vehicles, individual electric motors or other propulsion devices are used to drive ride vehicles, frequently without the necessity of having an operator stationed in each vehicle. In these ride vehicles, electric power is supplied through a power bus, mounted adjacent to the path, which the ride vehicle taps and uses to operate its motor. A central controller is used to monitor the proximity of vehicles and shut-off power to a particular zone, or section of the path, having a ride vehicle that is closely spaced to a predecessor, or during an emergency condition.

The ability to safely combine the perception of speed, boldness and recklessness with the theme, and unite them throughout the ride by a continuity of mood is paramount to the guest. To achieve this goal, ride designers experimented by departing from conventional roller coaster technology in favor of simulated thrills and the wide-screen cinema. Through sound and wide-screen image, it was possible to create point of view roller coaster footage which embraced the spectator—the simulated roller coaster. Heads tilted, eyes dilated, and brows dripped as guests felt the deep hills, abrupt turns, and even the velocity without ever leaving their theater seats. These experiences were further enhanced by the advent of motion simulators and their addition of actual audience motion to the spectacle of wide-screen movies.

Motion simulator ride vehicles simulate vehicle motion, and are typically operated entirely in an enclosed area such as a room. The simulator vehicles generally have a body with a passenger seating area which is movably supported by a motion apparatus having multiple actuators mounted above a platform. The platform is fixed and does not move; motion is imparted to the passenger seating area by multiple actuators. In use, guests seated in the passenger seating area view a wide-screen movie which corresponds to a pre-determined pattern of vehicle travel. During the film, the passenger seating area is moved in various directions for the purpose of simulating the motion of a ride vehicle as it follows the predetermined path of travel depicted on the wide-screen movie. For example, when the sensation of acceleration is desired, the passenger seating area is pitched backward slowly and practically undetectably, and then pitched forward rapidly (through rotational acceleration) to a level position as the vehicle speed seems to increase—corresponding to a visual impression created by the film. When the sensation of turning a corner is required, the passenger seating area is rolled to one side and then back to a level position, in cooperation with the film's depiction of an actual "turn." Other vehicle motion sensations can be simulated using appropriate visual imagery and articulated motion of the passenger seating area. One well-known simulator of this type that has been used for years is the "Star Tours" attraction at Disneyland® Park in Anaheim, Calif.

While ride vehicle motion simulators of this type have come a long way towards providing more dynamic and enhanced sensations, such simulators still fall short of providing an experience that truly emulates a ride through an attraction. Instead, because the simulator remains in a fixed position while the passenger seating area tilts in various directions corresponding to its simulated path, the guest does not receive the experience of actually traveling through live scenery and props which might otherwise pass by if the vehicle were to physically travel through a live attraction.

Ride vehicle motion simulators also are limited because the guest must usually look forward toward the movie screen in order to obtain and maximize the ride experience. Thus, the effect of being in a moving vehicle is limited by the fact that passengers cannot look sideways, or behind the vehicle. Unless the film viewed by the guest is changed and the motion pattern of the simulator reprogrammed to produce movement corresponding to the new film, which is an expensive undertaking, the guest will be exposed to the same ride experience each time the guest visits the attraction. Therefore, there is generally less incentive by the guest to repeatedly ride the vehicle simulator, as the ride experience will be the same each time. Moreover, motion picture film, no matter how realistic, presents a two-dimensional image that does not accurately recreate the impression that an actual three-dimensional object produces.

Today, more than ever, theme park guests want to experience the same thrills they see on television and film. Ride designers strive to create attractions which both thrill and realistically immerse the guest in the themed fantasy. The limitation on the guest's experience, was, and is, the technology of the ride vehicle.

Accordingly, there has existed a definite need for an amusement ride vehicle that enhances the sensation of the vehicle's motion and travel experienced by a guest in the vehicle as the vehicle itself physically moves through an actual attraction. There also has existed a definite need for an amusement ride vehicle that is capable of differing sequences of movement each time the ride is experienced, and thus which facilitates and enhances each repeated ride experience. There also has existed a definite need for an amusement ride vehicle that is capable of use in different attraction environments, to provide a greater versatility in the types of attractions in which the ride vehicle can be employed. The present invention satisfies these and other needs and provides further related advantages.

SUMMARY OF THE INVENTION

The present invention provides an amusement park attraction comprising a dynamic ride vehicle that moves through a simulated environment. The ride vehicle includes a movable chassis and a body adapted, as in a passenger seating area, to carry at least one passenger. A motion apparatus connected between the chassis and the body permits at least one axis of controlled motion between the chassis and the body.

Movement of the ride vehicle throughout the attraction is controlled by an electronic control system that generates and uses ride programs to synchronize vehicle movement to what passengers actually see in the attraction. Thus, the electronic control system controls and coordinates motion of the body relative to the chassis, and motion of the chassis relative to the actions of three-dimensional objects, such as scenery, show sets and other props in the attraction, which are external to the vehicle. Furthermore, the ride vehicle may be programmable so that it can be readily adapted to a wide range of different attractions or effects.

In one embodiment of the invention, the electronic control system controls actuation of the motion apparatus according to specific control data, where the actuation is synchronized with position of the ride vehicle's chassis with respect to a path followed by the vehicle throughout the attraction. In this regard, "position" may be construed to include, by way of example, an elapsed time, distance, localized presence of predefined surroundings or a predefined motion pattern of the ride vehicle. The control data is stored in a programmable memory that stores a sequence of such data, wherein each piece of data is indexed by the position of the vehicle chassis along the path. A computer is coupled to this memory and controls the actuation of the motion apparatus in response to the data in the sequence, to thereby articulate the body with respect to the ride vehicle. In more particular aspects of the invention, a plurality of alternative ride programs (each including a sequence of control data) may be stored and selected, or one of a plurality of alternative paths that the ride vehicle may follow may be selected.

In one aspect of the invention, the electronic control system controls movement of the body relative to the chassis along the path in the amusement attraction, to control presentation of a changing view to the passengers. The amusement attraction has a central controller, that exercises control over one or more ride vehicles, including the ability to stop the ride vehicles and to enable them to proceed. In this form of the invention, the programmable memory stores a plurality of sequences of data that each define different sequences of motion of the body in relation to the chassis and the path. A computer mounted within the ride vehicle controls the motion of the body in response to one of the plurality of sequences, and the central controller communicates selection information to each ride vehicle, to cause the computer of each ride vehicle to select a single sequence of data to present the passengers with a variable ride experience. This form of the invention contemplates that the motion apparatus may or may not be necessary to provide passengers with different ride experiences. In more particular aspects of the invention, the central controller communicates with each ride vehicle using, for example, radio frequency, infrared transmitters or power line carrier current.

In more specific aspects of the invention, the electronic control system, which controls the entire amusement park attraction, has the central controller remotely located from each of the ride vehicles. The central controller has a central transceiver, and each ride vehicle has a motion computer mounted in it. Each motion computer has (1) a memory that stores a sequence of motion apparatus data that defines operation of the motion apparatus during each event in a sequence of events, and (2) software that causes the motion computer to (a) determine a position of the ride vehicle (i.e., the chassis) with respect to the path, (b) access memory to obtain motion apparatus data for an event associated with position, and (c) actuate the motion apparatus to articulate the passenger holding body with respect to the chassis. The electronic control system also includes a vehicle transceiver resident in each ride vehicle that effects communication between its corresponding motion computer and the central controller.

The electronic control system may govern a plurality of ride vehicles operating within an amusement attraction, as described above, as well as moving show sets throughout the attraction. In this regard, the central controller may comprise a computer system having a plurality of programs that each define motion of a moving show set. The computer system determines which of various ride experiences are available, and in response thereto, implements a ride program in an approaching ride vehicle, such that the motion of the ride vehicle and the moving show sets are perfectly synchronized. One of the ride vehicle and the path mounts a position sensor that senses the position of the ride vehicle along the path, which is utilized to synchronize these motions. In addition, each ride vehicle may have a resident computer that receives data from a resident position sensor, accesses memory to retrieve data indexed by the sensed position, and uses that retrieved data synchronize its actions with the movement of the show set.

The present invention also provides a number of methods of controlling and programming the ride vehicles of an amusement attraction.

The motion apparatus of each ride vehicle has multiple actuators for imparting movement to the body along multiple axes. Multiple actuators are capable of causing body motion in multiple degrees of freedom. For example, with three actuators, body motion is capable of up to three degrees of freedom—e.g. pitch, roll, and heave—which may be provided alone or in combination.

Alternative embodiments of the motion apparatus may have additional actuators to increase the available varieties of motion. For example, the complete set of physical motions—i.e. roll, pitch, yaw, heave, surge, and slip—can be achieved with as few as six actuators.

In one embodiment, the actuators of the motion apparatus are hydraulic actuators. One or more high pressure accumulators store energy in the form of pressurized hydraulic fluid to supply power for the hydraulic actuators. Fluid spent by the actuators is returned to a reservoir. An electrically driven hydraulic power unit continuously recharges the accumulators from the reservoir.

Referring back to the vehicle control system, the system may also perform functions, such as communication with off board systems, internal status monitoring, exception handling, show control, show selection, and other functions described later. The system may include a computer which communicates with a central controller, which in turn collectively monitors one or more dynamic ride vehicles during operation. The computer may also monitor all of the ride vehicle's sensors, inform the wayside interface of its status, and shut down the dynamic ride vehicle operation if a serious or unexpected condition develops. In addition, the computer is responsible for providing the ride experience, and stores in electronic memory a number of ride programs from which a particular sequence of dynamic ride vehicle movements may be directed.

With the use of hydraulic actuators, control of the hydraulic actuators is accomplished by the vehicle control system selectively operating hydraulic servo valves. Position sensors on each hydraulic actuator generate feedback signals for the control system, to enable precise control of the hydraulic actuators and the corresponding movement of the body. The vehicle control system may monitor the motion apparatus response for added safety.

The body of the dynamic ride vehicle itself may take on any desired appearance, and may be themed to a selected environment. For example, the body can be configured to resemble a transportation vehicle, such as an all-terrain vehicle, a jeep, a car, or a truck, or it may be configured to resemble the shape of an animal or other object. It will be appreciated that the body may comprise any structure adapted to carry at least one passenger.

The dynamic ride vehicle is moved along a path by a driver. In one embodiment the driver is a motor which is adapted to drive wheels on the dynamic ride vehicle. Other means of dynamic ride vehicle propulsion may be employed. For example, the driver may comprise an externally driven towing mechanism, gravity, linear induction motors, or other suitable propelling devices. The driver may be controlled by the vehicle control system. A brake may be further for parking and fail-safe conditions.

In one embodiment, a hydraulic propulsion motor may be employed as the motor to drive the wheels on the dynamic ride vehicle. Further, the hydraulic propulsion motor may operate as a pump to recharge the accumulators during deceleration of the chassis. The hydraulic propulsion motor can also be used to provide one hundred percent dynamic braking torque.

The motion of the chassis throughout the amusement park attraction is determined by the path. The path may be predetermined or arbitrary. A predetermined path may comprise a wire-guide, track, such as a rail, or a channel, such as a roadway. Alternatively, the path may comprise a set of navigation instructions. Such a path may be predetermined, or arbitrary, or a combination thereof.

When the path is not a track, the dynamic ride vehicle is further provided with a steering mechanism. For example, a wheeled dynamic ride vehicle may include two front wheels and two rear wheels, which may be steered together or independently of each other. The steering may be effected by separate steering mechanisms to provide a variety of dynamic ride vehicle movements.

In one embodiment, the front wheels are steered by a mechanical system that steers the front wheels in response to the curvature of a channel followed by the dynamic ride vehicle. The rear wheels are steered by a hydraulic actuator. This hydraulic actuator is operated by a hydraulic servo valve which is controlled by the controller. Of course, the front wheels also may be steered in the same manner as the rear wheels, using a separate actuator. Alternatively, each wheel may have a separate steering actuator and may be independently controlled.

In one embodiment of the invention, the dynamic ride vehicle is guided along a channel by front and rear followers. These followers are respectively connected to front and rear bogies that roll along underground rails. The front follower links the front bogie to a front steering mechanism which causes a pair of front wheels to follow the channel. The rear follower is adapted to allow the dynamic ride vehicle to move laterally with respect to the bogies, within a predetermined envelope along the path. In the event that the dynamic ride vehicle transgresses the envelope, a lateral energy absorbing system limits lateral movement, absorbs lateral loads and, under certain conditions, completely disables operation of the dynamic ride vehicle. As a result, the passengers in the dynamic ride vehicle will not be subjected to unsafe accelerations, jerks or other violent movements of the dynamic ride vehicle. This helps to ensure the passengers' safety.

In another aspect of the invention, onboard audio provides sounds such as sound effects, narration and music. These sounds may be coordinated to enhance the ride experience of the passenger. Typical sound effects generated by the onboard audio include the sounds of the themed vehicle—its engine rumble or tire squeal. The sounds may be synchronized to specific movements or actions of the dynamic ride vehicle.

The onboard audio may operate to playback recorded sounds on a cue generated by the controller. Alternatively, the onboard audio may include a synthesizer to create sounds using parameters supplied by the controller. Thus, for example, gear whine from a vehicle's transmission may be in pitch proportional to the themed vehicle's velocity. Stereo music and monaural sound effects also may be provided.

The dynamic ride vehicle can execute a sequence of motion patterns for enhancing the sensation of actual vehicle movement, as well as simulated vehicle experiences; the dynamic ride vehicle may specifically enhance or diminish actual motion of the dynamic ride vehicle. For example, when the dynamic ride vehicle turns a corner, the body may be outwardly rolled from the chassis to exaggerate and enhance the passenger's sensation of the speed and sharpness of the corner. Alternatively, the body may be rolled inwardly from the chassis during turning of the corner to subdue and minimize the passenger's sensation of speed and sharpness of the corner. These outward and inward rolling motions are actually rotational movements of the body about a roll axis which produce the desired motion sensation. Addition of the steering mechanism, and its cooperation with the chassis driver, can further enhance the motion sensations imparted to the passenger. Further, the sequence of motion executed by the motion apparatus, steering mechanisms, and chassis driver can be controlled by the controller on the basis of a stored sequence of information.

The ride experience enjoyed by the passenger in the dynamic ride vehicle is unique because the dynamic ride vehicle actually moves the passenger along the path in the attraction, while imparting motion to the body in multiple degrees of freedom independent of any motion of the chassis. This substantially enhances the sensation of dynamic ride vehicle motion and, in some instances, provides a moving vehicle experience that is not actually happening. As a result, the ride experience can be safety-maximized, while providing the desired motion sensations and overall ride experience, since it is not necessary to accelerate and turn the dynamic ride vehicle at speeds that would ordinarily be necessary to produce these sensations.

An important aspect of the dynamic ride vehicle is its versatility and ability to be reprogrammed to provide a different sequence of motion patterns. Thus, in an amusement park attraction, one or more dynamic ride vehicles can be programmed differently from the other dynamic ride vehicles. In this way, the differently programmed dynamic ride vehicles can be used to, provide the passengers with different ride experiences or ride profiles along the same path each time the passenger rides a differently programmed dynamic ride vehicle. In addition, the programmability of the dynamic ride vehicles enables relatively quick reprogramming when it is desired to change portions of the attraction to provide a different ride experience, thereby minimizing the down time of the attraction when such changes are made.

Other features and advantages of the present invention will become apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DESCRIPTION OF THE PREFERRED EMBODIMENTS

Figure 1:
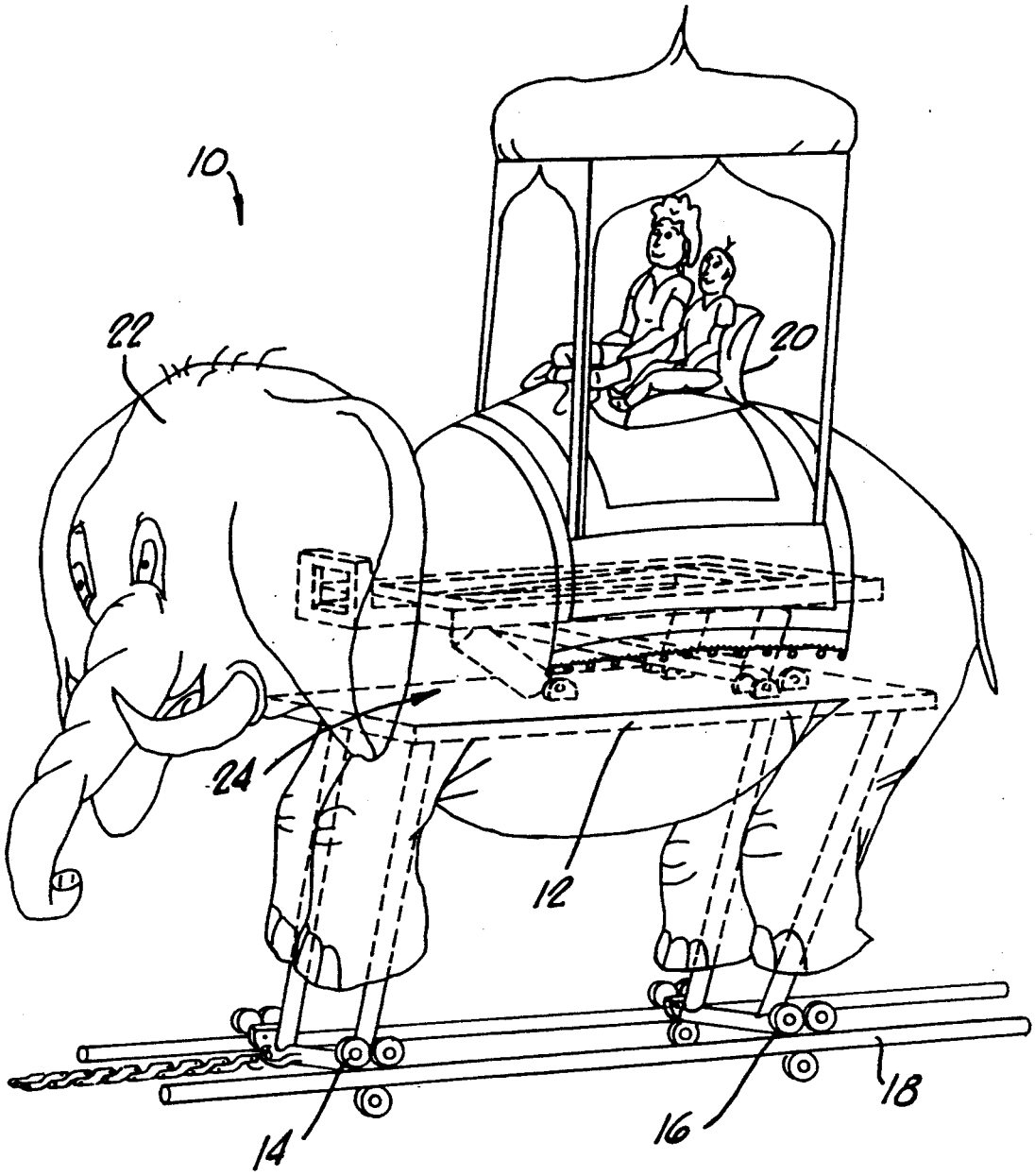
FIG. 1 is a front perspective view of one embodiment of a dynamic ride vehicle embodying the novel features of the present invention, showing a body of the vehicle in a lowered position.

As shown in the exemplary drawings, the present invention is embodied in an amusement park attraction having a dynamic ride vehicle, referred to generally by the reference numeral 10, for use in enhancing the sensation of vehicle motion and travel experienced by passengers in the vehicle. The ride vehicle 10 comprises a movable chassis 12 having a pair of front wheels 14 and a pair of rear wheels 16 for moving the vehicle along a path 18 throughout the attraction. The guests or passengers are seated in a passenger seating area 20 in a vehicle body 22 connected to the chassis 12. In accordance with the invention, a motion apparatus 24 connected between the chassis 12 and the body 22 is capable of selectively imparting motion to the body in one or more degrees of freedom relative to but independent of any motion of the chassis along the path 18. When this unique arrangement is employed in an amusement park attraction, it significantly enhances the sensation of vehicle movement experienced by the passengers riding in the vehicle 10.

As described in more detail below, the attraction includes an electronic control system that controls a plurality of ride vehicles 10 that follow a path 18 in the attraction. The electronic control system controls the motion apparatus 24 to articulate the body 22 with respect to the chassis 12, and to control the motion of the chassis relative to the path 18. In this way, the ride vehicle 10 presents passengers 48 with forces and effects that are synchronized to movement of the ride vehicle in the attraction. When ride vehicle 10 movements are coordinated with scenery, show sets, props or other three-dimensional objects strategically located in the attraction, a way unique and unusual ride experience is provided.

Thus, unlike the prior art simulator rides, real three-dimensional objects and motion and directional changes are presented to the passengers 48. For example, the body 22 is articulated in synchronism with either chassis 12 motions or the motions of external show sets, to create forces upon the passengers 48 which gives them the perception that their speed is faster than actual vehicle speed, or that they are under large gravitational forces, etc. In addition, the motion apparatus 24 can impart motion to give the passengers the perception that they are on variable terrain, such as on a cobblestone road, river, or other terrain. All of these effects are obtained by the combined use of the passengers' visual observation of their three-dimensional surroundings with articulation of the motion apparatus 24 synched to motion of the chassis 12 and to those surroundings. Preferably, the amusement attraction includes the path 18, scenery including moving show sets and stationary show sets, and a plurality of ride vehicles 10 that each execute one or more different ride programs.

The ride vehicle is also described in pending U.S. application Ser. No. 08/109,175, filed Aug. 19, 1993, which is incorporated herein by reference. (This pending application is entitled DYNAMIC RIDE VEHICLE, names Anthony W. Baxter, David G. Fink, William G. Redmann, Jon H. Snoddy, David W. Spencer, II and Scott F. Watson and corresponds to attorney docket no. P01 5357).

As described for the exemplary, preferred amusement attraction that is set forth below, particular features of the preferred electronic control system include (1) a vehicle control system 40 aboard each ride vehicle 10, and (2) a central controller that orchestrates the amusement attraction, monitors the operating status and program mode of each of the plurality of ride vehicles 10, displaying these on a monitor for an operator. The central controller is mounted at a passenger station, where passengers 48 may embark and disembark in the ride vehicle 10, and where the operator may monitor ride vehicle status throughout movement along the path 18. The vehicle control system 40 of each of the plurality of ride vehicles 10 used in the attraction all interact with the central controller via radio frequency ("rf") communications and a power bus 97, which lies beneath the path of the attraction.

The ride vehicles also interact with (1) a programming console, used for programming the ride vehicle with ride programs and to interact with the central controller, and for maintenance, and (2) moving show sets, or scenery and other devices mounted adjacent to the path 18 as part of the surroundings in the amusement park attraction that interact with the individual ride vehicles 10. As one example of a moving show set, an artificial boulder may be made to move, to present passengers 48 of a particular ride vehicle 10 with the illusion of an earthquake, or other activity. As the vehicle control system 40 aboard each ride vehicle is programmable, not every ride vehicle need take the same path, nor experience the same activities or moving shows, and the provision of a vehicle control system aboard each ride vehicle enables digital communication between ride vehicle and central controller and precise identification of status, position, etc.

Before proceeding to a discussion of the preferred electronic control system that implements the present invention, it will first be helpful to describe the ride vehicle 10 that is moved through the attraction and whose movements are controlled by the electronic control system.

Figure 2:
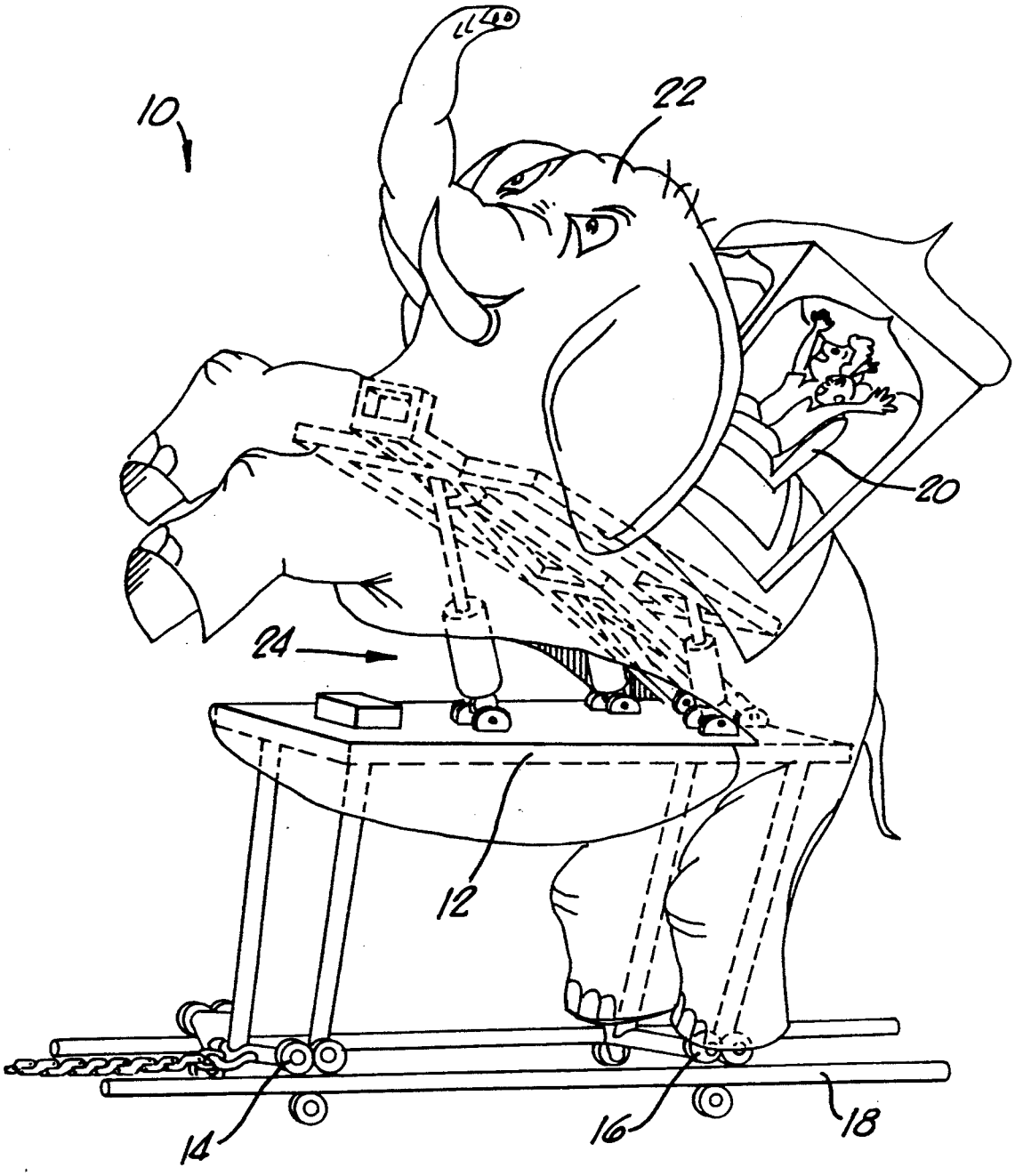
FIG. 2 is another front perspective view of the dynamic ride vehicle of FIG. 1, showing the body in a raised position.
Figure 3:
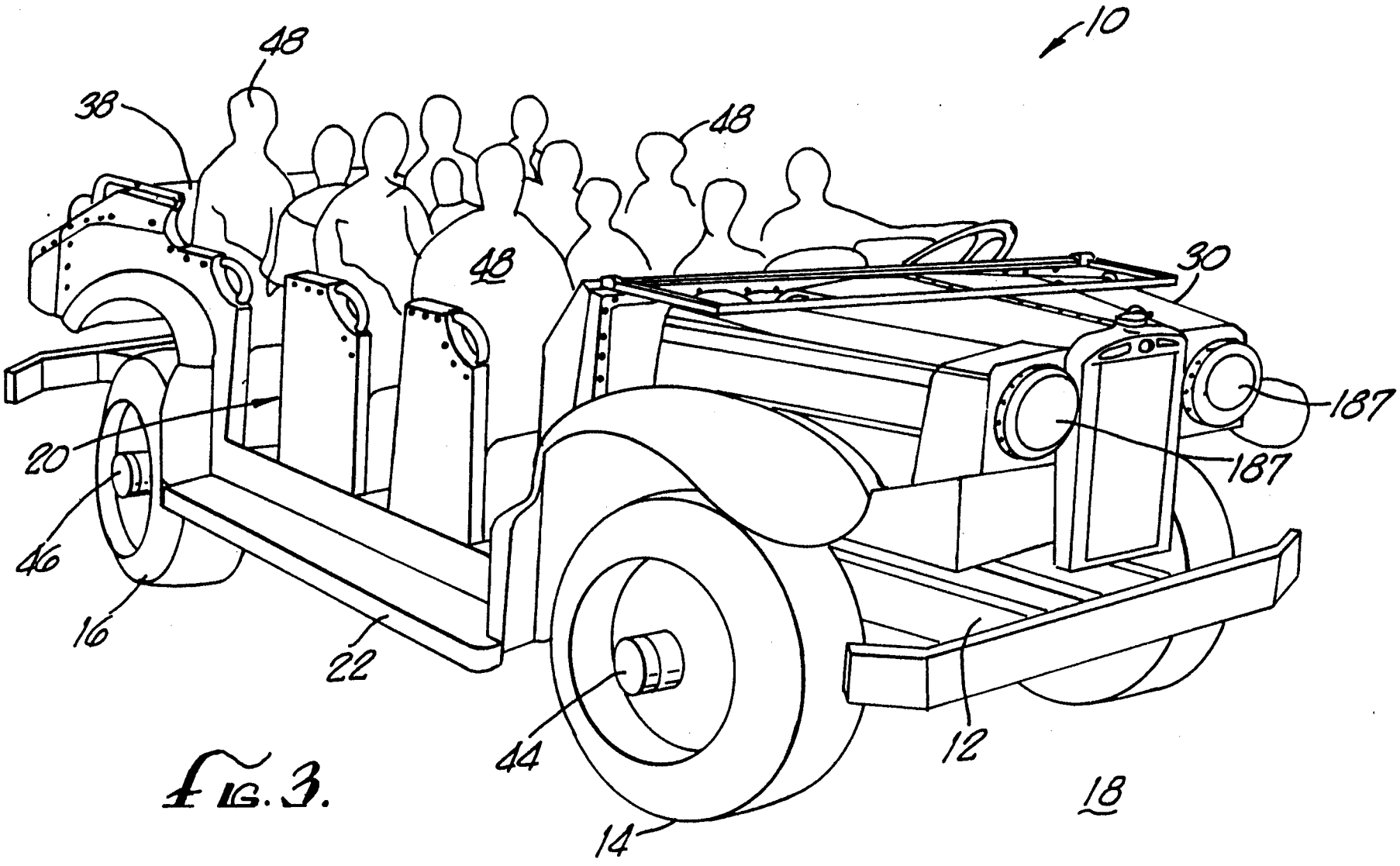
FIG. 3 is a front perspective view of another embodiment of a dynamic ride vehicle embodying the novel features of the invention.
Figure 4:
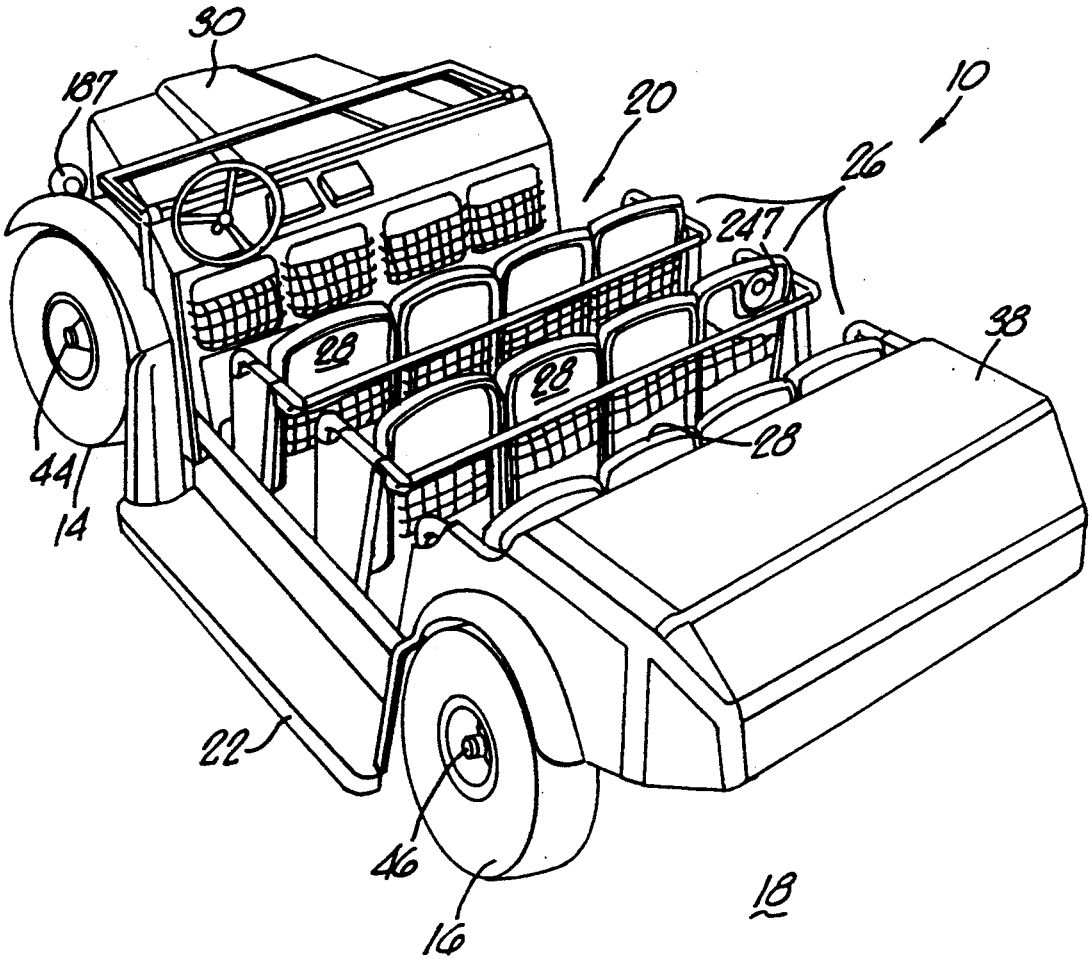
FIG. 4 is a rear perspective view of the ride vehicle of FIG. 3.

As shown best in FIGS. 1–4, the vehicle body 22 may comprise various forms and can take on a configuration that is themed to a selected environment. For example, as shown in FIGS. 1–2, the body 22 can be configured to resemble an animal, such as an elephant. To compliment the theme of the elephant body 22, the seating area 20 can be configured to resemble a howdah. Alternatively, as shown in FIGS. 3–4, the body 22 can be configured to resemble a transportation vehicle, such as an all terrain vehicle, a jeep, a car or truck, or various other forms of either on or off-road transportation vehicles. Various other body shapes may be employed as desired.

In the embodiment of the dynamic ride vehicle 10 shown in FIGS. 1–2, the ride vehicle is moved along a path 18 that comprises a track. By way of example, the track may take the form of a pair of parallel rails 25. The front and rear wheels 14 and 16 of the vehicle 10 can be suitably mounted for rolling engagement with these rails 25 in a conventional manner. An externally driven towing mechanism is provided as a driver to move the vehicle 10 along the rails 25. This driver may comprise an externally driven chain 27, as illustrated in FIGS. 1 and 2, or it may comprise a cable, platen drive system or other suitable arrangement.

As described below in connection with the embodiment of the ride vehicle 10 shown in FIGS. 3–9, suitable passenger restraints can be provided to restrain the passengers and confine them safely in their seats during vehicle motion. The ride vehicle 10 shown in FIGS. 1–2 also includes a vehicle control system 40 and a sound module 41 for generating sounds. These may be sounds corresponding to the sounds of the vehicle 10 interacting with the path, scenery and other props positioned at selected locations in, for example, an amusement attraction.

In the embodiment of the dynamic ride vehicle 10 shown in FIGS. 3–9, the passenger seating area 20 includes several rows 26 of seats 28. Other seating arrangements can be used depending upon the theme involved, the size and shape of the body 22, and the particular type of ride experiences to be conveyed. The embodiment of the ride vehicle 10 illustrated in FIGS. 1–2, showing an elephant-shaped body 22 with a howdah for a seating area 20, is exemplary. Passenger restraints also can be provided to restrain the passengers and confine them safely in their seats during vehicle motion. A suitable passenger restraint system is disclosed and claimed in U.S. Pat. No. 5,182,836.

Referring to FIGS. 3–4, the front portion of the body 22 includes a hood 30 which encloses the major power components of the vehicle, such as an electric motor 32, a hydraulic power unit 34 and a hydraulic propulsion motor 36. In this embodiment, the hydraulic propulsion motor 36 corresponds to the driver that puts the chassis 12 in motion along the path 18. It will be appreciated that the drivers illustrated in the embodiments of FIGS. 1–2 (elephant body 22) and FIGS. 3–9 (vehicle body 22) are provided for purposes of illustration only and not by way of limitation. Other suitable drivers include linear induction motors, combustion engines, electric motors, cables, platen drives, and other suitable propelling devices, including gravity.

The rear portion of the body 22 includes a trunk area 38 enclosing a vehicle control system 40 and a sound module 41 for generating sounds. These may be sounds corresponding to the sounds of the vehicle 10 interacting with the path 18, scenery 42 and other props positioned at selected locations in, for example, an amusement attraction. Further details regarding the vehicle's power components, vehicle control system 40, sound module 41, scenery 42 and other features are discussed in more detail below.

The chassis 12 has a front axle 44 and a rear axle 46, with the front and rear wheels 14 and 16 connected to the opposite ends of each axle, respectively. Each wheel 14 and 16 is equipped with a suitable tire, such as an inflatable tire or the like. Braking of the ride vehicle 10 when parked is carried out with spring applied, hydraulic release fail-safe disc brakes on all four wheels. If system power fails, spring energy causes the brakes to "fail" on. In one aspect of the invention, the front wheels 14 and the rear wheels 16 each have a separate steering system which allows the front wheels 14 and the rear wheels 16 to be steered independently of each other. This provides a steering system that is capable of producing a yaw axis of motion for the vehicle 10. This enables various motion patterns of the vehicle 10 not capable with conventional front wheel steering vehicles.

In accordance with the invention, the motion apparatus 24 is integrated into the chassis 12 for imparting motion in one or more degrees of freedom to the body 22 relative to but independent of the chassis 12. This relative motion of the body 22 with respect to the chassis 12 can be provided whether or not the chassis is in motion. When properly manipulated through an appropriate motion control system, the motion apparatus 24 can raise the body 22 and tilt it along several axes of motion to substantially enhance the sensation of vehicle movement experienced by passengers 48 riding in the vehicle 10. In some situations, motion of the body 22 with respect to the chassis 12 can be designed to enhance the sensation of vehicle movement that is actually taking place. In other situations, such motion can be designed to provide the passengers 48 with a realistic moving ride vehicle experience which is actually not taking place.

One form of the motion apparatus 24 is illustrated in FIGS. 5–9, with various details of the vehicle body 22 and chassis 12 having been omitted for purposes of clarity and simplification. This embodiment of the motion apparatus 24 uses three hydraulic servo actuators comprising a left-front motion apparatus servo actuator 50, a right-front motion apparatus servo actuator 52 and a rear motion apparatus servo actuator 54. The motion apparatus 24 also includes a body support platform or frame 56 securely connected to or integrated with the body 22 so as to form the underside of the body 22. All three of the actuators 50, 52 and 54 have their lower ends pivotally connected to a base portion 58 of the chassis 12 by separate mounting brackets 60. Similarly, mounting brackets 60 are also used to pivotally couple the upper ends of the actuators 50, 52 and 54 to the body support frame 56 (i.e., to the body 22). Each of these brackets 60 is adapted to receive a fastener 62 to secure the actuators 50, 52 and 54 to the mounting brackets 60. As seen in FIG. 3, for example, two of the actuators 50 and 52 in this embodiment are forwardly mounted and have their upper ends pivotally connected directly to the front portion of the body support frame 56 by separate brackets 60. The third actuator 54 is mounted rearwardly of the other two and has its upper end pivotally connected to the rear portion of the body support frame 56.

The motion apparatus 24 also comprises two motion control arms comprising an A-arm 64 and a scissors 66. The A-arm 64 preferably is a bolted steel structure, and the scissors 66 preferably is a welded tubular steel frame. As shown best in FIG. 8, the A-arm 64 has its front end pivotally connected by brackets 68 to the front end of the vehicle chassis 12 and its rear end pivotally connected by brackets 70 to the rear portion of the body support frame 56 adjacent to the rear motion apparatus servo actuator 54. The scissors 66 comprises a folding linkage in the form of two links 72 and 74 connected together at a pivot point 76. The lower end of the scissors 66 is pivotally connected by a bracket 78 to the chassis 12 adjacent to the two front motion apparatus servo actuators 50 and 52. The upper end of the scissors 66 is connected by a bracket 80 to the front portion of the body support frame 56 adjacent to the two front motion apparatus servo actuators 50 and 52. In order to permit rolling motion of the body 22 with respect to the chassis 12, universal joints 82 are employed to connect the body support frame 56 to the rear end of the A-arm 64 and the upper end of the scissors 66.

With the foregoing arrangement, the A-arm 64 is adapted to be pivoted up and down about the pivot points where the A-arm is connected to the chassis 12, while the body support frame 56 is adapted to be rolled from side to side about the pivot points where the frame is connected to the A-arm 64 and scissors 66 by the universal joints 82. This configuration of the motion apparatus 24 allows the body 22 to be rolled from side to side about an imaginary roll axis, pitched forward and backward about an imaginary pitch axis, and elevated or heaved up and down with respect to the chassis 12. However, the A-arm 64 constrains longitudinal forward and rearward shifting (surge), lateral side to side shifting (slip) and yaw movement of the body 22 with respect to the chassis 12.

It will be appreciated that alternative forms of the motion apparatus 24 can be provided. For example, in the embodiment shown in FIGS. 1–2, the motion apparatus 24 uses three hydraulic servo actuators, but in a reverse orientation from that described above. Thus, in the embodiment of FIGS. 1–2, the motion apparatus 24 comprises a front motion apparatus servo actuator 29, a rear-left motion apparatus servo actuator 31, and a rear-right motion apparatus servo actuator 33.

Alternatively, the motion apparatus 24 may comprise six actuators arranged in combinations of two to form a 2+2+2 motion apparatus arrangement. By controlling movement of these actuators, the body 22 may be rolled from side to side, pitched forward and backward and heaved up and down with respect to the chassis, as in the embodiments of the motion apparatus of FIGS. 1–2 and FIGS. 3–9. Other motion capabilities with these six actuators, however, include longitudinal forward and rearward shifting (surge), lateral side to side shifting (slip) and yaw movement of the body 22 with respect to the chassis 12.

Another alternative form of the motion apparatus 24, for example, can include six actuators forming a 3+3 motion apparatus arrangement, with three of the actuators rearwardly mounted and three forwardly mounted. This configuration of the motion apparatus 24 allows pitch, roll and heave of the body 22 with respect to the chassis, as in the embodiments of the motion apparatus of FIGS. 1–2 and FIGS. 3–9. Other movements, however, include surge, slip and yaw movement of the body 22 with respect to the chassis 12.

In still another alternative embodiment of the motion apparatus 24, for example, three actuators can be arranged in a 1+2 motion apparatus arrangement, in combination with a Watts linkage, to allow body movement with respect to the chassis 12 similar to that described above in connection with the embodiments of FIGS. 1–2 and FIGS. 3–9. However, the Watts linkage constrains surge, slip and yaw movement of the body 22 with respect to the chassis 12.

Figure 5:
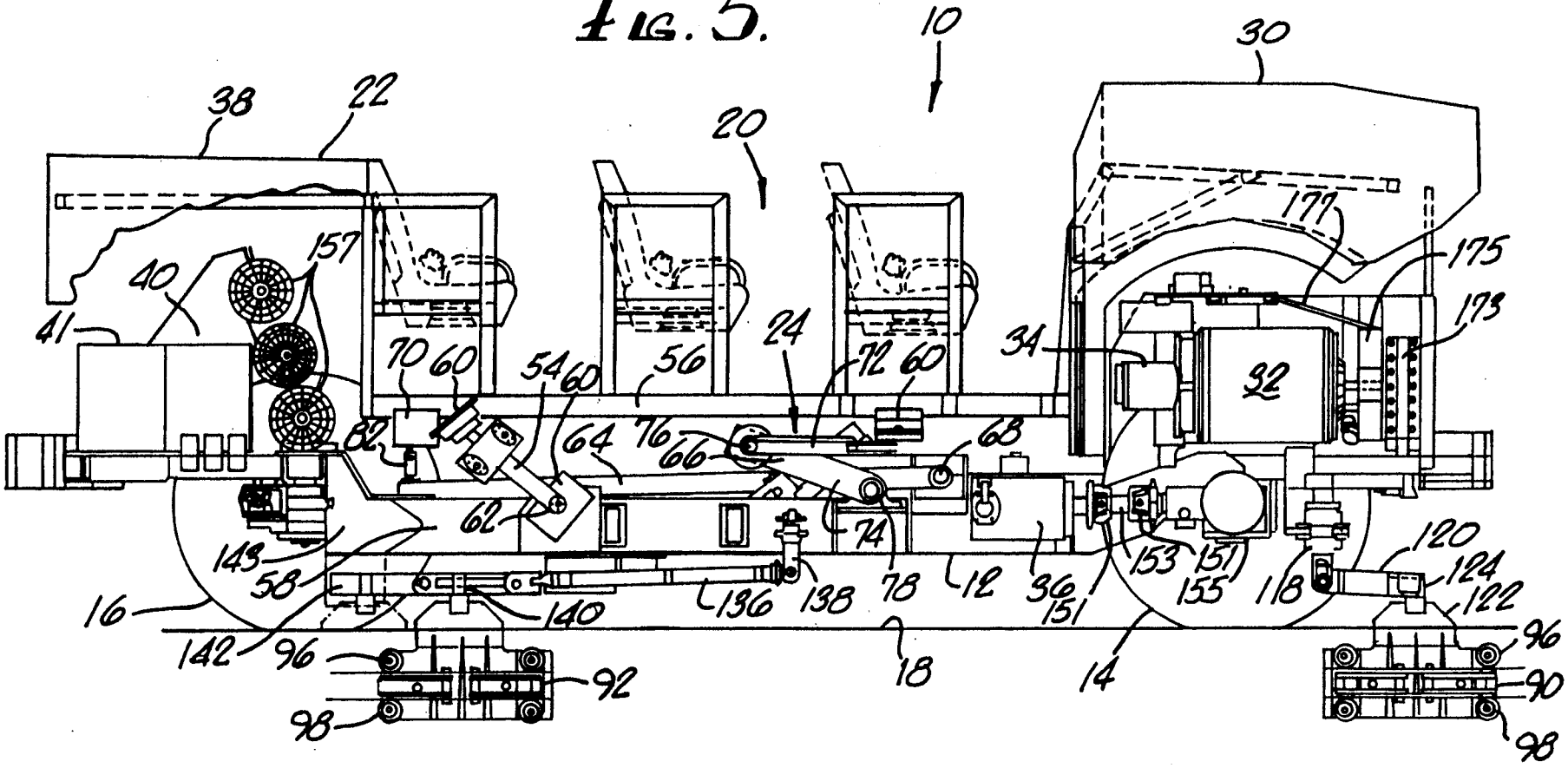
FIG. 5 is a side elevational view of the ride vehicle of FIG. 3, partly in cross-section, showing the body in a normal, horizontal position relative to the chassis.

FIG. 5 is a side elevational view, partly in cross-section, showing the body 22 in a normal, horizontal position relative to the chassis 12. In this position, each of the motion apparatus servo actuators 50, 52 and 54 is retracted to a totally collapsed condition such that the ride vehicle 10 appears to resemble any other typical roadway vehicle. The motion apparatus 24, including its actuators 50, 52 and 54 and other controls, is adapted to react to a wide range of motion commands, including high accelerations, low velocities, smooth transitions and imperceptible washout to a static condition. The motion apparatus 24 preferably is designed to be interchangeable from one vehicle to another, as are all of the other components of the ride vehicle 10 described herein.

The motion apparatus 24 is intended to replicate a broad range of vehicle motions during a ride. As explained in more detail below, these motions can be programmed in conjunction with an amusement park attraction or other environment to provide a unique ride experience to the passengers 48. Moreover, each vehicle 10 is adapted to store more than one motion pattern so that the vehicle ride and action is not necessarily the same from one ride to the next. The motion patterns are programmed and stored by a ride programmer during the development of an attraction with the aid of a separate programming console (not shown). This programming console is then used to directly download programmed data to the vehicle's on board control system 40.

When the ride first starts, the body 22 usually will be in the fully settled or down position, as shown in FIGS. 1 and 3–5, to allow the passengers 48 to unload and load. In this position, the motion apparatus servo actuators 50, 52 and 54 are fully collapsed and the forces of gravity can move the body 22 to the down position. If desired, the actuators 50, 52 and 54 can be commanded to go to a collapsed condition when it is necessary to quickly move the body 22 to the down position, such as at the end of the ride.

Figure 6:
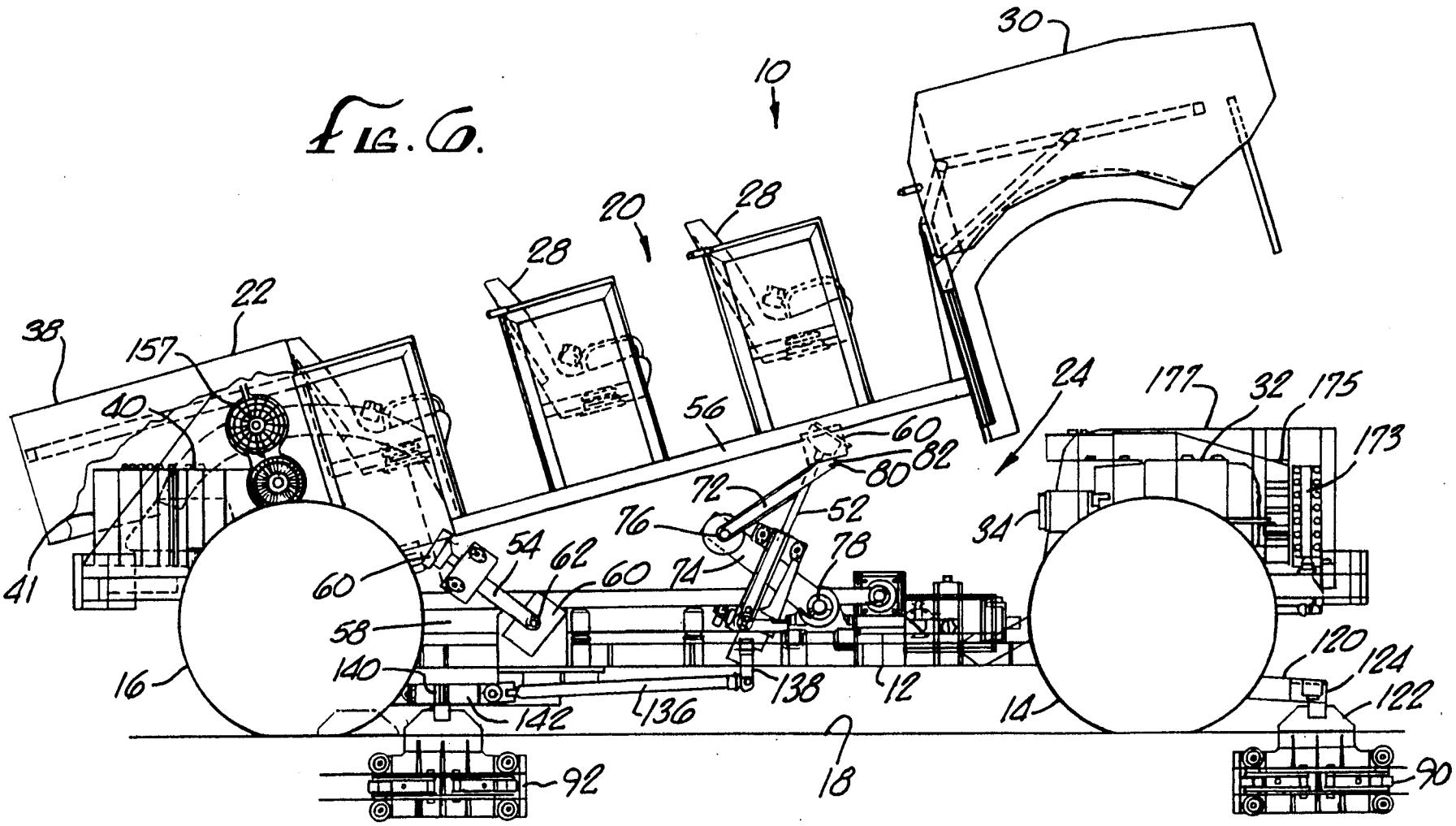
FIG. 6 is another side elevational view of the ride vehicle, similar to FIG. 5, showing the body pitched rearwardly with respect to the chassis about a pitch axis.

FIGS. 6–9 show examples of the range of motion of the body 22 with respect to the chassis 12. By using three motion apparatus servo actuators 50, 52 and 54, the motion apparatus 24 is capable of providing motion in three degrees of freedom to provide body movements with respect to the chassis 12. For example, FIG. 6 shows the body 22 pitched in a rearward direction about the pitch axis of the vehicle 10. The two front actuators 50 and 52 provide movement of the body 22 in this manner, while the rear actuator 54 is moved only slightly or not at all. Power for movement of the actuators 50, 52 and 54 is derived from the on-board vehicle hydraulic system and position sensors 84 on the actuators that provide the position of the body 22 to the on-board control system 40. In one embodiment, these sensors 84 are a non-contact, absolute position, magnetostrictive-type sensor. Using the sensors 84, the degree of pitch of the body 22 with respect to the chassis 12 may be accurately controlled as desired. In the one embodiment, the body 22 can be pitched rearwardly by as much as 15.9 degrees.

Figure 7:
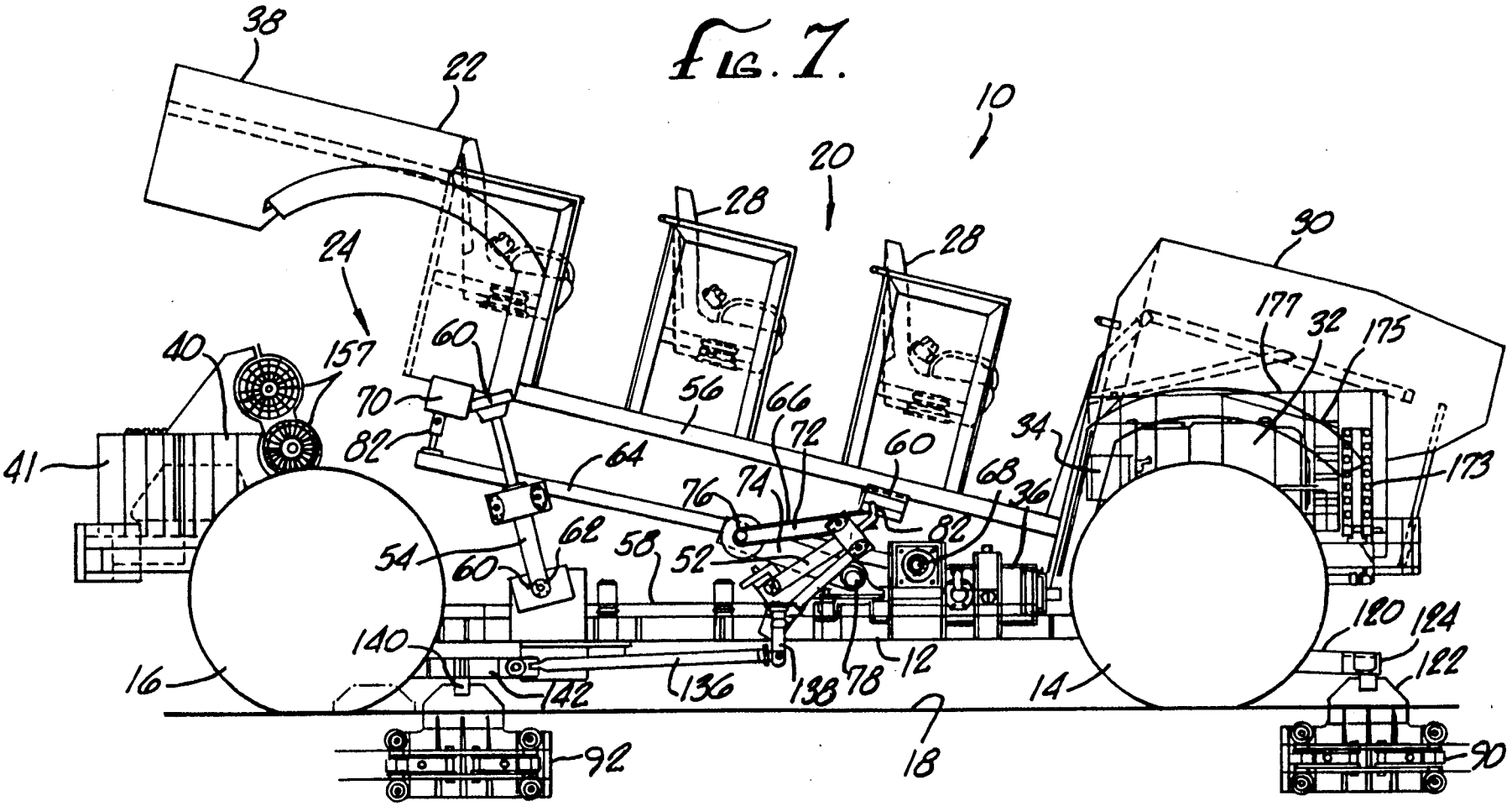
FIG. 7 is another side elevational view of the ride vehicle, similar to FIG. 5, showing the body pitched forwardly with respect to the chassis about the pitch axis.

FIG. 7 shows the body 22 pitched in a forward direction relative to the chassis 12. This pitching motion is achieved by supplying appropriate hydraulic power to the rear actuator 54 to raise the rear end of the body 22, while the two forward actuators 50 and 52 are moved only slightly or not at all. This forward pitching motion of the body 22 with respect to the chassis 12 occurs about the pitch axis of the vehicle 10. In one embodiment, the body 22 can be pitched forward by as much as 14.7 degrees. In both cases of forward or rearward pitching of the body 22, the movement of the actuators 50, 52 and 54 causes either a constant velocity movement or rotational acceleration of the body 22 with respect to the chassis 12 about the pitch axis.

Figure 8:
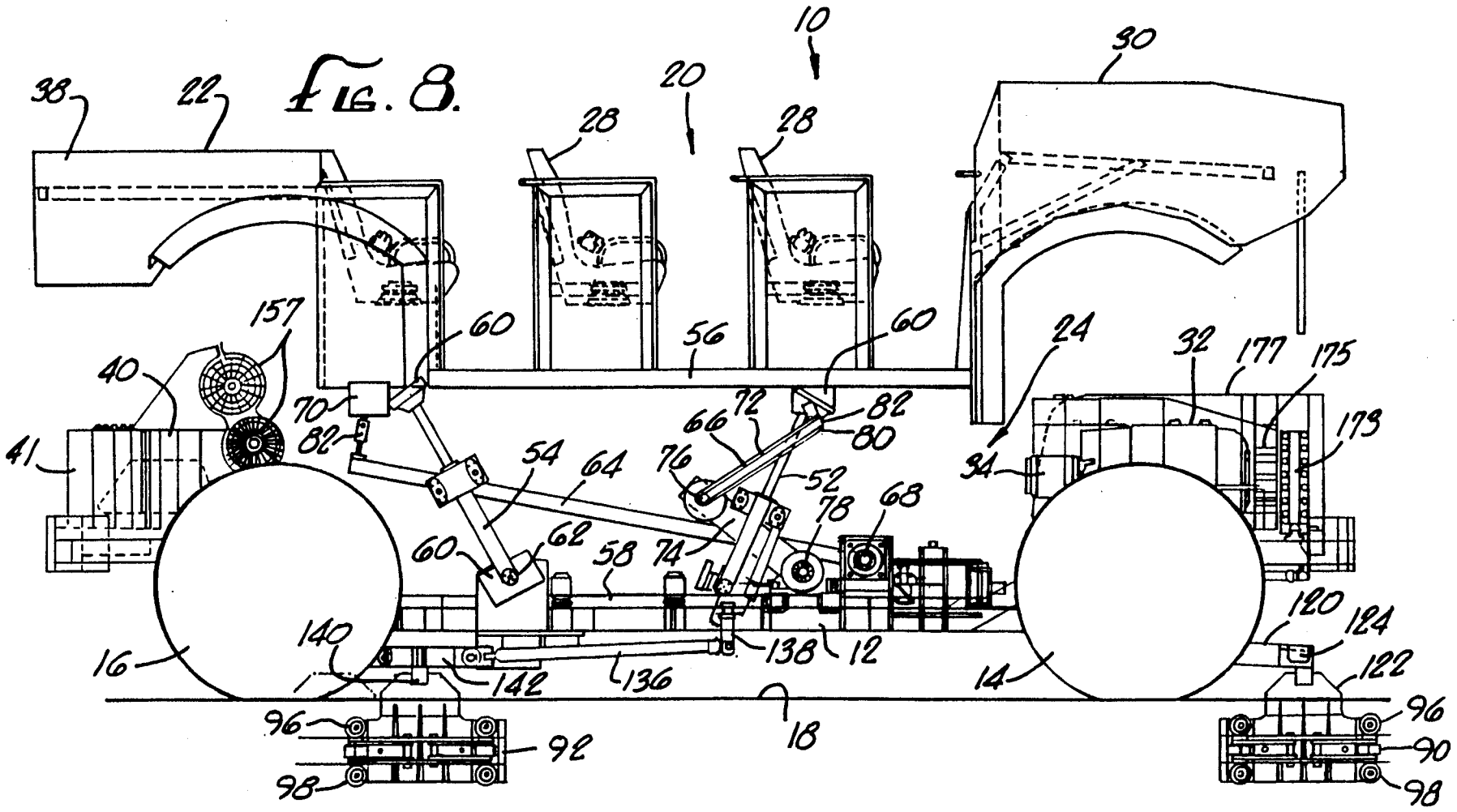
FIG. 8 is another side elevational view of the ride vehicle, similar to FIG. 5, showing the body in an elevated, horizontal position with respect to the chassis.

FIG. 8 shows all three actuators 50, 52 and 54 in a fully extended position, raising the body 22 to an elevated, horizontal position with respect to the chassis 12. This is accomplished by supplying appropriate hydraulic power to all three actuators 50, 52 and 54 so that they are fully extended. In one embodiment, the body 22 can be elevated or heaved by as much as 15 inches above the chassis.

Figure 9:
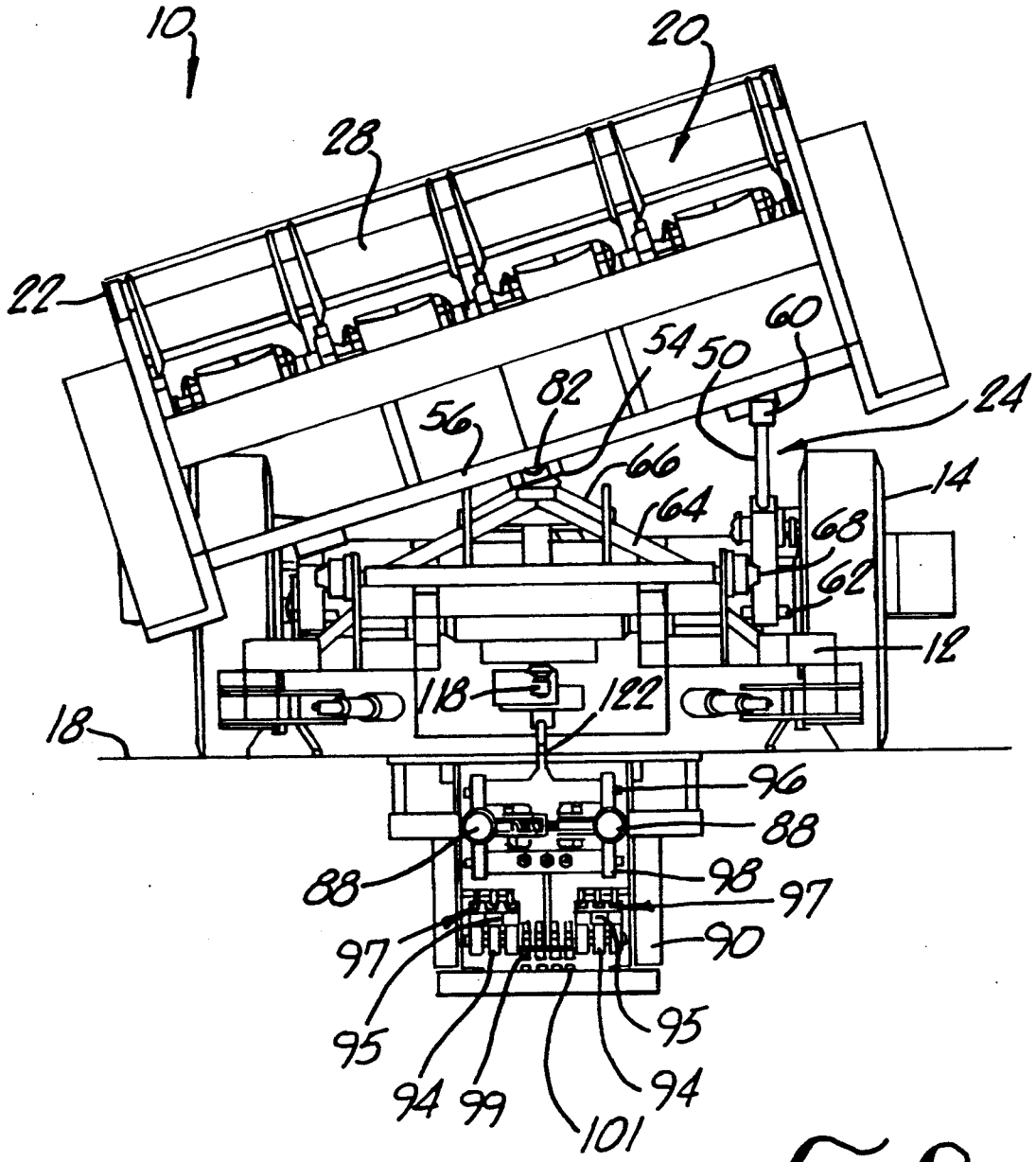
FIG. 9 is a front elevational view of the ride vehicle of FIG. 3, partly in cross-section, showing the body rolled to one side with respect to the chassis about a roll axis.

FIG. 9 is a front elevational view of the vehicle 10, showing the body 22 rolled with respect to one side of the chassis 12. This is accomplished by supplying appropriate hydraulic pressure to the actuators 50, 52 and 54, resulting in rotational movement of the body 22 with respect to the chassis 12 about the roll axis of the vehicle 10. In this condition, one of the two front actuators 50 is extended while the other actuator 52 is collapsed. The rear actuator 54 also is partially extended to the extent necessary to accommodate extension of the one front actuator 50. In one embodiment, the body 22 can be rolled by as much as 16.1 degrees to either side of the chassis 12. Again, it will be understood that various intermediate ranges of motion, and motion in the opposite direction to that shown in FIG. 9, are possible about the roll axis of the vehicle 10.

It also will be understood that intermediate ranges of motion are possible, beyond the full range of motions described above and depicted in FIGS. 6–9. For example, the body 22 can be both pitched forward and rolled to one side with respect to the chassis 12 by as much as 8.2 degrees (pitch) and 15.4 degrees (roll). Similarly, the body 22 can be both pitched rearward and rolled to one side with respect to the chassis 12 by as much as 7.2 degrees (pitch) and 17.4 degrees (roll). These motions can be carried out by appropriate control and extension and retraction of the motion apparatus servo actuators 50, 52 and 54 in a multitude of combinations to produce compound body movements. Therefore, it is understood that the motions described herein are by way of example only and not limitation.

Figure 10:
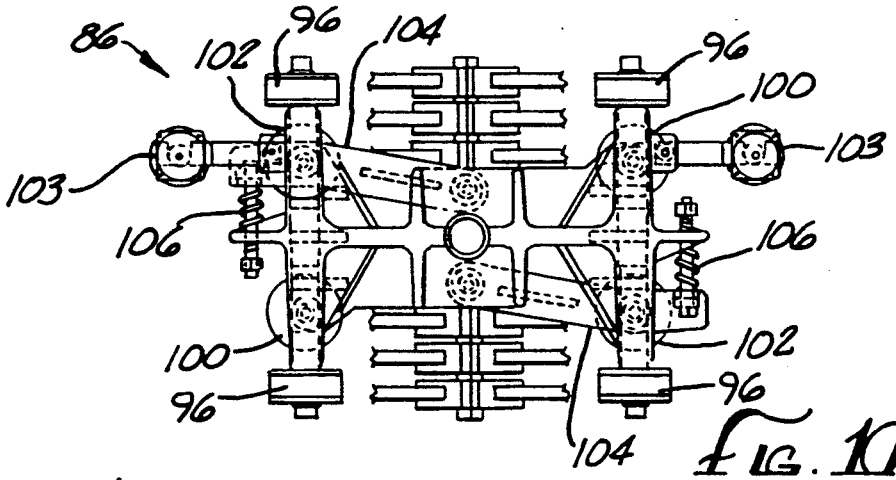
FIG. 10 is a top plan view of a bogie for use in guiding the ride vehicle along a path.
Figure 11:
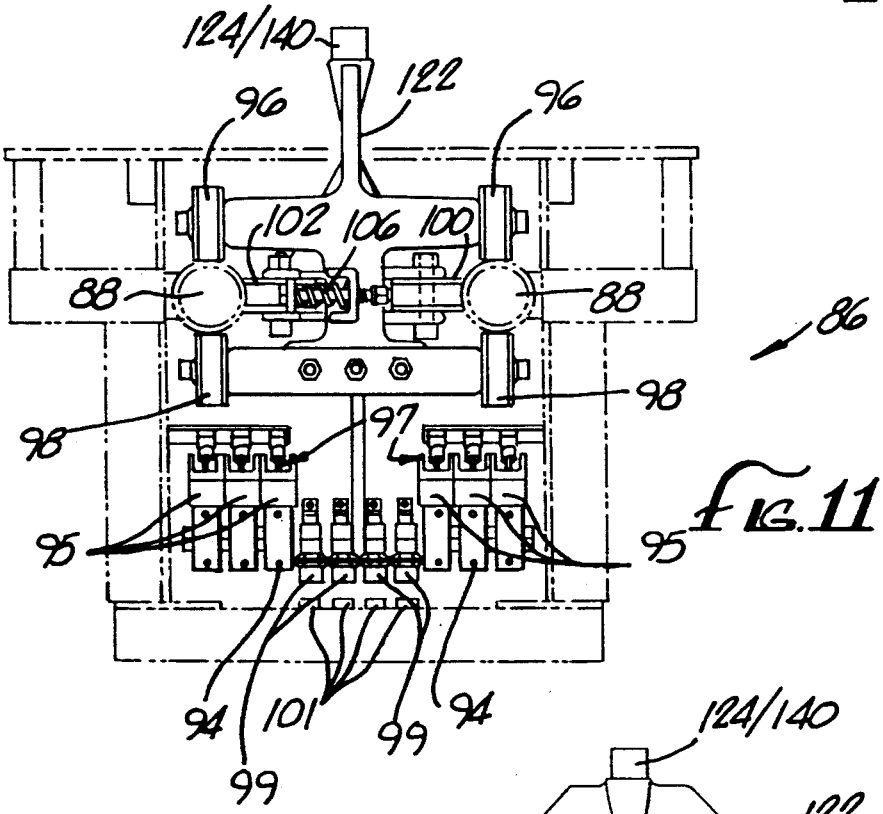
FIG. 11 is a front elevational view of the bogie.
Figure 12:
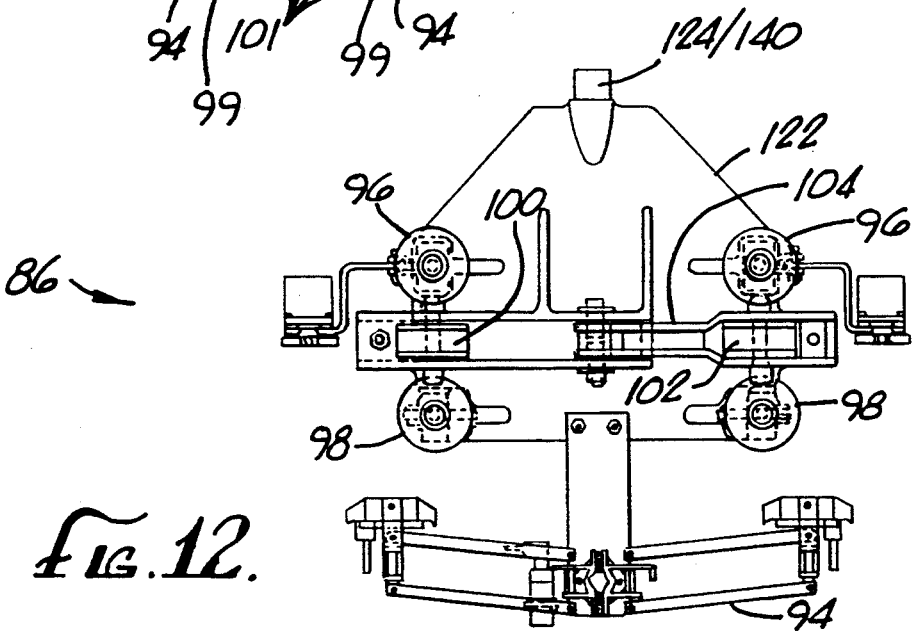
FIG. 12 is a side elevational view of the bogie.

FIGS. 10–12 show a bogie apparatus 86 for connecting the ride vehicle 10 to underground track rails 88 below the surface of the path 18 upon which the vehicle 10 travels. In one embodiment, as shown in FIG. 5, for example, there are two bogies comprising a front bogie 90 and a rear bogie 92. These bogies 90 and 92 have several common features. With reference to FIGS. 8–10, each of the bogies 90 and 92 has several sets of wheels for rolling engagement with a pair of spaced, parallel rails 88 positioned under the path or surface 18 on which the vehicle 10 travels. As explained below, these sets of wheels securely attach the bogies 90 and 92 to the rails 88. The front bogie 90 also is provided with two bus bar collectors 94 per bus rail. These bus bar collectors 94 are spring tensioned to maintain the necessary contact forces between the collector 94 and a bus bar 95 to provide the A.C. electrical power used to drive the electric motor 32 and control system signals for the ride vehicle 10.

Each bogie 90 and 92 has a multiple wheel arrangement comprising load wheels 96, up-stop wheels 98, static guide wheels 100 and active guide wheels 102. The load wheels 96, of which there are four, ride on the top of the track rails 88 and support the weight of the bogies 90 and 92. The up-stop wheels 98, which also are four in number, are located on the bottom of the bogies 90 and 92 and inhibit upward motion. These wheels 98 preferably are designed with a small clearance relative to the rails 88 so as not to add to the rolling resistance of the bogie 90 or 92. There are two static guide wheels 100 to prevent lateral motion of the bogie 90 or 92 into the side of the track rail 88. Finally, two active guide wheels 102 mounted on pivoting arms 104 pre-load and center the bogie 90 or 92 and also inhibit lateral motion of the bogie into the side of the opposing track rail 88. Each of these wheels 104 also is provided with a spring tensioner 106 for the pre-loading and centering function.

The front bogie 90 is connected to the vehicle's front steering system and, therefore, is subjected to front steering loads. The rear bogie 92 is essentially free of normal operating loads, other than its own weight, and is towed along the track through its connection to the vehicle's lateral energy absorbing system described below.

The bus bars 95 preferably have a stainless steel wear surface and may comprise aluminum bars having a 200 amp capacity. For example, the Wampfler Model 812 bus bar has been used and found to be suitable. The bus bar collectors 94 preferably have a wear surface comprising copper graphite. The bus bars 95 preferably are installed in an open downward position to prevent debris from entering the bars and shortening their life.

Figure 13:
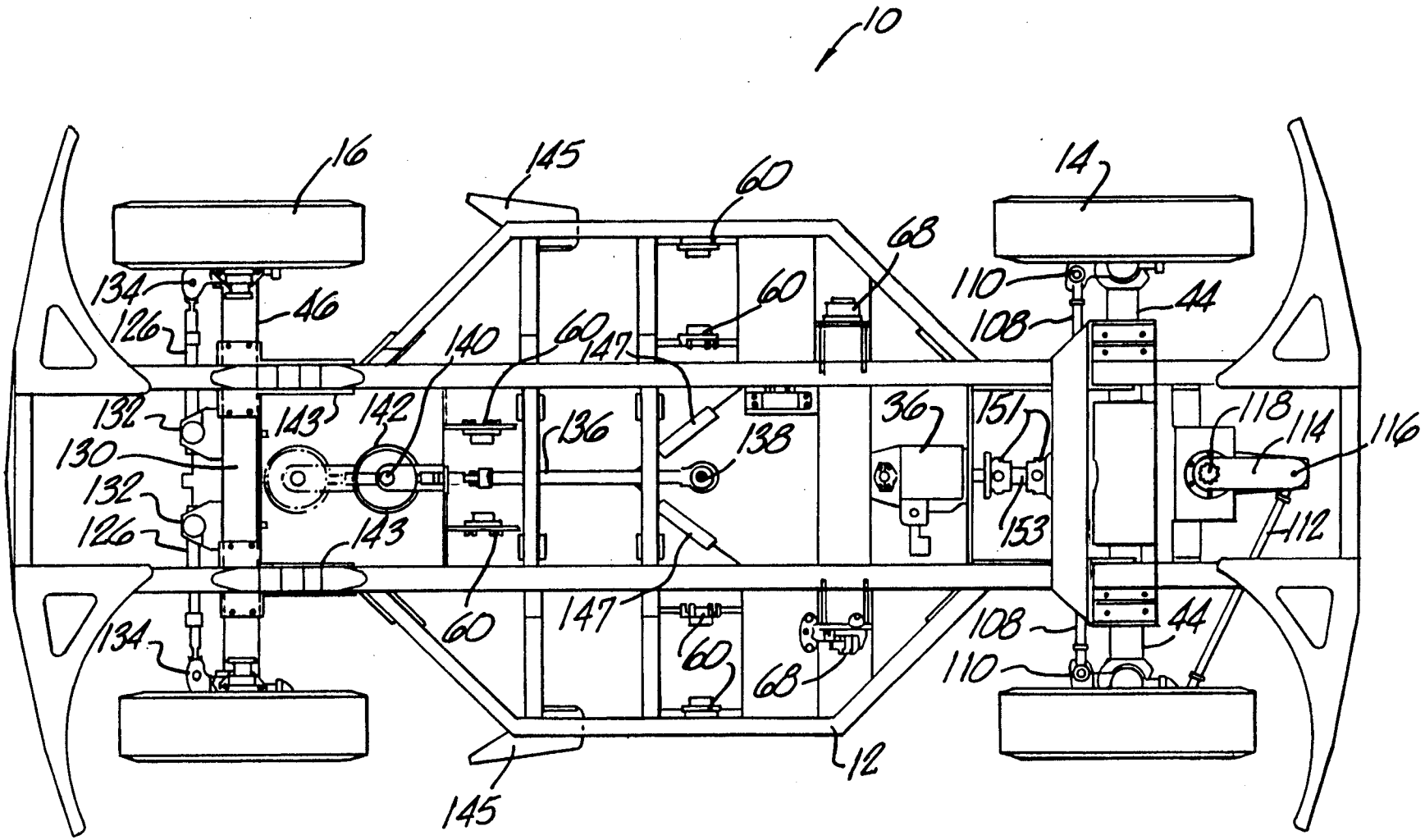
FIG. 13 is a top plan view of the ride vehicle chassis illustrating one embodiment of a steering mechanism and a lateral energy absorbing system of the ride vehicle.
Figure 14:
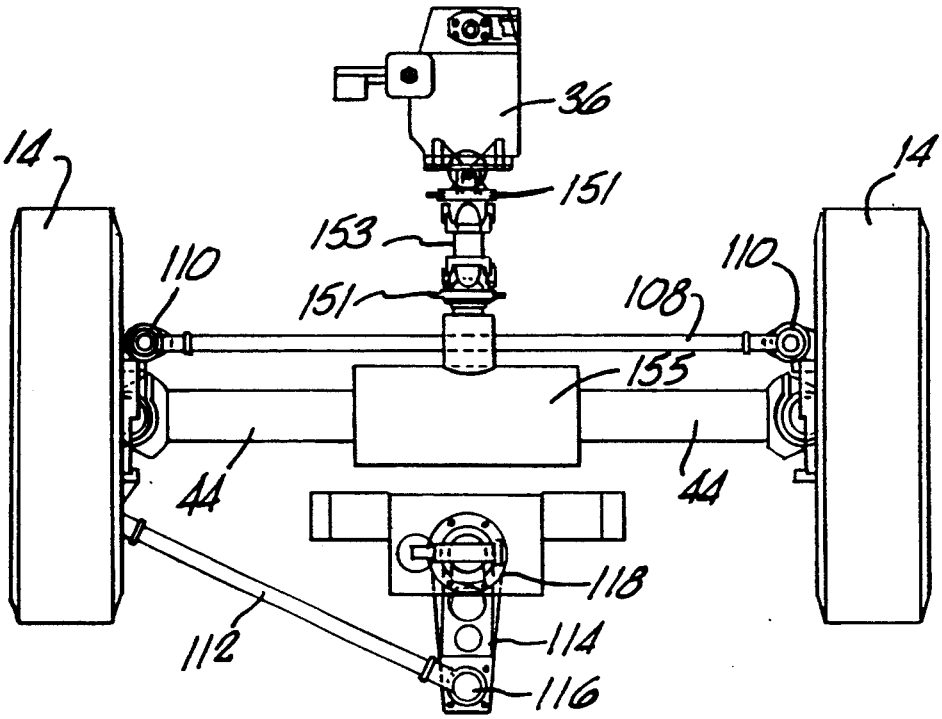
FIG. 14 is an enlarged top plan view of one embodiment of a front steering mechanism of the ride vehicle.
Figure 15:
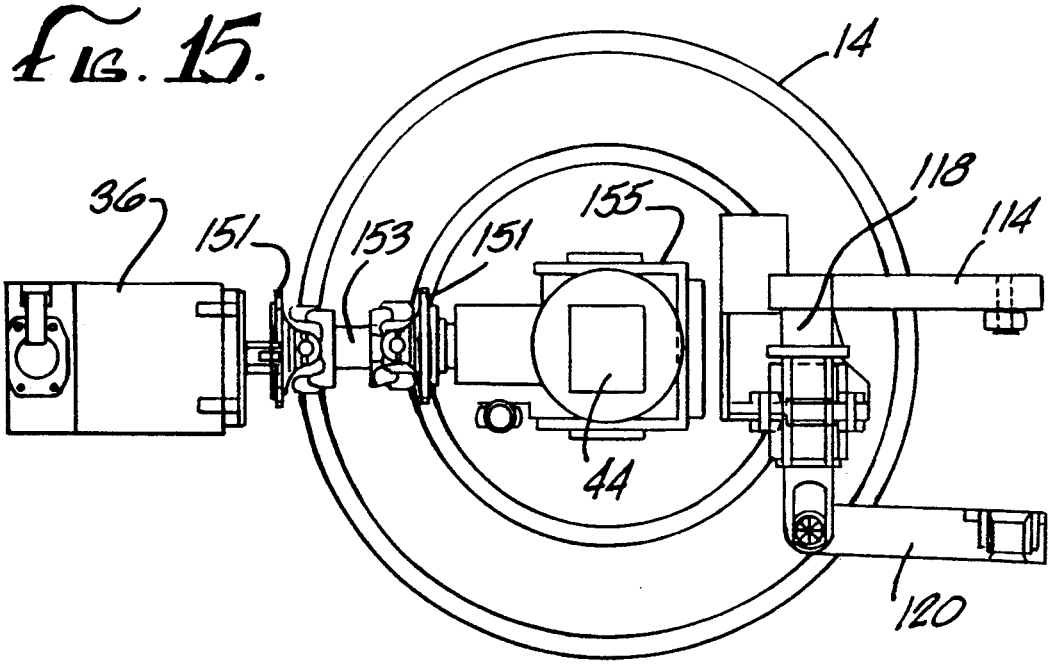
FIG. 15 is an enlarged side elevational view of a portion of the front steering mechanism shown in FIG. 14.

As shown best in FIGS. 13–15, the vehicle's front wheels 14 are steered in one embodiment via a mechanical steering system that uses the curvature of the path 18 to steer the front wheels. More particularly, the two front wheels 14 are connected to the chassis 12 for rotation by the front axles 44, using zero king pin inclination. The two front wheels 14 also are linked together by a linkage arm 108, such that turning motion of one front wheel 14 is automatically transferred via the linkage arm 108 to the other front wheel 14. The two ends of the linkage arm 108 are connected to the front wheels 14 by conventional ball and joint connections 110.

One of the front wheels 14, such as the right-front wheel, is connected by a steering bar 112 to an upper steer arm 114 via ball and joint connections 116. The upper steer arm 114 is connected by a vertical spline shaft 118 to a lower input arm 120 such that horizontal pivoting motion of the lower input arm 120 about the axis of the vertical spline shaft 118 is directly translated into corresponding horizontal pivotal movement of the upper steer arm 114. The lower end of the spline shaft 118 is pivotally connected to the lower input arm 120 to accommodate up and down movement of the lower input arm caused by the grade of the path 18. The lower input arm 120 is, in turn, bolted to the front bogie 90 via a front follower 122 and a plain spherical bearing 124.

With the foregoing front steering arrangement, it can be seen that steering of the front wheels 14 is governed by the curvature of the path 18. Thus, on a straight path 18, the front wheels 14 point straight ahead. However, when the front bogie 90 follows a turn in the path 18, causing non-linear movement of the front bogie, the lower input arm 120 is caused to pivot with respect to the bogie 90 via the plain spherical bearing 124. This pivoting motion of the lower input arm 120 is transferred via the spline shaft 118 to the upper steer arm 114 which, in turn, moves the steering bar 112 causing the right-front wheel 14 to turn in the direction of the path turn. This turning motion of the right-front wheel 14 is transferred via the linkage arm 108 to the left-front wheel 14 to provide coordinated steering of the two front wheels in unison.

Figure 16:
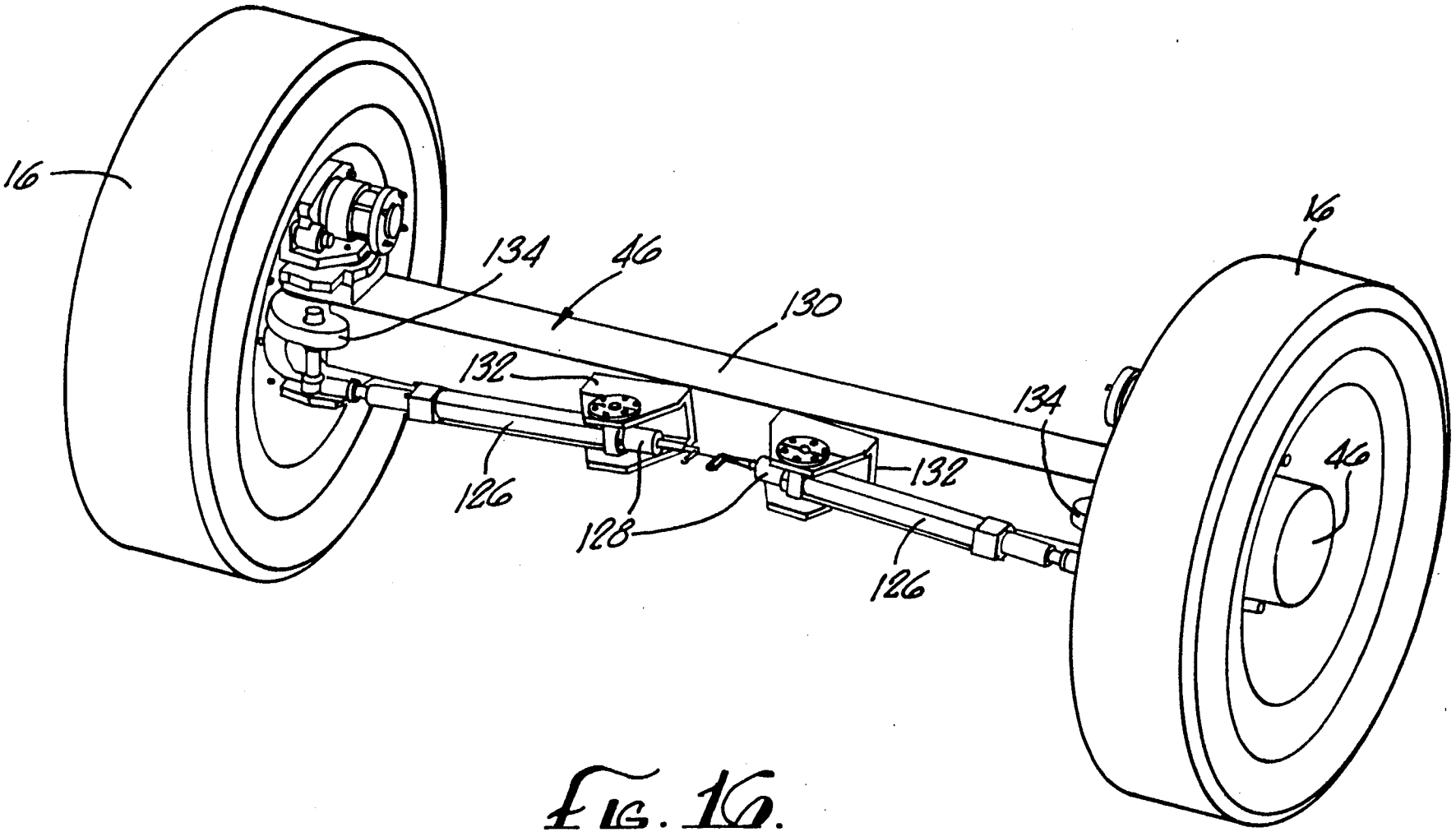
FIG. 16 is a rear perspective view of one embodiment of a rear steering mechanism of the ride vehicle.
Figure 18:
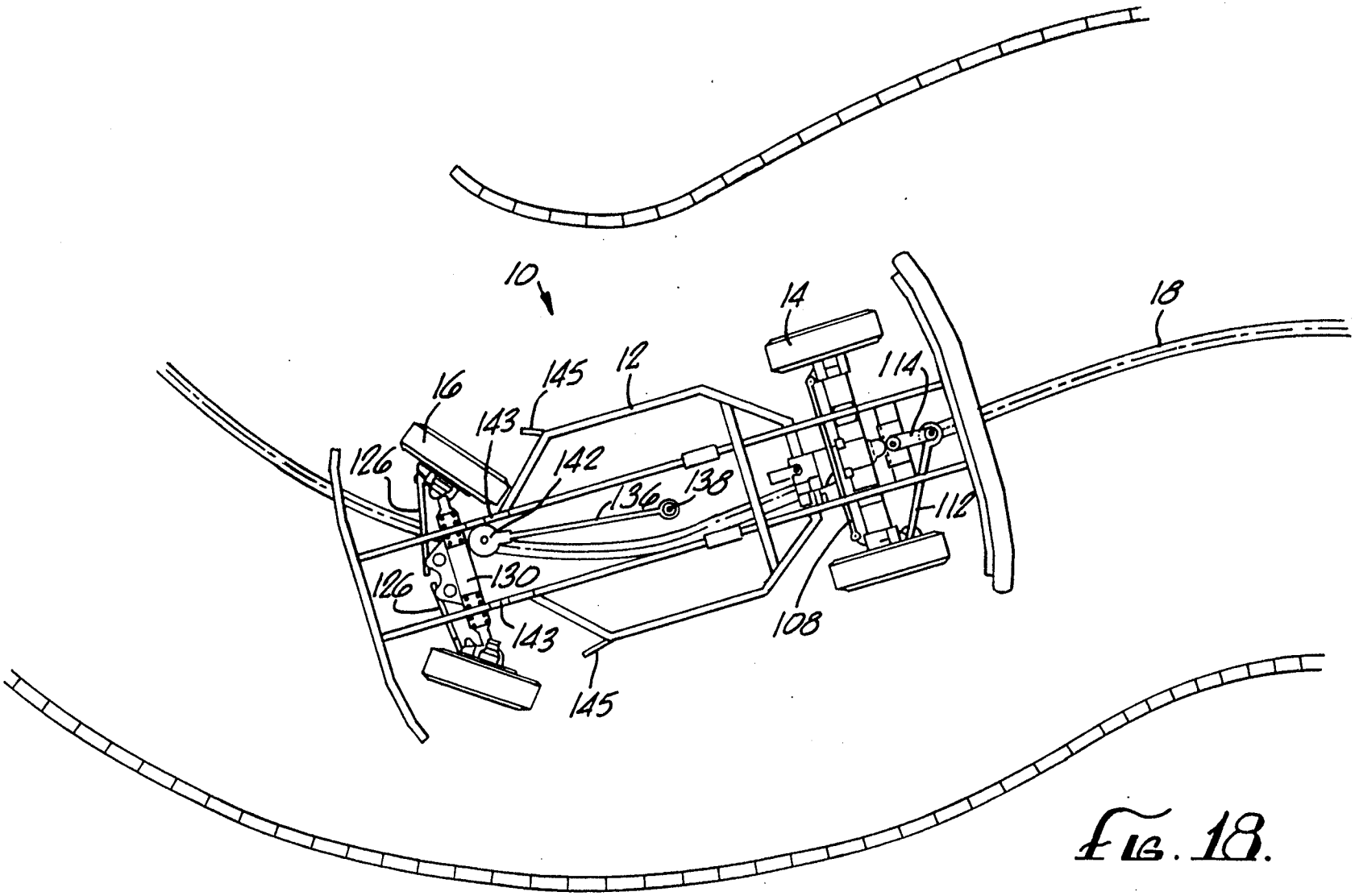
FIG. 18 is a cross-sectional plan view of the ride vehicle illustrating the lateral energy absorbing system operating in a first mode to confine the range of lateral motion of the vehicle with respect to the path to a first distance.
Figure 19:
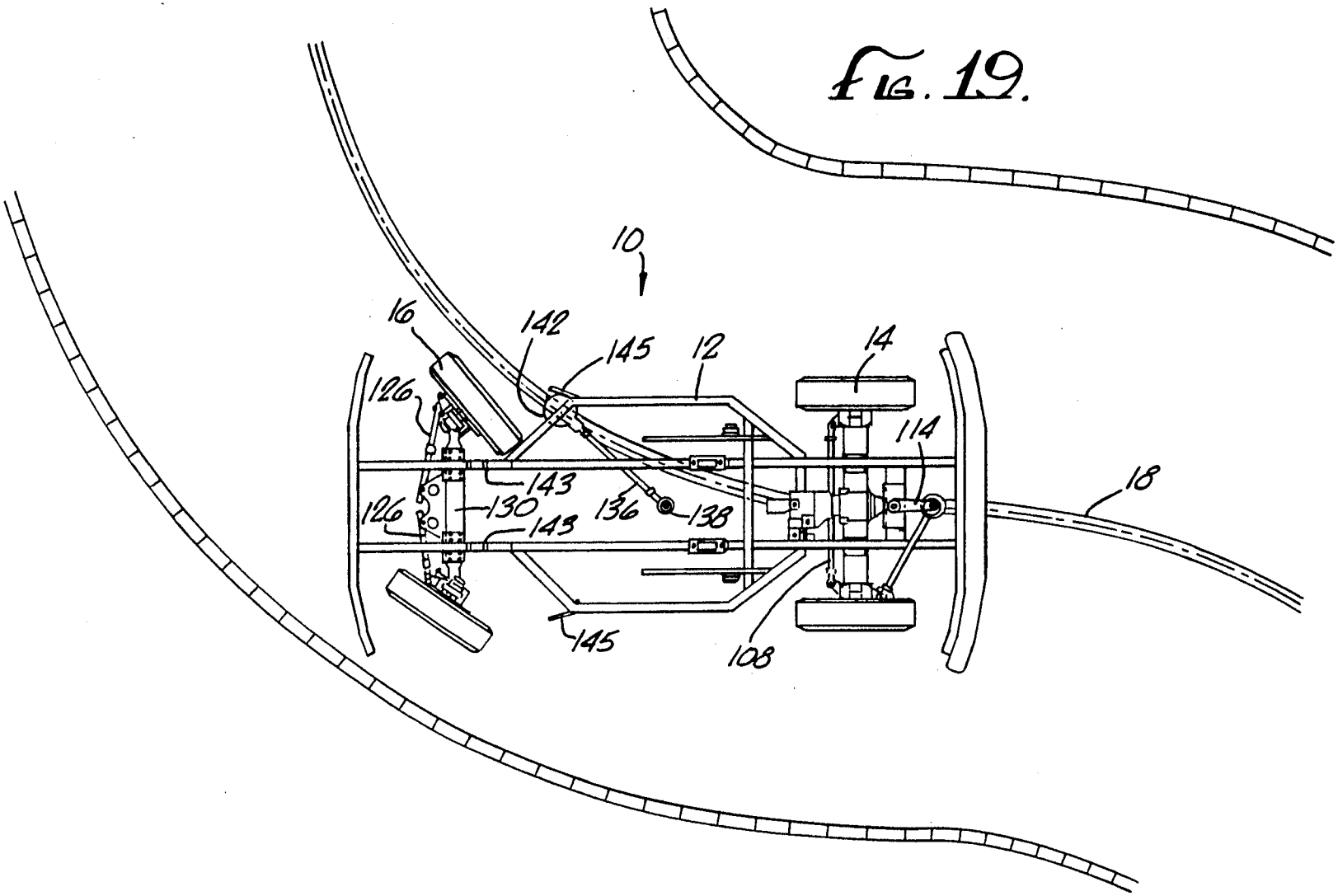
FIG. 19 is another cross-sectional plan view of the ride vehicle illustrating the lateral energy absorbing system operating in a second mode to confine the range of lateral motion of the vehicle with respect to the path to a second distance.

In one aspect of the invention, steering of the rear wheels 16 is independent of steering of the front wheels 14 to increase the versatility of motion of the ride vehicle 10. As shown in more detail in FIGS. 13 and 16, the steering of each rear wheel 16 is controlled by separate hydraulic steering servo actuators 126. These steering actuators 126 are connected to the hydraulic control system of the vehicle 10 and are controlled by the vehicle control system 40 in combination with feedback signals from sensors 128 to control the movement of the actuators 126 and, thus, the steering of the rear wheels 16. FIGS. 18 and 19 show the range of steering motion of the rear wheels 16 in more detail.

In particular, the inner ends of the steering actuators 126 are mounted to the vehicle's rear axle beam 130 by brackets 132 with pivotal connections. The outer ends of the steering actuators 126 are mounted to trunion mountings 134 at the rear axle 46 via plain bearings. The trunion mounting 134 for the actuators 126 incorporates motion in two axes to allow for build tolerances. The steering actuators 126 are controlled by the hydraulic control system through appropriate tubing.

Figure 17:
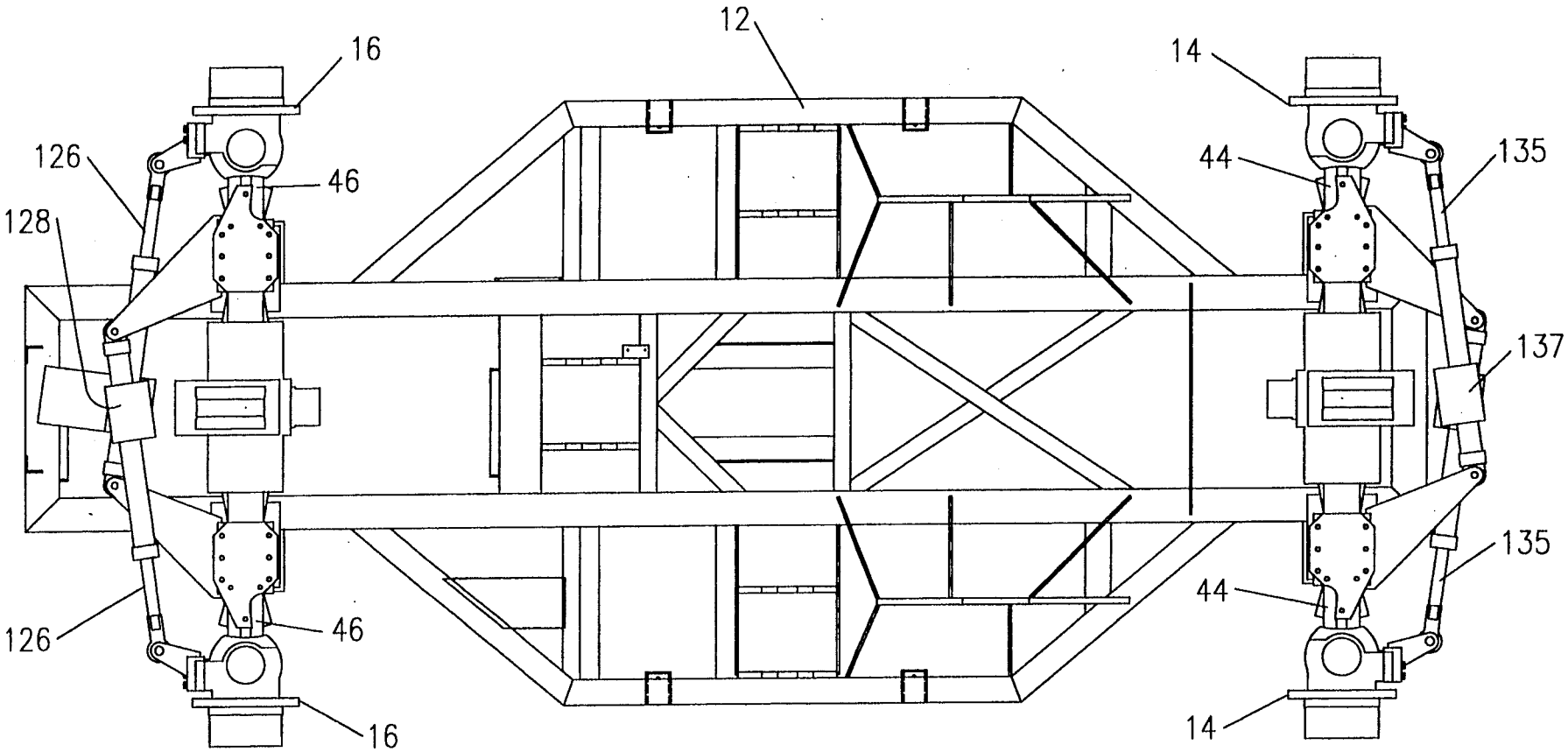
FIG. 17 is a top plan view of the chassis showing another embodiment of a steering mechanism of the ride vehicle.

In another embodiment, shown in FIG. 17, the steering of the front wheels 14 may be carried out in the same manner as the steering of the rear wheels 16, by using separate front steering servo actuators 135. The front steering actuators 135 also are connected to the hydraulic control system of the vehicle 10. These actuators 135 are controlled by the vehicle control system 40 in combination with feedback signals from sensors 137 to control the movement of the actuators 135 and, thus, the steering of the front wheels 14. Using this arrangement, the steering of the front wheels 14 is independent of the curvature of the path 18 followed by the vehicle 10.

The foregoing embodiments, which provide independent steering of the front wheels 14 and the rear wheels 16, allow a wide range of vehicle motion not otherwise possible with conventional ride vehicles, which have either had front wheel steering or rear wheel steering (but not both), or no steering capabilities at all for vehicles that are totally track dedicated. The examples of vehicle motion enabled by four-wheel steering include the simulated effect of the vehicle 10 fishtailing, such as during rapid acceleration or deceleration of the vehicle, or sliding sideways as on ice or an oil slick. The turning of corners can also be exaggerated by using four-wheel steering, which substantially enhances the general overall mobility and turning capabilities of the vehicle 10. These and other vehicle movements are described later.

FIGS. 13 and 18–19 also illustrate one embodiment of a lateral energy absorbing system of the vehicle which defines the maximum rear offset of the vehicle 10 with respect to the path 18, and which allows the vehicle 10 to move laterally with respect to the rear bogie 92 within a pre-determined tracking envelope defined by the maximum rear offset. In the event that the vehicle 10 transgresses the tracking envelope, the lateral energy absorbing system absorbs lateral loads and, under certain conditions, completely disables operation of the vehicle 10. In this way, the passengers 48 in the vehicle will not be subjected to unsafe accelerations, jerks or other violent movements of the vehicle beyond specified limits, to help ensure the passenger's safety.

The lateral energy absorbing system comprises a rear follower lockout actuator 136 pivotally connected to the chassis 12 by a pivot shaft 138 and to the rear bogie 92 via a spherical bearing 140 on a rear follower 142. The lockout actuator 136 is designed to operate in two distinct modes related to the degree of curvature of the vehicle's path 18. The path 18 shown in FIGS. 18–19 comprises a channel forming a roadway that allows some lateral movement of the dynamic ride vehicle 10.

The lockout actuator 136 is designed to operate in a first mode when the vehicle 10 follows a path 18 at a narrow portion of the attraction, where it is necessary to maintain a shallow envelope, as shown in FIG. 18. In the first mode, the lockout actuator 136 is in a fully extended position. In this fully extended position, an energy absorbing pad 142 at the rear portion of the actuator 136 is laterally confined between two vertical plates 143 spaced apart by a first distance on the chassis 12.

The lockout actuator 136 is designed to operate in the second mode when the vehicle 10 is required to maneuver at portions of the path 18 within a wider envelope, as shown in FIG. 19. In the second mode, the lockout actuator 136 is in a fully retracted position. In this fully retracted position, the energy absorbing pad 142 at the rear portion of the lockout actuator 136 is laterally confined between two oppositely facing vertical blades 145 on the chassis 12 which are spaced apart by a second distance that is greater than the first distance previously described.

In the event that the vehicle chassis 12 attempts to move laterally with respect to the rear bogie 92 by an amount that exceeds either the first distance (when the lockout actuator 136 is fully extended in the first mode, as shown in FIG. 18), or the second distance (when the lockout actuator 136 is fully retracted in the second mode, as shown in FIG. 19), then the energy absorbing pad 142 will contact either the vertical plates 143 or the vertical blades 145 on the chassis 12 to prevent further lateral movement. Moreover, when the lateral movement of the chassis 12 attempts to exceed a respective one of these distances, two sensors 147 coupled to the lockout actuator 136 will be activated to cause an E-stop and completely disable the vehicle 10.

With reference to FIG. 13, the sensors 147 are designed to measure the amount of lateral travel of the energy absorbing pad 142 by sensing the amount of rotation of the pivot shaft 138 which connects the front end of the lockout actuator 136 to the vehicle chassis 12. Under appropriate operating conditions and proper programming of the ride vehicle 10, the lateral motion of the vehicle with respect to the rear bogie 92 is designed such that the energy absorbing pad 142 will not completely travel either the first or second distance and will avoid contacting one of the vertical plates 143 or blades 145. Instead, the energy absorbing pad 142 will stop just short of the plates 143 or blades 145 under a maximum travel condition (i.e., the tracking envelope). However, should the energy absorbing pad 142 attempt to exceed the tracking envelope, the sensors 147 will cause the E-stop and completely disable the vehicle 10. The lockout actuator 136 is moved to the extended and retracted positions by the hydraulic control system based on commands provided by the vehicle control system 40.

The lateral energy absorbing device is also disclosed in detail in pending U.S. application Ser. No. 08/109,174, filed Aug. 19, 1993, which is incorporated herein by reference. (This pending application is entitled VEHICLE LATERAL ENERGY ABSORBING DEVICE, names Edward B. Fritz as inventor, and corresponds to attorney docket no. P01 31534).

Figure 20:
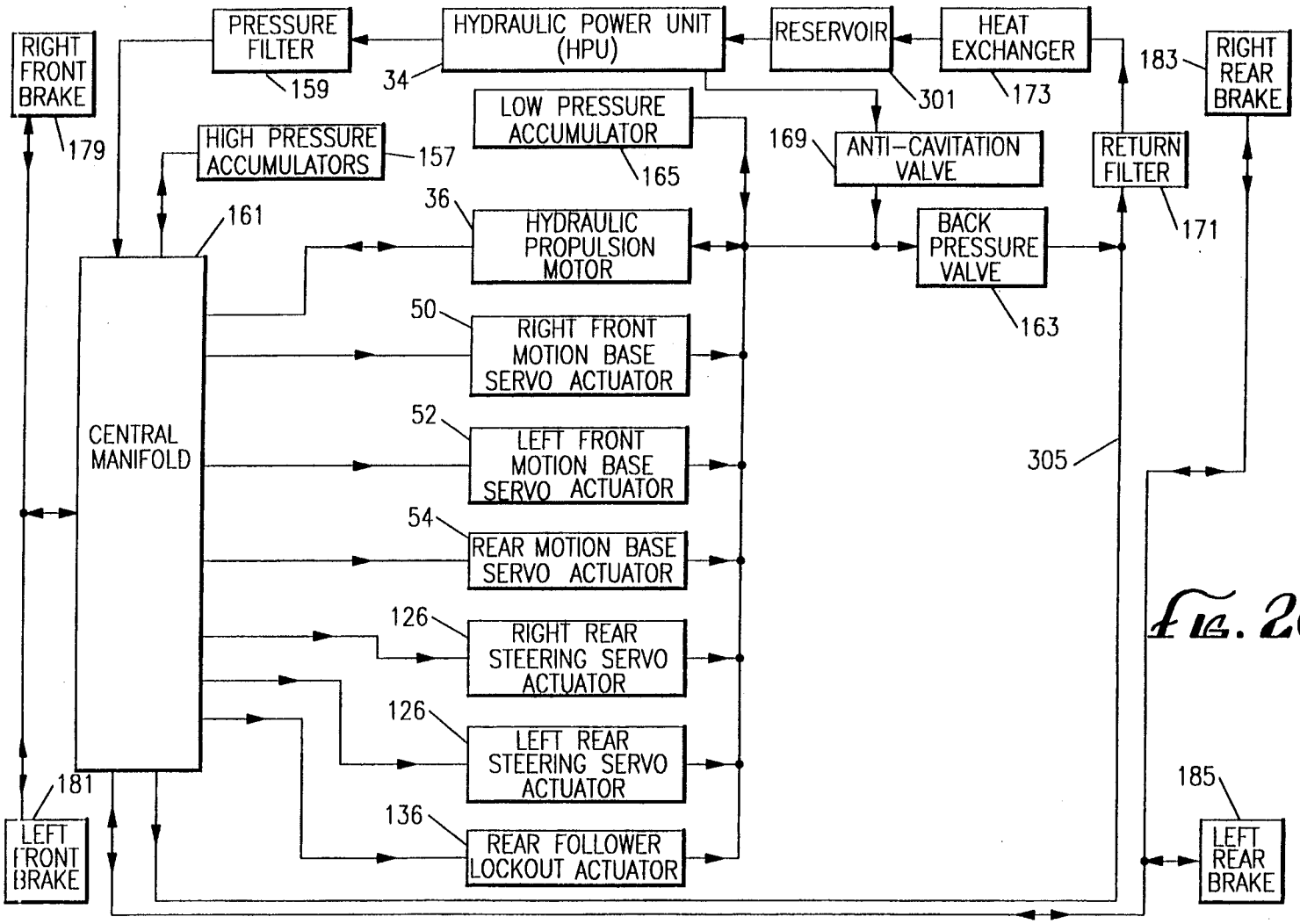
FIG. 20 is a block diagram of one embodiment of a hydraulic system used to operate the motion apparatus, rear steering mechanism and other components of the vehicle.
Figures 21, 21A, 21B:
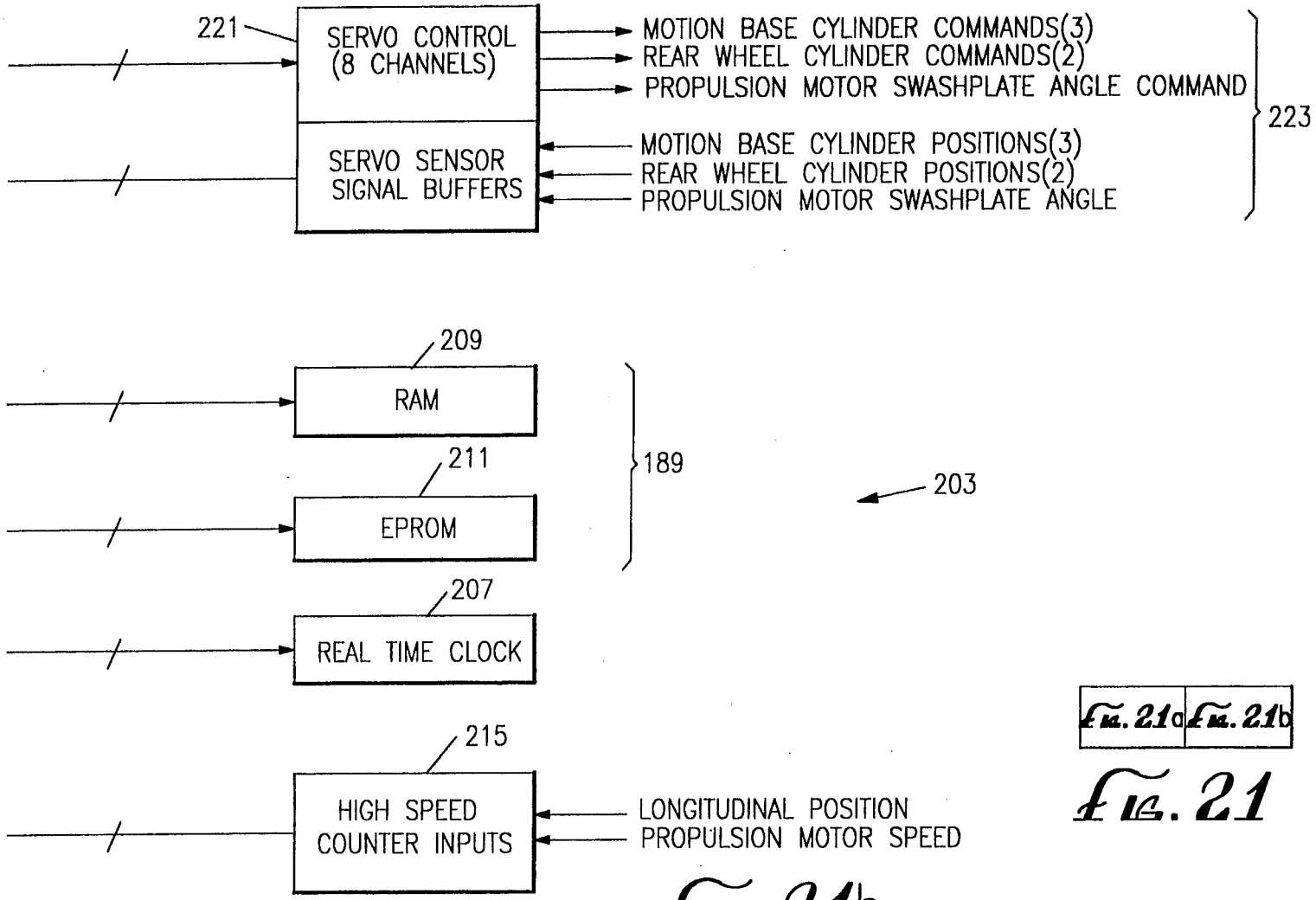
FIG. 21 is a composite drawing consisting of FIGS. 21A and 21B which together form a block diagram showing the architecture and wiring of a computer that controls various vehicle functions.
FIG. 21A is the first half of the composite drawing of FIG. 21, and shows various elements of the computer of FIG. 21, including a CPU.
FIG. 21B is the second half of the composite drawing of FIG. 21, and shows various elements of the computer of FIG. 21, including a servo control.
Figure 21A:
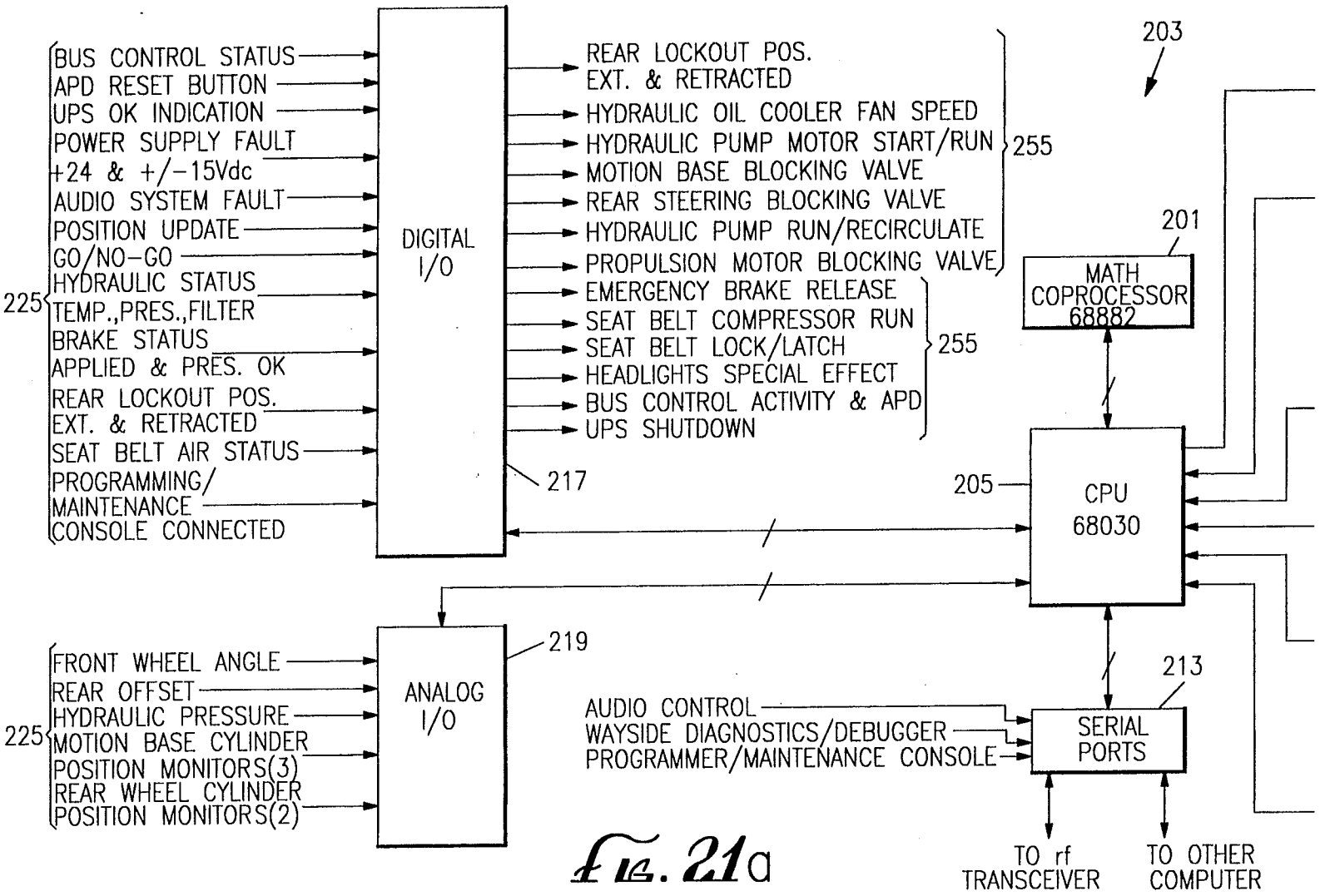

FIG. 20 is a block diagram illustrating the hydraulic control system for providing hydraulic power to the various actuators and other components of the ride vehicle 10. A three-phase, 480 volt power supply, tapped from the power bus 97, drives the electric motor 32, which in turn drives the hydraulic power unit 34. The hydraulic power unit 34 is responsible for providing the energy for all of the ride vehicle's actuators, and operating the hydraulic motor 36. As shown in FIG. 13, the output of the hydraulic motor 36 is transferred by couplings 151 to a differential ratio gear box 155. Differential and planetary gears inside the gear box 155 create a 20:1 ratio for driving the front wheels 14. In the preferred embodiment, the hydraulic motor 36 is a 125 cubic centimeter variable displacement hydraulic motor (manufactured by the Rexroth Corporation, of Bethlehem, Pa.) and is mounted to the ride vehicle chassis 12. A tachometer (not shown) measures the hydraulic motor's output shaft rotations-per-minute ("rpm"). This information is sent as a servo signal input to the vehicle control system 40, which monitors the motor's speed, while stroke displacement transducers (also not shown) measure hydraulic displacement of the hydraulic motor's pistons to provide for controlled acceleration, deceleration and velocity of the ride vehicle 10. Using a nested control loop in software to monitor this arrangement, the ride vehicle 10 travels at speeds of up to about 15 miles per hour.

An important function of the hydraulic power unit 34 is to charge high-pressure accumulators 157 with hydraulic energy. FIG. 5 shows the location of these accumulators 157 at the rear of the ride vehicle. These accumulators are used for ride vehicle propulsion, actuation of the motion base 24 and for steering of the rear wheels 16. The hydraulic power unit 34 supplies this hydraulic energy by pumping hydraulic fluid through a pressure filter 159 through a central manifold 161 and subsequently to the high-pressure accumulators 157. The primary function of the high-pressure accumulators 157 is to store and save energy for supply on demand to the various energy users of the hydraulic system. These energy users comprise the hydraulic motor 36, the left-front motion base servo actuator 50, the right-front motion base servo actuator 52, the rear motion base servo actuator 54, the right-rear steering servo actuator 126, the left-rear steering servo actuator 126 and the rear follower lockout actuator 136. Each of these actuators, except for the follower lockout actuator 136, has a servo valve which controls the flow of pressurized hydraulic fluid to the actuators according to a command from the vehicle control system 40.

The hydraulic control system also includes a back pressure valve 163 that maintains a predetermined amount of back pressure in a low-pressure accumulator 165. In the preferred embodiment, the back pressure valve 163 has a one-hundred and thirty-five pounds-per-square-inch gauge ("psig") setting. The low-pressure accumulator 165 is designed to store extra hydraulic fluid that may be needed by the hydraulic propulsion motor 36 when the ride vehicle 10 is decelerating, to thereby provide regenerative braking, as will be explained below.

An anti-cavitation valve 169, a return filter 171 and a heat exchanger 173 also are provided to complete the hydraulic control system. The anti-cavitation valve 169 prevents damage to the hydraulic propulsion motor 36 in the event that the low-pressure accumulator 165 is completely depleted of hydraulic fluid. Under these circumstances, the anti-cavitation valve 169 supplies hydraulic fluid under atmospheric pressure to the hydraulic propulsion motor 36 to prevent it from cavitation damage. The return filter 171 filters the returning hydraulic fluid, and the heat exchanger 173 cools the fluid before it is returned to a reservoir 301.

In addition to the heat exchanger 173, cooling of the hydraulic fluid also is provided by a cooling fan 175 driven by an output shaft of the electric motor 32. The cooling fan 175 is designed to run whenever the hydraulic system is powered. The fan 175 includes a shroud 177 that directs airflow through the heat exchanger 173 and over the electric motor 32. The shroud 177 also encloses the electric motor 32, hydraulic pump 34 and cooling fan 175. The return filter 171 is used to keep debris out of the hydraulic fluid before it enters the heat exchanger 173.

The hydraulic control system also is used to control operation of the ride vehicle's emergency brakes. These brakes comprise a right-front brake 179, a left-front brake 181, a right-rear brake 183 and a left-rear brake 185. In the preferred embodiment, the ride vehicle's brakes 179, 181, 183 and 185 are spring applied disc brakes of the failsafe type. The hydraulic system for the brakes involves a bi-directional hydraulic fluid flow. To apply the brakes 179, 181, 183, and 185, hydraulic fluid is withdrawn from the brakes through a return line to the central manifold 161 and return filter 171. This releases the brake springs and applies spring force to cause braking action. To release the brakes 179, 181, 183 and 185, pressurized hydraulic fluid is supplied to the brakes to compress the springs and remove the spring force. The emergency brakes are used primarily during an emergency stop, or during passenger unloading and unloading, to thereby "park" the ride vehicle. During movement of the ride vehicle 10 in accordance with one of the ride programs, however, dynamic braking of the ride vehicle using the hydraulic motor 36 is preferred means of braking vehicle motion.

The hydraulic control system includes several special features. In one aspect of the hydraulic control system, illustrated diagrammatically in FIGS. 18A and 18B, the hydraulic motor 36 is designed to recover kinetic energy that is created when the ride vehicle 10 is braking or decelerating.

As noted above, pressurized hydraulic fluid flows from the high-pressure accumulators 157, through the hydraulic motor 36 to propel the ride vehicle 10, and then into the low-pressure accumulator 165 when the ride vehicle is accelerated (according to ride program data from a sequence of data). The motor speed is controlled according to a predetermined vehicle speed profile, defined by a sequence of data of a particular ride program. Each particular piece of data represents vehicle speed at a particular position (defined in the preferred embodiment according to one of distance and time), and a software loop adjusts the angle of a swashplate via a control valve 303 to allow appropriate displacement of the hydraulic motor 36 to match vehicle speed and the hydraulic energy presently stored in the high-pressure accumulators 157 (which is at approximately 3500 psig pressure). Spent hydraulic fluid pressurizes the low-pressure accumulator 165 to approximately 135 psig, and additional hydraulic fluid is dumped through the back pressure valve 163 through a return line 305 to the reservoir 301.

The swashplate angle, although driven to a positive angle when the vehicle is called upon to accelerate or maintain a velocity, is generally driven to a negative angle when the vehicle is called upon to decelerate. In this case, the hydraulic motor 36 provides resistance to continued vehicle motion, and the kinetic energy of the ride vehicle 10 causes the motor to pump hydraulic fluid from the low-pressure accumulator into the high-pressure accumulators 157, to thereby transfer the kinetic energy of the ride vehicle 10 to hydraulic energy stored in the high-pressure accumulators.

The recovered energy is thus stored in the high-pressure accumulators 157 for future use by any of the hydraulic control system's other energy users, such as the motion base servo actuators 50, 52 and 54, the steering actuators 126, or the hydraulic motor 36. The energy stored in the high-pressure accumulators 157 can be especially useful when it is necessary to execute rapid and continuous movements with the motion base servo actuators 50, 52 and 54 requiring a high-horsepower output.

By recovering energy during braking and decelerating and storing it in the high-pressure accumulators 157, the hydraulic motor 36 essentially functions as a pump and allows the system to store and subsequently provide higher peak output horsepower upon demand than would otherwise be obtainable from a conventional hydraulic power unit and control system. As a result, a relatively smaller horsepower hydraulic power unit 34, on the order of about 50 horsepower, may be used. However, in view of the ability of the system to store large volumes of hydraulic energy, the system can still provide peak horsepower outputs that far exceed the horsepower of the hydraulic power unit 34, by a factor of three or more.

The hydraulic control system is also disclosed in detail in pending U.S. application Ser. No. 08/109,172, filed Aug. 19, 1993, which is incorporated herein by reference. (This pending application is entitled RIDE VEHICLE CONTROL SYSTEM, names Jeffrey G. Anderson and William L. Wolf as inventors, and corresponds to attorney docket no. P01 31535).

Control over the path 18 and all ride vehicles 10 currently running in the attraction is achieved by a central controller, called the "Wayside Interface" in the preferred embodiment. This Wayside Interface includes an operator interface in a "Wayside Station," where passengers embark and disembark, and where a human operator can control the operation of the entire attraction. The Wayside Interface uses the power bus 97, comprised of six bus bars 95 (FIG. 11), to control ride vehicle power by path segment, or zone, and also radio (rf) communication to interact with vehicle control system 40 on each ride vehicle 10.

The vehicle control system aboard each ride vehicle 10 includes two vehicle computers that are responsible for conducting the ride experience in a programmable manner, and accordingly, the ride experience may be distinct for each ride vehicle 10. Programming and maintenance are effected by a special programming console, assisted by use of an off-line editor. More details about ride vehicle control will be discussed further below.

As shown in FIGS. 11 and 12, the power bus 97 is comprised of six adjacent bus bars 95, three just left of the center of the path 18 and three just to the right of the center of the path. The left three bus bars 95 supply four hundred eighty volts in three phases, one voltage phase carried by each bus bar, for meeting each ride vehicle's power requirements. Most aspects of ride vehicle control, including propulsion, are achieved by hydraulic power, which is derived from the hydraulic power unit 34, essentially a large electric pump. In addition, the power bus 97 supplies electric power that drives each ride vehicle's other electric elements, for example, a pneumatic compressor motor (not shown), and peripherals, including headlights 187 and the sound module 41. The three bus bars 94 just right of center provide a ground signal, a twenty-four volt go signal and a twenty-four volt, variable-impedance, "no-go" signal (which indicates the presence of a ride vehicle), the latter two being specific to each zone, or path segment. That is, in cases of emergency, the central controller can lower the go signal for each specific zone or all zones to disable forward motion of the ride vehicle 10 along the path.

Each ride vehicle 10 when operating, and in response to the go signal, places a voltage upon the "no-go" bus bar, which indicates to the Wayside Interface that a first ride vehicle is present in the particular zone. If a second ride vehicle becomes too close in spacing along the path 18 to the first vehicle, the central controller detects the presence of two ride vehicles in adjacent zones and disables the go signal to the zone of the second vehicle, until the first vehicle has left the zone that it occupies. A hypothetical alternative embodiment could, within the context of the present invention, utilize a no-go signal by direct communication between vehicle and central controller by defining a zone to be a variable quantity, determined by the location of the first vehicle. In other words, ride vehicle position could equivalently be directly monitored by the central controller without the use of zone-specific bus bars.

During use of these two bus bars 95 (go and no-go), power is continuously supplied to the ride vehicles via the three bus bars just left of center.

The Wayside Interface also communicates with each ride vehicle 10 for monitoring the ride vehicle's status, principally when the ride vehicle is in a zone where it loads and unloads passengers 48. Thus, each rf signal may be digitally addressed to a specific ride vehicle, or in the alternative, infrared communication may be used (instead of rf communication) and communication confined to a small, ride vehicle specific area adjacent to the Wayside Station. As an alternative embodiment, a specific line of the power bus may be devoted to digital communications between each of the ride vehicle and central controller, with the specific line being tapped by each ride vehicle and communications specifically addressed within the system, to either a particular vehicle or the central controller. Alternatively, other forms of communication, for example, modulation of power or the go signal, may be utilized in well-known fashion.

These digital communications are utilized by the Wayside Interface to request and receive ride vehicle diagnostic information, and to select a particular ride program stored among a plurality of such programs in electronic memory 189 aboard each ride vehicle. The diagnostic information requested by the Wayside Interface includes, for example, ride vehicle operating status, mode, ride vehicle subsystem fault indications, computer fault indications, current ride program, longitudinal position with respect to the path length, ride vehicle ID, and time of day.

The front bogie of the ride vehicle mounts two position sensors 99 on each side, for a total of four track position proximity-type update sensors. These sensors sense the proximity of path-mounted position markers 473 and 475, each consisting of a number of metal targets 101 mounted within the track, just below the front bogie, as seen in FIG. 9.

In addition to these proximity sensors 99, two idler wheels 103 of the front bogie are used as redundant incremental longitudinal position sensors, in the form of rotary encoders. These encoders, each a quadrature sensor, provide 360-pulse-per-rotation 90-degree phase-shifted output signals, which are coupled to a velocity polarity sensor (which detects forward and reverse velocity) and to high-speed counter inputs 215. These inputs 215 are read and formatted to a total distance measurement, in feet, by the computerized vehicle-control system 40, and are loaded into a distance register. Thus, the ride vehicle 10 keeps track of incremental distance using the idler wheels 103, and uses the update sensors 99 to detect the presence of the path-mounted position markers 473 to detect and correct errors in the tracked position of the ride vehicle. A logic error is ascertained by the computerized vehicle-control system if position errors exceed a relatively small quantity, or if the counter inputs 215 differ by more than a predetermined amount.

Importantly, the idler wheels 103 are utilized instead of a tachometer, which may be subject to error occasioned by slippage and wear of the wheels 14 of the ride vehicle 10. The high speed counter inputs 215 are reset each time that they are read by the CPU 205, and the incremental position measurement is expected to be sufficiently accurate that the position markers 473 may be spaced at great distances, for infrequent detection and update of the incremental position measurements.

As discussed below, the computerized vehicle-control system includes two (principally) redundant computer systems, each operating in parallel to monitor position and other vehicle functions.

Figure 22:
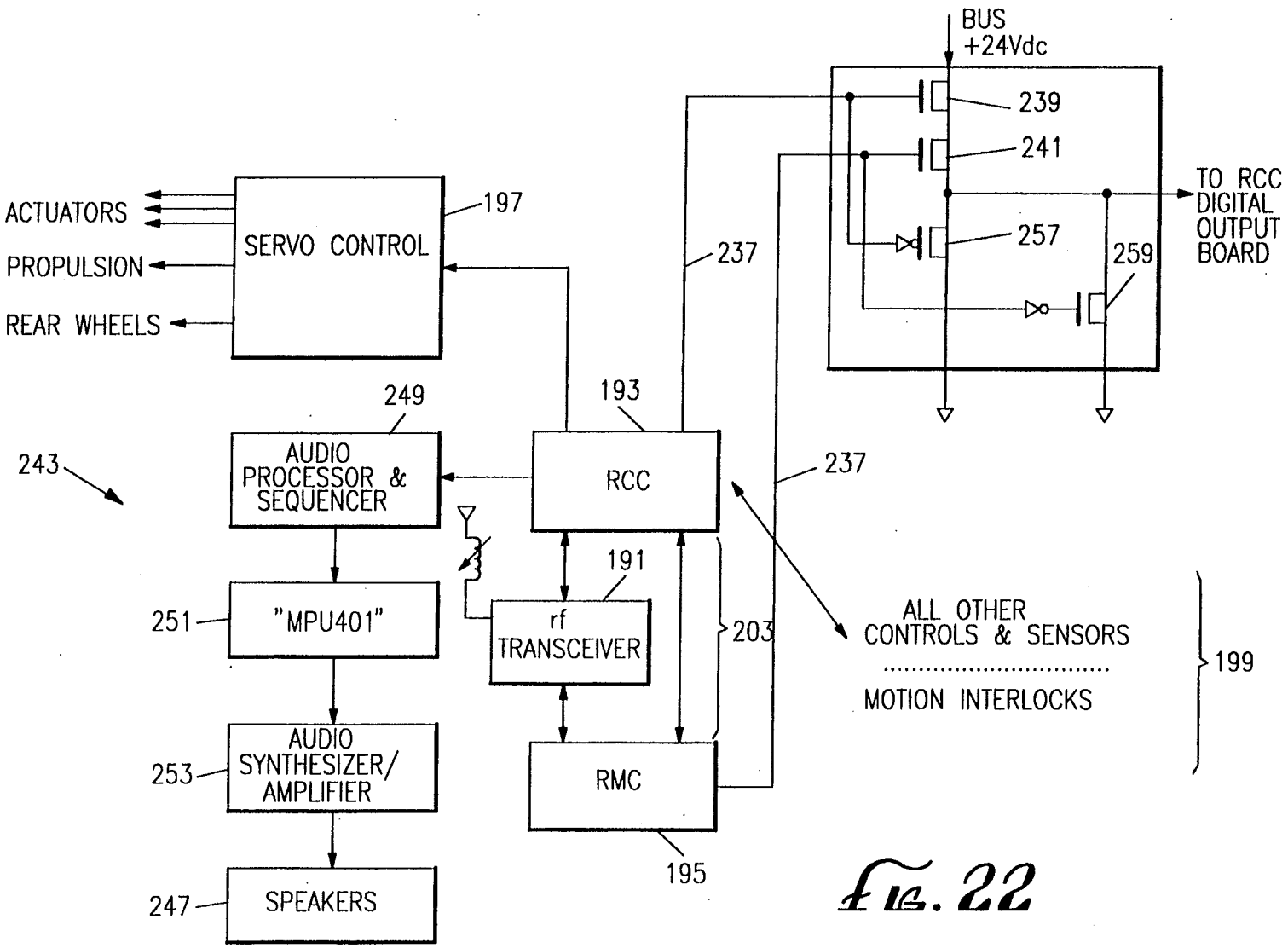
FIG. 22 is another block diagram of the vehicle control system, including two substantially similar computers, used for ride control and for monitoring of ride vehicle actions.

With reference to FIG. 22, the vehicle control system 40 of a single ride vehicle 10 will be briefly described. All of the ride vehicle's digital functions, including the vehicle control system 40, are driven by a twenty-four volt direct current (dc) power supply. This power is derived from the 480-volt, three phase ac power supply provided by the power bus 97, discussed above, through the use of step-down transformers aboard each vehicle that provide 480-volt ac primary to 115-volt ac secondary and a twenty-four volt dc power supply. All other vehicle electronics, including a cooling fan, air compressor, and the vehicle's non-digital audio functions, such as amplification, are driven at 115-volts ac.

Each ride vehicle 10 carries an rf transceiver 191 and two on-board computers 193 and 195, which are nearly identical in configuration, and which are utilized in parallel for safety purposes, as part of a "voting" implementation. One computer 193, called the ride control computer ("RCC"), controls the audio aspects of the ride experience and the servo and digital control elements 197 that control propulsion and ride vehicle motion. Both the RCC 193 and its companion ride monitor computer 195 ("RMC") are separately coupled to the rf transceiver 191 and to parallel sensors and bus controls for shut-down of the ride vehicle. The computers 193 and 195 communicate with each other regarding ride vehicle faults, action and status, by the voting scheme, and alert the Wayside Interface if there is a disagreement between the two computers, indicating a logic fault, or an agreement about a serious status that requires ride vehicle shutdown, for example, critical overheating. Depending upon the status, fault or action, both computers 193 and 195 wait a specific time period to receive a related signal from their companion computer before reaching a conclusion as to agreement or disagreement, mostly necessitated due to tolerance differences between different sensors used in parallel by each computer. The system described, by utilizing two computers 193 and 195 in parallel and the mentioned-voting procedure, provides for added reliability and passenger safety.

As indicated in FIGS. 18A and 18B, each computer 193 and 195 carries its own memory 189, which contains all the program information necessary to run a plurality of different ride programs. In the preferred embodiment, this memory includes eight megabytes of $E^2$-PROM. Each program is stored in a plurality of program portions, each consisting of a plurality of commands which are indexed by time and distance. In this manner, the ride vehicle computers 193 and 195 may independently determine when and where a particular command is to be executed during the ride, and confirm this determination and resultant ride vehicle reaction with the other computer. Each command of each ride program includes a number of digital data values, or commands of each parallel data track, including ride vehicle velocity (including "reverse"), motion base position for each of three axes, offset for the rear of the ride vehicle, audio cues, ride vehicle headlights on and off, and safety functions (including engagement and disengagement of rear follower offset lock-out, lock and release of seat belt tongue and retractor reel, and engagement and disengagement of the motion base actuator block and settling valves). As further discussed below, each ride computer 193 and 195 possesses a math co-processor 201 which is used for all floating point calculations. As indicated above, both the RCC 193 and the RMC 195 are substantially identical in architecture and operate in parallel, and both are generally represented by the reference numeral 203 in FIGS. 18A and 18B.

FIGS. 18A and 18B illustrate the architecture and wiring of one of the computers 203 (RCC and RMC) to the various sensors and controls utilized by the ride vehicle. Each computer has a CPU 205 that includes a Motorola "68030" microprocessor for monitoring ride vehicle sensors and for directing communications, voting, and activities of the servo mechanisms. A real-time clock 207 is utilized for computation of time based segments and overall system control. In addition to random access memory 209, each computer 203 features a modular $E^2$PROM board 211 which generally includes 8 Mbytes of memory for storing eight ride programs which may be accessed. In addition, the math co-processor 201 (having a math specialized co-processor, a Motorola "68882" in the case of the preferred embodiment) is provided for the CPU 205 to all floating point calculations. Each computer 203 also possesses several serial ports 213, as mentioned above, and a set of high-speed counter inputs 215 and digital and analog I/O boards 217 and 219, for monitoring ride vehicle sensors and providing digital control signals. Lastly, servo mechanism control is supplied by a servo control board 221 having eight servo outputs and eight feedback inputs, collectively designated by the reference numeral 223. In the preferred embodiment, only six of these outputs are used, including outputs for each of the three motion base servo actuators 50, 52 and 54, propulsion (swashplate angle of the hydraulic motor 36), and steering for each of the two rear wheels 16 (angular).

The servo control board 221 is installed only in the RCC 193, to drive the servo actuated elements, whereas in an alternative embodiment, each of the RCC 193 and the RMC 195 includes the servo control board 221, which accepts servo feedback signals from the motion base 24, rear steering actuators 126 and the swashplate. However, in the preferred embodiment, all feedback signals from these elements are derived using linear sensors, and the feedback signals fed to the analog I/O board 219 in a zero-to-ten volt format, and are monitored by both of the RCC 193 and the RMC 195 using analog feedback.

Referring again to FIG. 22, the interaction of the two (parallel) computers 193 and 195 and the ride vehicle control functions are diagrammatically presented. As indicated, since the RMC 195 is provided primarily for added safety and backup in the RCC's control of the various mechanical elements of the ride vehicle 10, it would be redundant to require both computers to be electronically coupled to convey identical commands that require a ride vehicle response, i.e., acceleration. Thus, only the RCC 193 is used to control the ride vehicle's servo actuated elements. In the alternative embodiment mentioned above, where each of the RCC 193 and the RMC 195 includes a servo control board 197, control is achieved wiring only the servo control board 197 to the actual servo mechanisms (the three actuators 50, 52 and 54, the swashplate of the HPU 34 and steering actuators 126 for the rear wheels 16), whereas the servo control board of both the RCC and RMC are wired to accept feedback.

Also, in the preferred embodiment, only the RCC 193 provides digital control signal output 255 to control safety features of the ride vehicle, such as motion interlocks 227 and 229 which activate emergency brakes 231 and 233, and block out steering and motion by valve actuation within the hydraulic system. Both computers 193 and 195, however, receive sensor inputs (collectively designated by the reference numeral 225) from the ride vehicle 10, for monitoring ride vehicle status and response, for example, ride vehicle velocity and position of the motion actuators. Both computers are also coupled to the bus controls, collectively 239, 241, 257 and 259, which supply the digital I/O board 217 with power. This construction enables either computer 193 or 195, in the event of a disagreement in the voting that occurs with each directed action or fault analysis, to disable if necessary the ride vehicle's mechanical elements by disabling the bus controls. Both computers 193 and 195, through software, monitor expected position and actual ride vehicle position via position update signals, which are provided from position switches located on the front bogie 90.

Control of the mechanical elements by the vehicle control system 40, described above, consists of providing a servo actuation signal to hydraulic cylinders for the motion base 24, rear offset (deviation in steering of the rear wheels in relation to the path 18) and vehicle velocity. With respect to the motion base 24, control is achieved by simple use of linear feedback position signals, or servo feedback position signals 223 in the case of the alternative embodiment mentioned above, to ensure that each of the servo actuators 50, 52 and 54 are driven to their commanded position, and by determining whether a fault status exists if the actuators are not so driven. Control over vehicle velocity and rear offset is slightly more complicated, and is discussed below.

Vehicle velocity, including acceleration and deceleration, is controlled by the hydraulic motor, which as mentioned, is a variable displacement, rotary hydraulic motor. More particularly, the speed of the ride vehicle 10, including dynamic braking, is controlled by varying a swashplate of the hydraulic motor, which directly determines the displacement. The swashplate preferably has an integrated position feedback sensor which provides a propulsion motor swashplate angle analog signal input to the RCC 193.

Speed of the ride vehicle 10 is controlled using two control loops, an inner loop and an outer loop. The inner loop controls the swashplate angle to thereby control motor torque, in aid of providing a commanded amount of acceleration or deceleration. The outer loop, on the other hand, compares actual vehicle velocity with velocity desired by the ride program, and controls the inner loop with this feedback to drive the swashplate angle, such that the provided motor torque and acceleration or deceleration provided yields exactly the desired vehicle velocity.

The maximum rear offset and rear steering are controlled by a linear hydraulic cylinder (including a servo valve driven by a proportional-derivative servo control), and a position feedback sensor, while front wheel steering, as mentioned above, is controlled by a mechanical mechanism that is linked to the bogie. While the preferred embodiment uses the aforementioned bogie configuration, with front wheel steering being controlled by the path 18, a contemplated alternative embodiment utilizes front wheel steering independent of the path, with permitted lateral displacement from the bogie. Thus, in this alternative embodiment, front and rear wheels may be separately driven within the envelope, and an additional servo output from the servo control board 221 utilized to control front offset.

The linear hydraulic cylinders used for steering control directs the wheel angle of each wheel of the rear steering system. As with the velocity control, mentioned above, a similar two loop control system is provided to respectively apply (1) feedback to correct for steering errors, and (2) use of the rear steering offset value to calculate the required angle of each rear wheel, based upon desired rear offset and the direction of the path 18 and front wheel steering, and to convert the calculated steering angle to a required stroke for each of the linear actuators, based upon the steering linkage geometry.

Each ride vehicle command stored in each of computer's memory 189 may also include audio cue information which is also synchronized to motions of the ride vehicle 10, moving show sets, or of the motion base 24. In the preferred embodiment, sounds are generated by the ride vehicle 10 including 4 engine pitches, screeching tires, a thump and brakes. These sounds are directed to, and are actually produced by, speakers 247 located under the seat of the passengers 48 to simulate sounds coming from the vehicle itself. The ride vehicle 10 also features an independent sound system including speakers located within the seat backs of the passengers that generates music and announcements from analog electronic signals. In addition to the speakers 247 on the ride vehicle 10, additional speakers (not shown) may also be placed at strategic locations along the path 18 followed by the ride vehicle. As illustrated in FIG. 22, the RCC 193 is coupled to an audio processor and sequencer 249 to which it feeds the audio signal information to simulate vehicle and ride sounds which are produced by the speakers 247 located under the passengers' seats. This processor 249 configures a MIDI format command having "on" and "off" note values, which effectively indicate note duration.

MIDI data is formatted to include data representing pitch, instrument type and a command that turns the note either on or off. In the case of the preferred embodiment, only a few different sounds are used, for example, screeching tires and brakes.

The audio processor and sequencer 249 formats these commands to have a "countdown time," expressed in a number of musical beats, and sends these commands to a musical interface board 251, such as a "MPU401." The musical interface board 251, in abstract terms, maintains an electronic calendar for each of a number of channels, each representing a single sound, and loads each received note command into a corresponding calendar. Once the "countdown time" corresponding to the note on or off command is elapsed, the musical interface board 251 sends the note to an audio amplifier and synthesizer 253, which creates the actual sound to be produced by the appropriate speaker 247.

The actual sounds and actions reproduced by the ride vehicle 10 are created during an off-line programming state, following actions by a programmer in recording basic motions of the ride vehicle and the motion base 24. These programmed actions are initially time-based, and are recorded in digital format, much as music would be recorded by a tape machine. However, since the playback information for these time-based activities is in digital format, it may be readily edited using the off-line editor. Once the time-based sounds are generated, they are then sequenced within one of the parallel data tracks of the selected ride program to commence at a specific position along the path 18, or during a hold-pattern. As indicated above, additional time-based and position-based motion and sound routines are preferably configured to be run when the ride vehicle 10 is in a hold-pattern; that is, when the ride vehicle is stopped, the ride vehicle may implement a motion sequence where only the motion base 24 of the ride vehicle 10 is used, or certain audio sounds, such as engine-revving, etc. It is emphasized that ride vehicle actions are recorded in a digital format, preferably using a disk operating system ("DOS"), and stored in a software file which may be readily sequenced and edited, and even stored on a floppy disk medium. Once a complete ride program has been generated, it is electrically merged with ride profile data generated by the programming console and burned into $E^2$PROM 211 for implementation and use, as directed by the Wayside Interface.

As noted above, typical sounds generated by the sound module 41 include the sounds of the ride vehicle's engine, tires and brakes. More specific examples of some of these sounds include roaring, straining, freewheeling and screaming sounds of the engine, as well as skidding, spinning, squealing, sliding and flapping sounds of the ride vehicle's tires. Further sounds include gear whine, screeching brakes, thumping, scraping, crashing, banging, splashing water, whistling air, creaking and cracking wood sounds. It will be appreciated that various other sounds can be generated as desired to create a particular audio effect.

To further enhance the ride experience of the passengers as the ride vehicle 10 moves through the attraction, means may be provided for introducing special effects corresponding to the ride vehicle's interaction with the path 18 and scenery 42 in the attraction. In one form of the preferred amusement attraction, the means for introducing special effects comprises an apparatus that is adapted, for example, to create the effect of blowing wind, dust clouds, flying gravel, dirt, mud, sparks, water spray and fog. Of course, other special effects may be employed as desired, in combination with special scenery, props and audio effects, to create the most realistic ride vehicle experience possible. Therefore, the foregoing examples of audio effects and special effects have been listed for the purposes of illustration only and not by way of limitation.

Details of the electronic control system of the attraction are described below and are also disclosed in pending U.S. application Ser. No. 08/109,370, filed Aug. 19, 1993, which is incorporated herein by reference. (This pending application is entitled ELECTRONIC CONTROL SYSTEM FOR RIDE VEHICLE AND RELATED METHODS, names William L. Wolf, William G. Redmann, David W. Spencer, II, Jon H. Snoddy and Scott F. Watson as inventors, and corresponds to attorney docket no. P01 31510).

Figure 55:
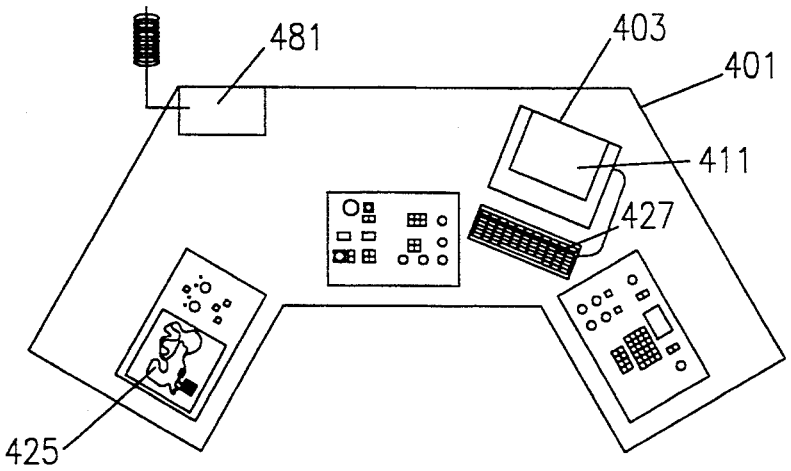
FIG. 55 is a plan view of a control tower of a "Wayside Interface" which orchestrates the conduct of the amusement attraction, including control over system power and zones, advancement of vehicles, interface with the human operator, and ride program selection.

With reference to FIG. 55, a control tower 401 of the Wayside Interface is shown as including a computer system 403 that controls (1) the supply of 480-volt ac power to the entire patch 18, (2) maintenance of the go signal in the various zones 405 of the path 18 and the dispatch of ride vehicles within the Wayside Station 407, (3) collection and presentation of vehicle status and fault messages for ride vehicle operating within the attraction, for display to the human operator 409, and (4) selection of ride program for each ride vehicle, either automatically or with aid of the human operator. The computer system 403 is a duplex computer arrangement, nearly identical to the computerized vehicle-control system 40, and includes a computer monitor 411 which displays the status messages which each of the ride vehicles have transmitted to the central controller by rf transmission, including information indicative of operating mode, path position and ride program selection. In this way, it may be seen that if a fault condition arises on one or more of the vehicles, the human operator may take action as appropriate, including removing the vehicle from active operation within the attraction, shutting-down a particular zone, or shutting-down ac power for the entire attraction.

Figure 53:
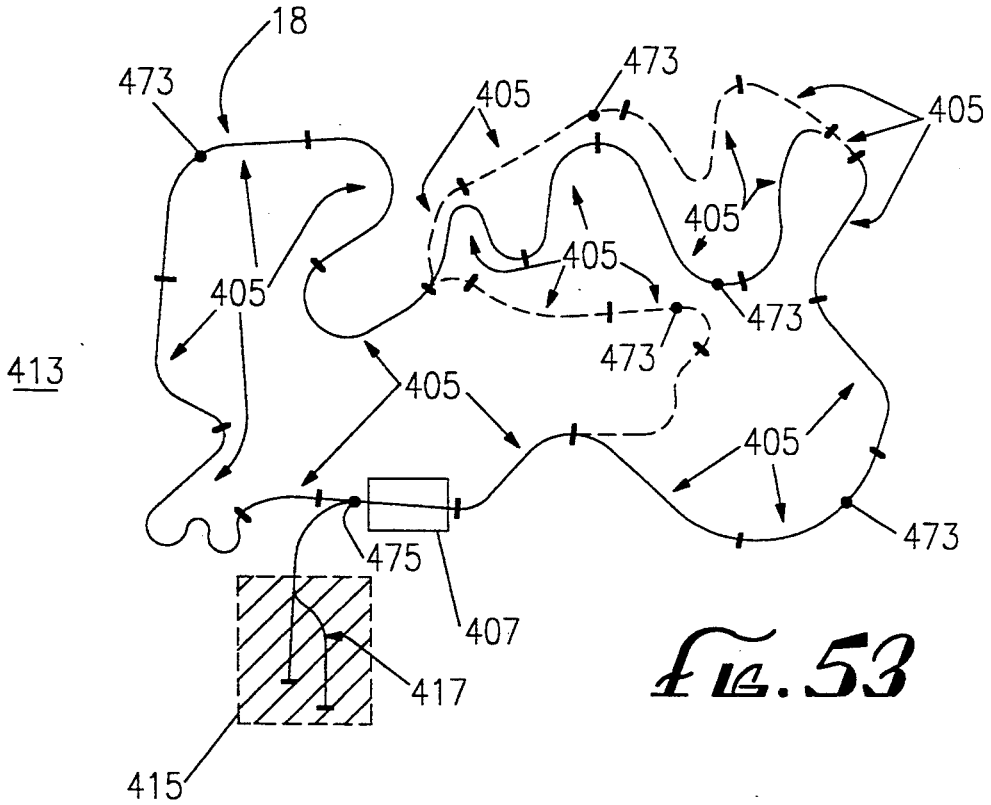
FIG. 53 is a schematic of a closed-loop path, Wayside Station and maintenance yard of an amusement attraction, upon which a plurality of ride vehicles may be operated, including a plurality of zones of the closed-loop path, with alternative paths shown in phantom.

Ideally, the control tower 401 is mounted within the Wayside Station 407, at which passengers 48 may embark and disembark each of the plurality of the ride vehicles 10. FIG. 53 shows a schematic layout of one possible amusement attraction 413 showing this arrangement of Wayside Station 407, the closed-loop path 18, and a maintenance yard 415, consisting of a branched-track portion 417 and other repair and maintenance facilities (not shown). The closed-loop path 18 and branched-track portion 417 each feature the above-mentioned six bus bar 95, power bus 97 arrangement, and are divided into contiguous zones 405, as described earlier.

The computer system 403 at the Wayside Interface is coupled to receive the no-go signal for each zone 405. It is also coupled to the go signal for each zone with the ability to, in response to receipt of a no-go signal for a particular zone, selectively stop ride vehicle motion in the immediately preceding zone. In addition, the computer system 403 also controls three power switches (not shown) which are operated as a single unit to turn on and off three-phrase power to the path 18 on a global-basis. In this manner, if an emergency condition should develop, all ride vehicles within the attraction may be instantaneously halted.

Figure 54:
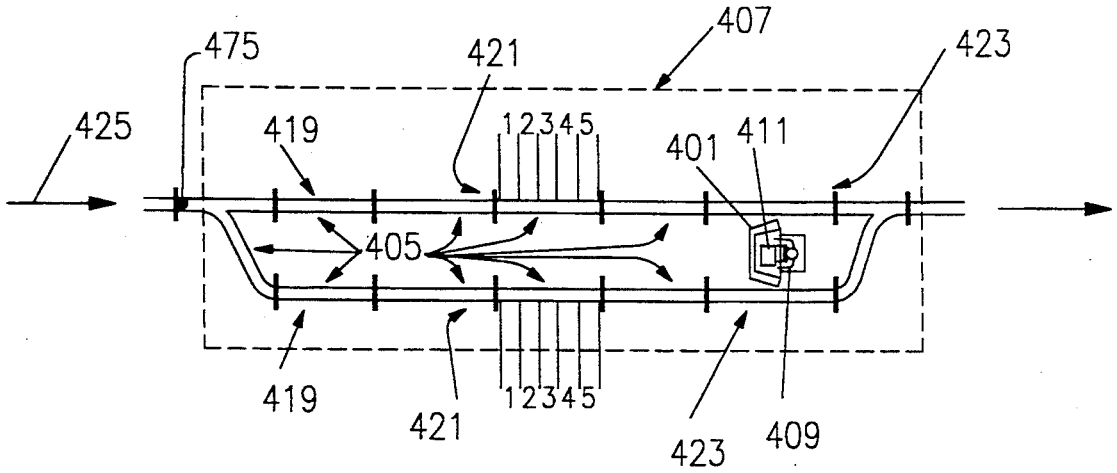
FIG. 54 is a schematic view of the layout of the Wayside Station of FIG. 53, and shows a number of advancement points, including a passenger unloading area and a passenger loading area.

One of the primary purposes of control tower 401 is to control vehicle movement within the Wayside Station area (FIG. 54), including the assumption of control over a ride vehicle that enters the Wayside Station 407 (in the direction indicated by the reference numeral 425), subsequent advancement to a hold area 419, to a subsequent passenger loading/unloading area 421, to a seat belt check area 423, and finally, the return of control over vehicle movement to the particular ride vehicle, in accordance with the selected ride program. Consequently, as shown in FIG. 55, the control tower 401 also mounts a number of manually-operated dispatch controls 425 that control the advancement of ride vehicles within the above-mentioned framework, e.g., to passenger loading/unloading area 421, and a computer keyboard or other interface 427. Upon activation of the appropriate control, the computer system 403 selectively controls the go signal within each of several zones 405 within the Wayside Station 407, to permit each vehicle to proceed to the next stop according to programmed, continuous motion. The Wayside Interface, prior to releasing control over vehicle motion to the selected ride program, requires a go signal from the human operator 409 that effectively indicates that all seatbelts aboard the vehicle have been fastened, and that the Wayside Interface may relinquish control to the particular ride vehicle. In addition to the above-mentioned controls 427 for vehicle advancement within the Wayside Station 407, the Wayside Interface will be primarily relied upon to move each ride vehicle between the closed looped path 18 and branched-track portion 417.

Periodically, the computer system 403 of the Wayside Interface requests each ride vehicle 10 to report its operating status. In addition, a ride vehicle 10 which is approaching the Wayside Station 407 is queried for its most recent operating status prior to entering the station. As described below, each ride vehicle develops diagnostic information which is transmitted to the Wayside Interface, including the vehicle's operating status, operating mode, fault indications for each vehicle's subsystem, logic fault indications from the vehicle's on-board computerized vehicle-control system 40, indicated by the voting mechanism above, current ride program selection, longitudinal position of the ride vehicle 10 along the path 18, vehicle I.D. and time of day.

Fault indications are generated as they arrive on-board each ride vehicle and are stored within a stack of each of the RCC 193 and RMC 195 for display at each of (1) the computer system 403 of the Wayside Interface, (2) a maintenance monitor (not shown in FIGS. 50–52) located within the vehicle's computerized vehicle-control system 40, at the rear of the ride vehicle 10, and (3) the programming console, mentioned below, when the programming console is used for maintenance and diagnostics. These messages principally include lateral (offset) and longitudinal (path) position errors, velocity and motion base errors, and hydraulic fluid over-temperature, warning and shutdown signals. Specific messages within the stack may be cleared at terminals associated with any of these three systems.

The remaining diagnostic information is requested by our communications by the Wayside Interface on both a periodic basis and at times when each ride vehicle is proximate to, and about to enter, the Wayside Station 407.

Thus, the Wayside Interface is responsible for coordinating vehicle motion along the path 18, and communicates with each ride vehicle 10 to obtain diagnostic information and to perform ride program selection from among a plurality of such programs. In addition, the Wayside Interface monitors the path 18 to advance the vehicles within the Wayside Station 407 and branched-track portions, to ensure that vehicles do not come too close to one another, and to ensure that no emergency conditions develop. To control these latter-activities, the Wayside Interface is placed in control of the 480-volt ac power supply on a global basis, and in addition, the go signals for each zone 405 along the path 18. Finally, the Wayside Interface through the control tower 401 provides the human operator 409 with information, digitally-transmitted from each vehicle, which informs the human operator as to the status of each vehicle, and permits alternate ride program selection. In the preferred embodiment, the software of the computer of the Wayside Interface randomly selects one ride program from among the plurality of programs stored in the $E^2$PROM 211 of each ride vehicle 10, as a default operation. The software permits an additional mode of operation where the human operator 409 may select a particular ride program prior to the departure of the ride vehicle from the Wayside Station 407.

Another important feature of the Wayside Interface is to select particular ones of a plurality of ride vehicle programs. In one embodiment, this is done by radio frequency communication with each particular ride vehicle as it enters the Wayside Station. To this effect, both of the Wayside Interface and each vehicle features a radio frequency transceiver which allows their respective computer systems to remain in contact, transmitting digital information therebetween. Other contemplated embodiments respectively use one of infrared communication, transmission by a dedicated digital communication line of the power bus 97, or by power modulation of one of the phases of 480-volt power or the go signal.

In the preferred embodiment, however, portions of the path 18 include moving show sets that are actuated according to a predefined motion pattern. Ideally, this motion pattern is controlled by a motion computer of the computer system 403 of the Wayside Interface, which stores a plurality of motion patterns. The computer system 403 selects a particular pattern to be presented in the vicinity of a particular ride vehicle, and prior to that vehicle's attainment of a predetermined position, communicates corresponding selection information to the ride vehicle, which selects a particular ride program in response to the selection signal provided by the computer system 403. In this way, moving show sets may be manipulated in synchronicity with the ride vehicles, both cooperating to provide a number of different ride experiences. Thus, in this preferred embodiment, the computer system 403 uses radio frequency communication, and digitally addresses signals to specific vehicles to communicate show selection information prior to the time that they engage corresponding scenery, including moving show sets.

In accordance with the invention, the amusement ride vehicle 10 is capable of enhancing the sensation of vehicle movement that is actually taking place, as well as providing the passengers with realistic moving ride vehicle experiences that are not actually happening. Even when travelling along a path 18 in the attraction without scenery, props, audio or other special effects, the ride vehicle 10 can be made to execute several motion patterns, or sequences of motion patterns. These patterns can be programmed into the vehicle control system 40, or alternatively, provision can be made for motion control in response to manual control of the vehicle 10 or other manual command. In the context of the present invention, a motion pattern is defined as a sequence of movements by the motion apparatus 24 and its corresponding actuators 50, 52, 54 and 126 and/or 135 that cause the body 22 to move in a repeatable path in relation to the chassis 12, and which may occur while the chassis 12 is stationary or in motion along the path 18. The resulting motion pattern gives the passengers 48 a sensation that the vehicle 10 is undergoing directional maneuvers or surface conditions which may or may not actually be present. FIGS. 23–34 illustrate examples of some of the basic motion patterns executed by the ride vehicle 10. These motion patterns will now be described.

Figure 23:
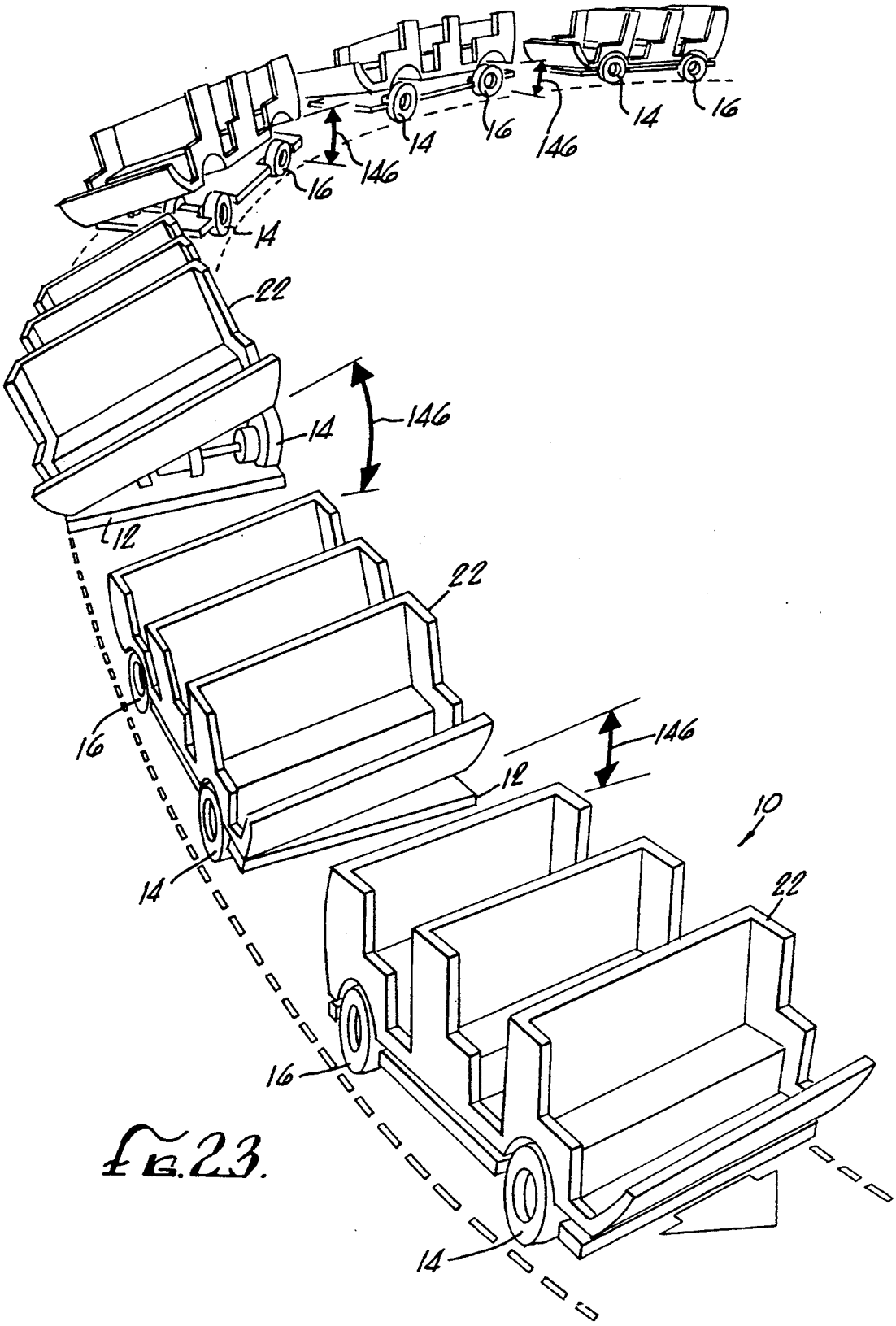
FIG. 23 is a perspective view of the ride vehicle showing it in various stages of turning a corner with outward body roll.

FIG. 23 shows a motion pattern in which the ride vehicle 10 is in various stages of turning a corner 144. The sensation of turning the corner 144 is exaggerated by outward body roll relative to the chassis 12. This is accomplished by rotational acceleration of the body 22 with respect to the chassis 12 about the roll axis of the vehicle 10. Prior to initiating the turn, the vehicle 10 is moved forward along the path 18 with the body 22 in a substantially level position with respect to the chassis 12. As the wheels 14 or 16 are turned in a direction to follow the curved path 18, the body 22 is simultaneously accelerated about the roll axis, in an outward direction with respect to the curved path 18, as indicated by the motion arrows 146. The degree of outward body roll is increased until it reaches a maximum at the point where the vehicle is substantially at the apex of the curved path 18. This has the effect of exaggerating and enhancing the passenger's sensation of the speed and sharpness of the corner 144, thereby supplementing the normal sensations that would be experienced by the passenger when turning a corner in the absence of the outward body roll. As the vehicle 10 begins to come out of the turn, the body 22 is rolled back inwardly until it reaches a substantially level position with respect to the chassis 12, at the end of the turn.

During execution of this or other motion patterns, further motion patterns can be superimposed. The following three motion patterns are examples of such further motion patterns.

The motion pattern described above simulates the gross movements of a vehicle turning sharply at a high rate of speed. In a conventional automobile, such a maneuver normally would be accompanied by an effect called "wheel hopping." Wheel hopping occurs under high lateral loads when tires alternately skid across the pavement and then grab the pavement in quick succession. This wheel hopping effect can be simulated very closely in the ride vehicle 10 by appropriate actuation of the motion apparatus servo actuators 50, 52 and 54. These actuators can be manipulated to cause up and down movement of the body 22 during the turning of the corner 144 which simulates the wheel hopping sensation.

Another effect which can be added to various motion patterns, or used alone, simulates the feeling of the texture or roughness of a road. Providing the servo actuators 50, 52 and 54 with a noise signal while the chassis 12 is in motion produces the perception of road roughness. The road roughness illusion is improved by making the frequency of the noise proportional to the vehicle's actual or simulated speed. The degree of roughness, simulating for example the difference between a gravel road and a stony riverbed, is simulated by the amplitude of the noise.

If the dynamic ride vehicle 10 is intended to simulate the motion of an animal, another effect which can be added to various motion patterns simulates the gait of the animal as it would be perceived by a rider. A rough four phase motion could be programmed to simulate a trot, while a smoother two phase motion would simulate a gallop.

Figure 24:
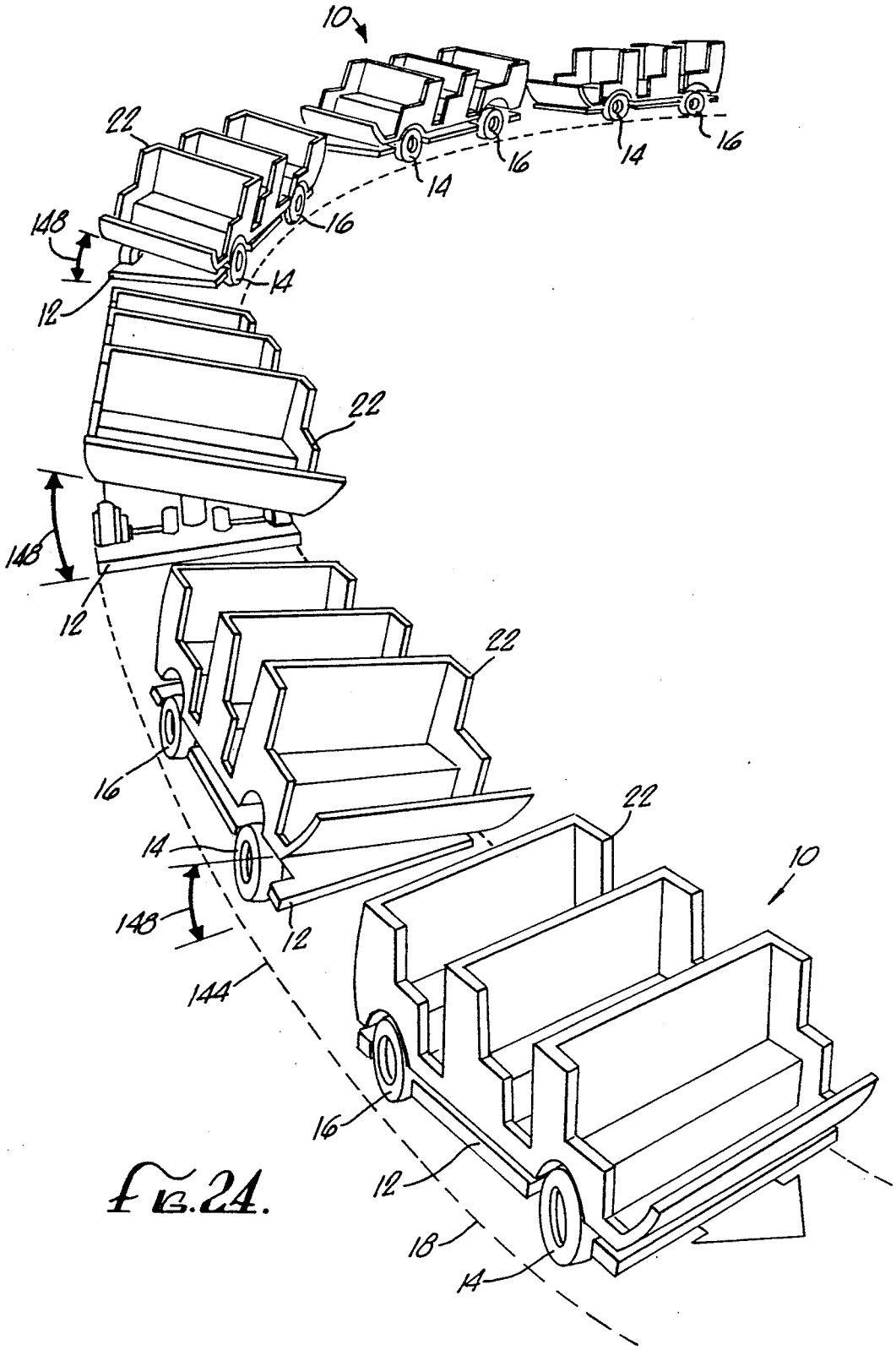
FIG. 24 is a perspective view of the ride vehicle showing it in various stages of turning a corner with inward body roll.

FIG. 24 shows the ride vehicle 10 in various stages of turning a corner 144 with an inward body roll. In this motion pattern, the vehicle 10 is moved along the path 18, prior to initiating the turn, with the body 22 in a substantially level position with respect to the chassis 12, similar to the motion pattern described above in connection with FIG. 23. As the wheels 14 and 16 are turned in a direction to follow the curved path 18, the body 22 is simultaneously accelerated about the roll axis in an inward direction with respect to the curved path 18, as indicated by the motion arrows 148. The degree of inward rolling movement of the body 22 reaches a maximum point at the apex of the curved path 18. This has the effect of subduing and minimizing the passenger's sensation of the speed and sharpness of the corner 144, much like turning a corner on a banked road. As the vehicle 10 begins to steer out of the turn, the body 22 is then rolled back outwardly until it reaches a relatively level position with respect to the chassis 12, at the end of the turn.

Figure 25:
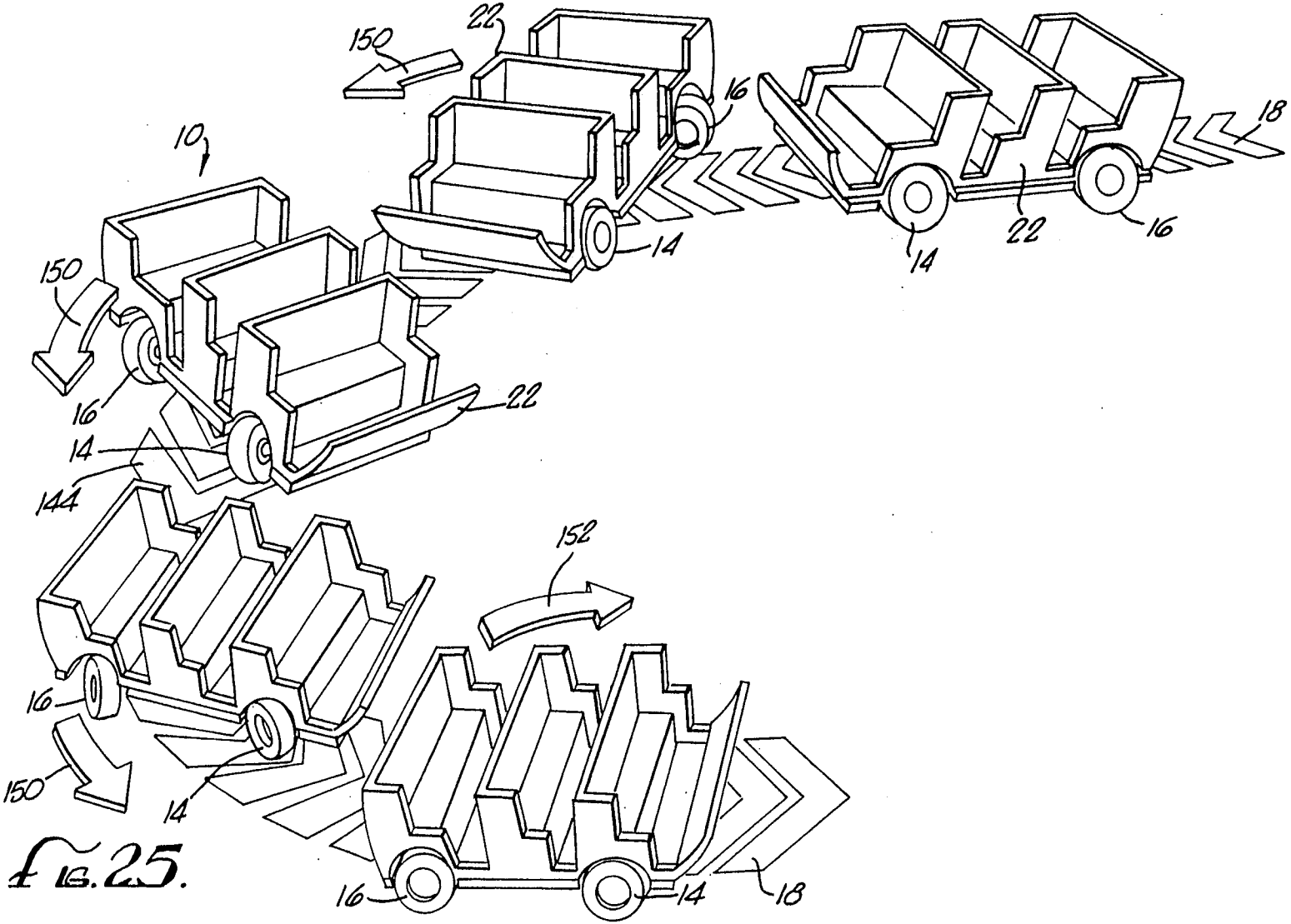
FIG. 25 is a perspective view of the ride vehicle showing it in various stages of turning a corner with four-wheel steering.

FIG. 25 shows another motion pattern in which the ride vehicle 10 is in various stages of turning a corner 144. In this motion pattern, however, the turning sensation experienced by the passengers is exaggerated by four-wheel steering, rather than by outward body roll as shown in the motion pattern of FIG. 23. Accordingly, the vehicle 10 is moved forward along the path 18, and the body 22 is kept in a substantially level position with respect to the chassis 12 at all times throughout the turn. As the vehicle 10 is about to enter the curved path 18 corresponding to the turn, the rear wheels 16 of the vehicle 10 are steered away from the direction of the turn. This causes the back end of the vehicle 10 to accelerate and swing outwardly during the turn, as indicated by the motion arrows 150, to give the simulated effect of sliding. Throughout this motion pattern, the front wheels 14 substantially follow the curvature of the turn 144. After the vehicle 10 passes the apex of the turn 144, the rear wheels 16 are steered back inwardly into the turn. This causes the back end of the vehicle 10 to accelerate and swing inwardly, as indicated by the motion arrow 152, and simulates the effect of further sliding of the vehicle 10 as it comes out of the turn 144. At the end of the turn 144, the wheels 14 and 16 can be made to steer straight ahead in preparation for the next motion pattern.

Figure 26:
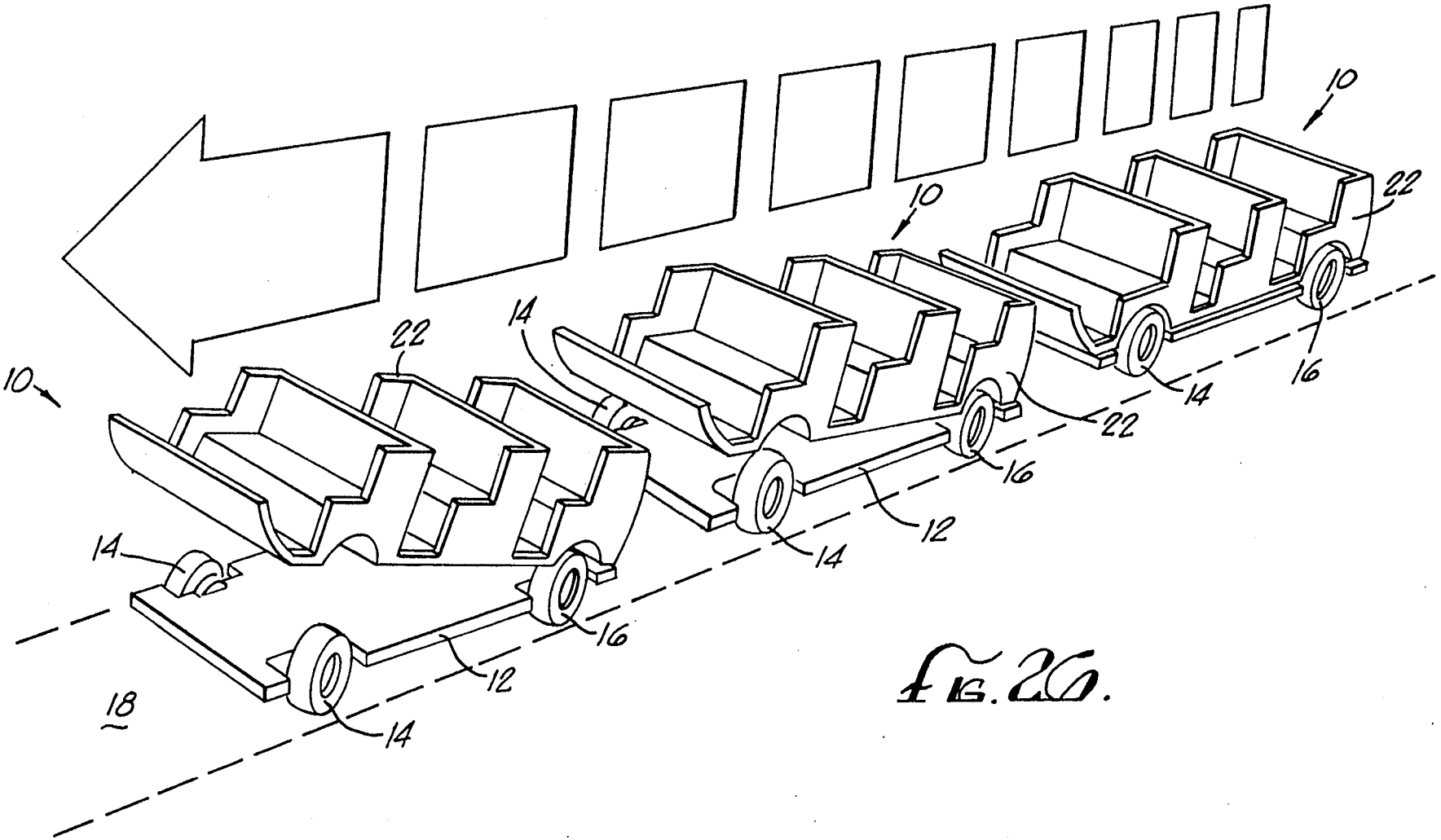
FIG. 26 is a perspective view of the ride vehicle showing it in various stages of forward acceleration with rearward body pitch.

FIG. 26 shows the ride vehicle 10 in various stages of forward acceleration, utilizing rearward body pitch to exaggerate the sensation of speed during acceleration. This is accomplished by rotational acceleration of the body 22 with respect to the chassis 12 about the pitch axis of the vehicle 10. In this motion pattern, the vehicle 10 is accelerated quickly in the forward direction along the path 18. As soon as the vehicle 10 begins accelerating, the body 22 is quickly pitched backward by accelerating and raising the front end about the pitch axis. This body motion has the effect of exaggerating and enhancing the passenger's sensation of the acceleration of the vehicle 10 beyond the normal acceleration experienced in the absence of such body-pitching motion. When the vehicle 10 has substantially finished its forward acceleration, the body 22 is gradually pitched forward by dropping the front end until it reaches a substantially level position with respect to the chassis 12. It will be understood that forward acceleration of the vehicle 10 may occur from a standing start or while the vehicle is already in motion.

Figure 27:
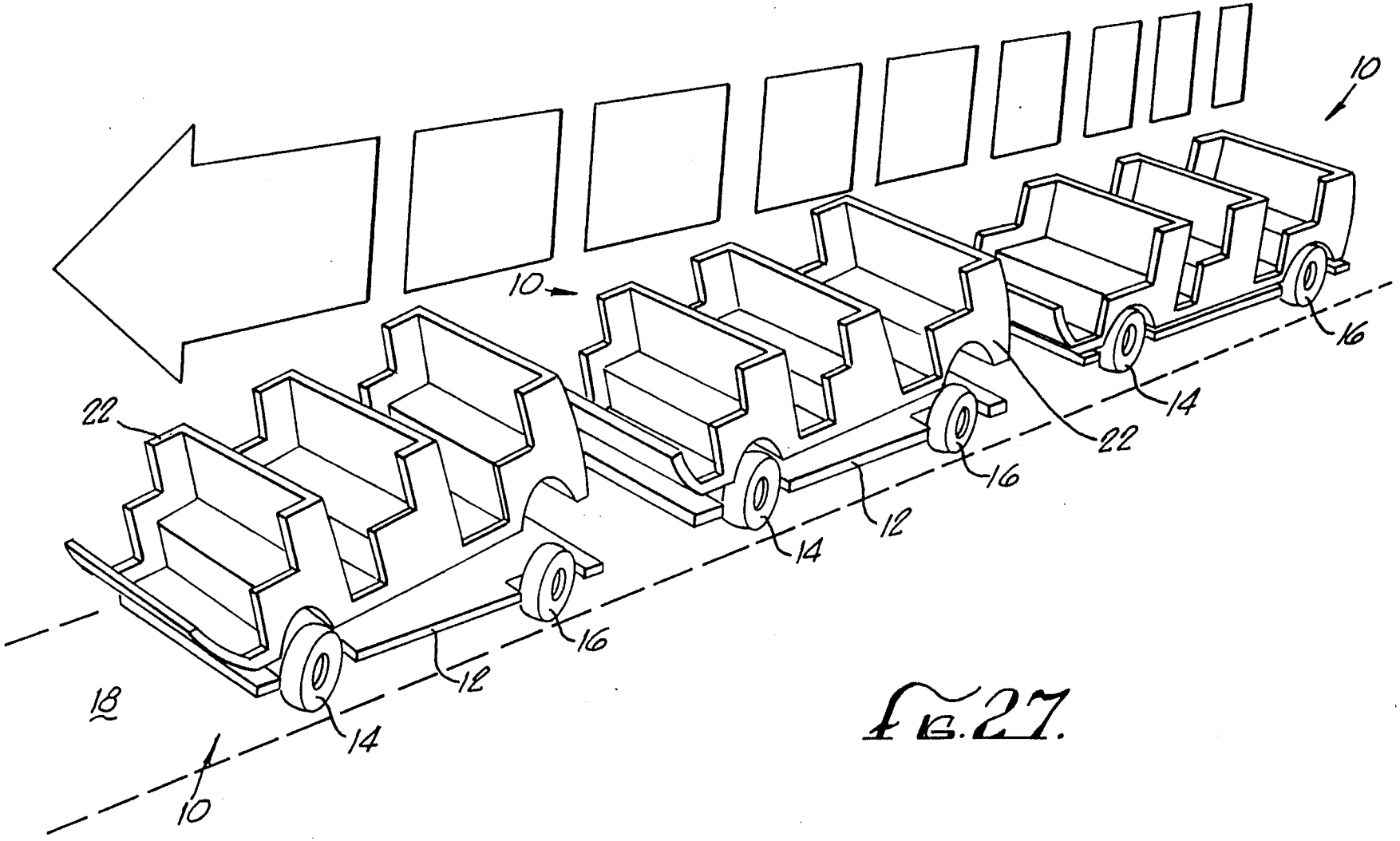
FIG. 27 is a perspective view of the ride vehicle showing it in various stages of decelerating or braking with forward body pitch.

FIG. 27 shows the ride vehicle 10 in various stages of decelerating or braking, as exaggerated by forward body pitch. In this motion pattern, as the vehicle 10 moves in a forward direction along the path 18, the vehicle is quickly decelerated. As soon as the vehicle 10 begins decelerating, the body 22 is quickly pitched forward with respect to the chassis 12 by accelerating and raising the rear end about the pitch axis. When the vehicle 10 has stopped or otherwise finished decelerating, the body 22 is quickly pitched backward with respect to the chassis 12 by lowering the rear end to a substantially level position with respect to the chassis. This motion of the vehicle 10, as enhanced by forward pitching of the body 22, substantially exaggerates and enhances the passenger's sensation of the braking of the vehicle.

In the motion patterns described above in connection with FIGS. 23–24 and 26–27, it will be understood that the acceleration, speed and extent to which the body 22 is rolled inwardly or outwardly during a turn, or pitched rearwardly or forwardly during acceleration or deceleration of the vehicle 10, will govern the simulated degree of vehicle motion sensed and experienced by the passengers. The quicker and further the body 22 is rolled and pitched, the more exaggerated will be the sensation of motion, and vice versa.

Figure 28:
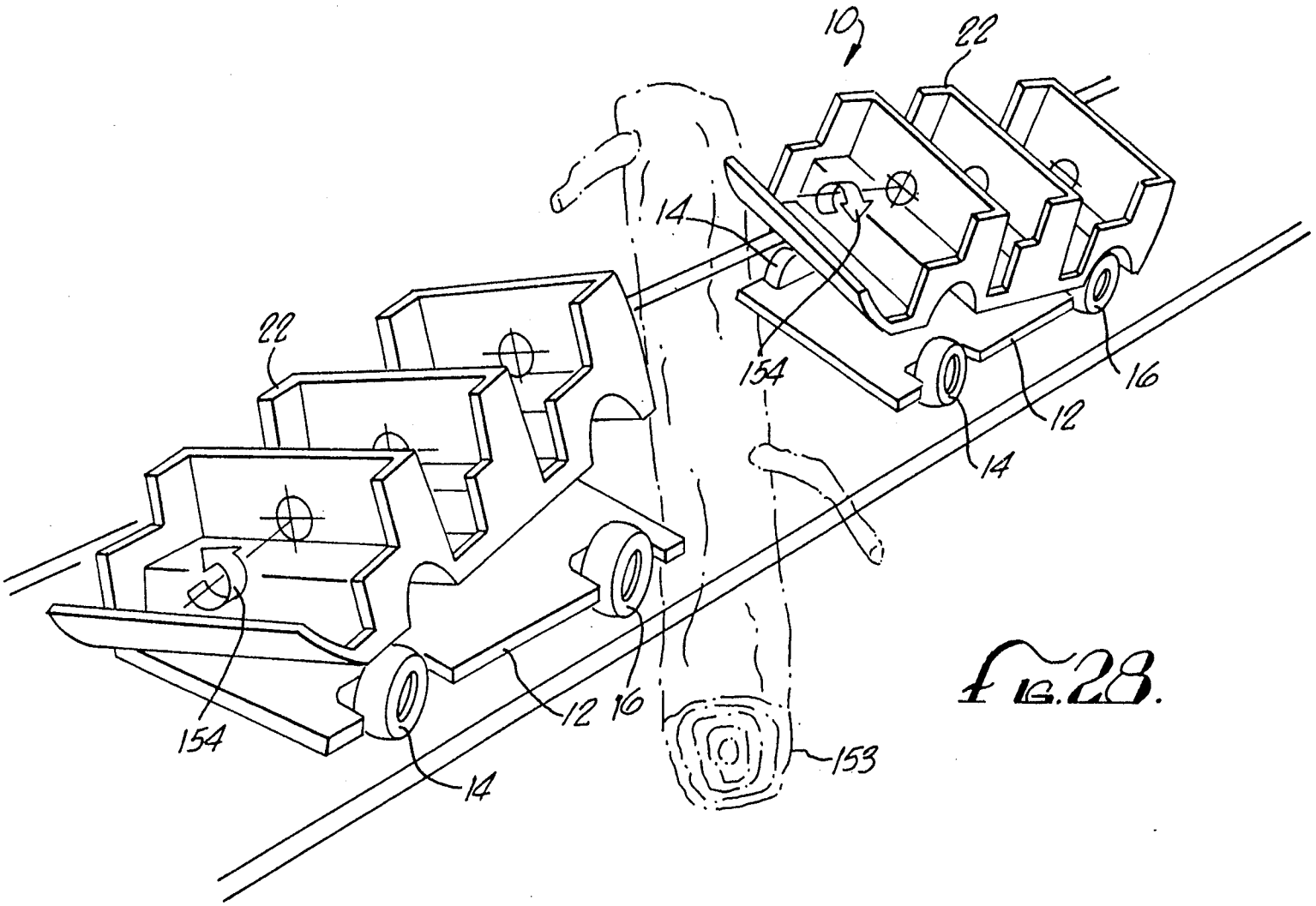
FIG. 28 is a perspective view of the ride vehicle showing it moving in a forward direction with body motion to simulate the effect of travelling over a bump or other object.

FIG. 28 shows a motion pattern in which the ride vehicle 10 is moving in a forward direction with body motion designed to simulate the effect of traveling over a bump or other object. This motion pattern involves moving the vehicle 10 forward along the path 18 to a point corresponding to the location of an imaginary object 153. When the vehicle 10 reaches this point, the body 22 is quickly pitched backward and then forward by causing the front end of the body to quickly raise up and then down with respect to the chassis 12 as the front of the vehicle passes the point corresponding to the location of the imaginary object 153. This simulates the effect of the front wheels 14 travelling over the object. After waiting for an elapsed distance travelled by the vehicle 10 that corresponds to the rear of the vehicle 10 reaching the imaginary object 153, the body 22 is quickly pitched forward and then backward by causing the rear end of the body to quickly raise up and then down with respect to the chassis 12 as the vehicle continues to move forward passing the imaginary object 153. This simulates the effect of the rear wheels 16 traveling over the object 153. Depending upon the type of imaginary object to be "run over," the pitching motion of the body 22 described above may be combined with outward body roll from one side to the other, as may be desired to achieve a particular effect. An example of body rolling from side to side is shown by the motion arrows 154 of FIG. 28.

A further aspect of the motion pattern illustrated in FIG. 28 involves pitching the body 22 forward and backward for several cycles after the vehicle 10 has passed the imaginary object 153. This gives the passengers the sensation normally experienced after a vehicle travels over an actual object 153. Thus, as the distance between the vehicle 10 and the imaginary object increases, the amplitude of the pitching motion is decreased until the body 22 is returned to a substantially level position with respect to the chassis 12. The degree of body-pitching motion and the corresponding number of cycles and amplitude can be varied, depending upon the size of the object and the ride experience to be conveyed.

Figure 29:
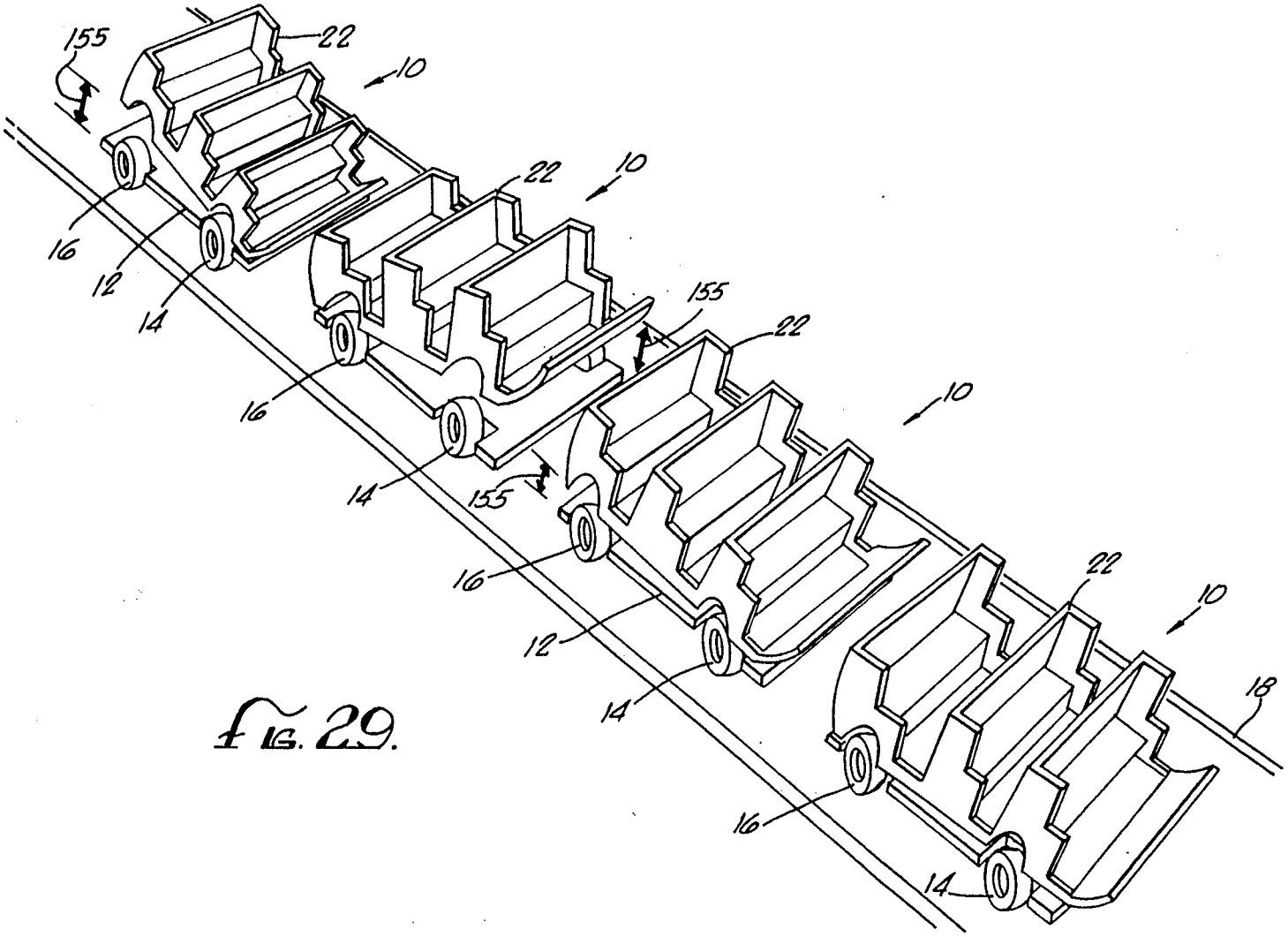
FIG. 29 is a perspective view of the ride vehicle showing it moving in a forward direction with body motion to simulate the effect of travelling over a dip or ditch.

FIG. 29 shows the ride vehicle 10 moving in a forward direction with body motion designed to simulate the effect of traveling over a dip or ditch. In this motion pattern, the vehicle 10 is moved forward to a point corresponding to the location of the imaginary dip. When the vehicle 10 reaches this point, the rear end of the body 22 is raised up and then dropped back down as the vehicle passes the point corresponding to the location of the imaginary dip. This body motion simulates the effect of the front wheels 14 entering the dip. After waiting for an elapsed distance travelled by the vehicle 10 that corresponds to the rear of the vehicle 10 reaching the imaginary dip, the front end of the vehicle is raised up and then moved back down as the vehicle continues to move forward passing the imaginary dip. This body motion simulates the effect of the rear wheels 16 traveling through the dip. Hence, the total experience conveyed by this motion pattern, indicated by the motion arrows 155, is the simulated effect of going over a dip that is not actually present in the path 18 followed by the vehicle 10.

In one aspect of the foregoing motion pattern, the forward and backward pitching motion of the body 22 is continued for several cycles after the vehicle 10 passes the imaginary dip. As discussed above in connection with the motion pattern involving the simulated effect of driving over an imaginary object, this continuation of the pitching motion gives the passengers the sensation of being in a conventional vehicle having shock absorbers that dampen the vehicle's motion after traveling over the dip. Thus, as the distance between the vehicle 10 and the imaginary dip increases, the amplitude of the pitching motion of the body 22 with respect to the chassis 12 is decreased until the body is returned to a substantially level position at a predetermined distance from the imaginary dip.

Figure 30:
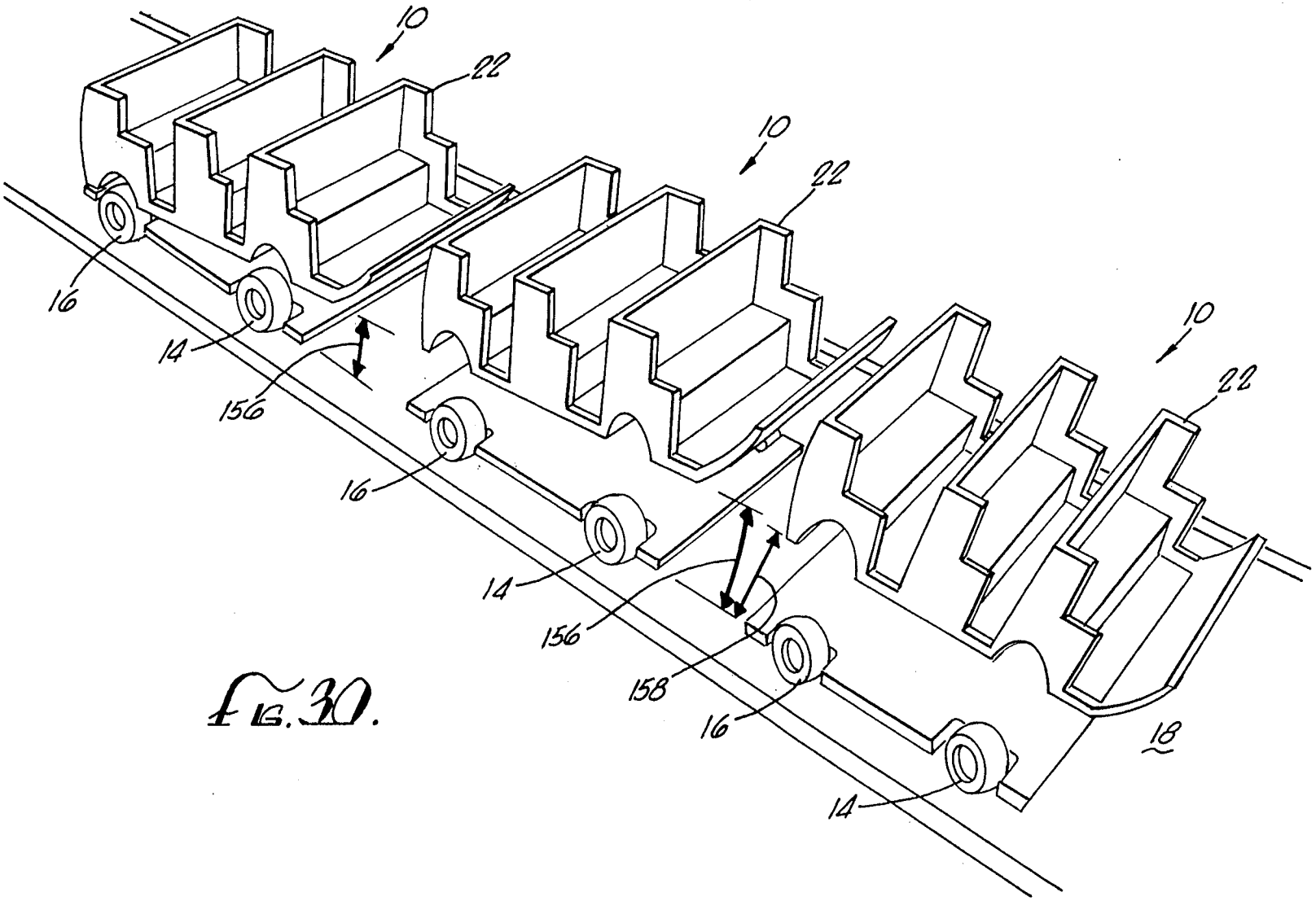
FIG. 30 is a perspective view of the ride vehicle showing it moving in a forward direction with body motion to simulate the effect of climbing a hill.

FIG. 30 shows the ride vehicle 10 moving in a forward direction with body motion designed to simulate the effect of climbing a hill. In this motion pattern, as the vehicle 10 moves in a forward direction along the path 18, the body 22 is pitched backward by accelerating and raising the front end about the pitch axis, as indicated by the motion arrow 156. The body 22 is kept in this pitched position, and then both the front and rear end are raised together as the imaginary hill is climbed. Finally, the front end is kept at a fixed, elevated position while the rear end of the body 22 is raised until it reaches a position substantially level with respect to the chassis 12 at the end of the climb, as shown by the motion arrow 158.

Figure 31:
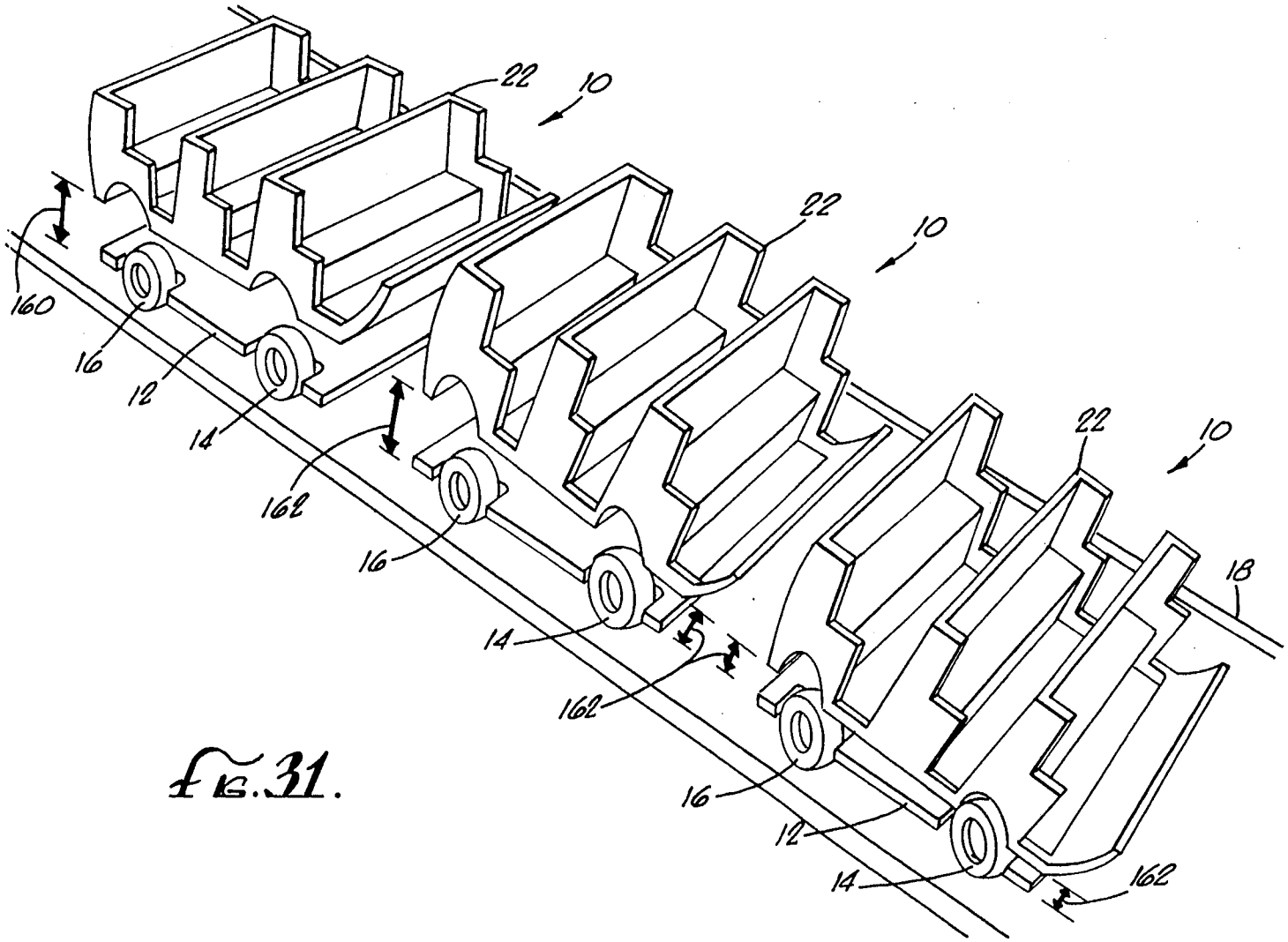
FIG. 31 is a perspective view of the ride vehicle showing it moving in a forward direction with body motion to simulate the effect of descending a hill.

FIG. 31 shows the ride vehicle 10 moving in a forward direction with body motion designed to simulate the effect of descending a hill. This motion pattern, which is essentially the reverse of the motion pattern of FIG. 30, involves moving the vehicle 10 forward along the path 18 with the body 22 in a substantially horizontal but elevated position with respect to the chassis, as indicated by the motion arrow 160. The imaginary hill is descended by initially pitching the body 22 forward by accelerating and lowering the front end about the pitch axis. The body 22 is kept in this pitched position as the imaginary hill is descended, while both the front and rear end are lowered together, as indicated by the motion arrows 162. At the bottom of the imaginary hill, the rear of the body 22 is dropped down until it reaches a position substantially level with respect to the chassis 12.

Figure 32:
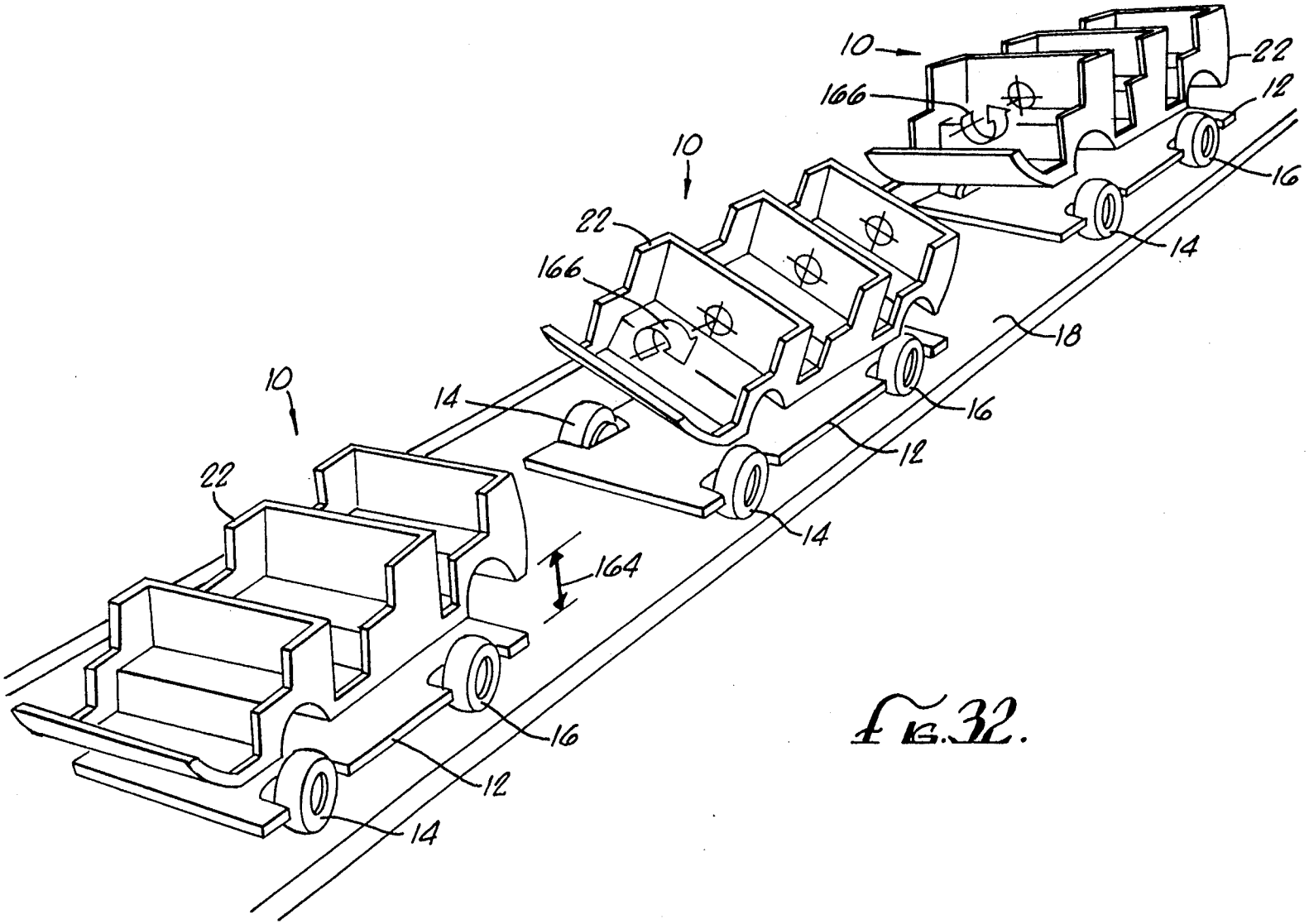
FIG. 32 is a perspective view of the ride vehicle showing it moving in a forward direction with body motion to simulate the effect of floating or flying.

FIG. 32 shows the ride vehicle 10 moving in a forward direction with body motion designed to simulate the effect of floating or flying. In this motion pattern, the vehicle 10 is moved forwardly along the path 18 while gently rolling and pitching the body 22 through rotational accelerations about the roll and pitch axes in a random fashion with respect to the chassis 12, as indicated by the motion arrows 164 and 166. The addition of audio and special effects in combination with this motion pattern can provide a realistic moving ride vehicle experience which is not actually taking place.

Figure 33:
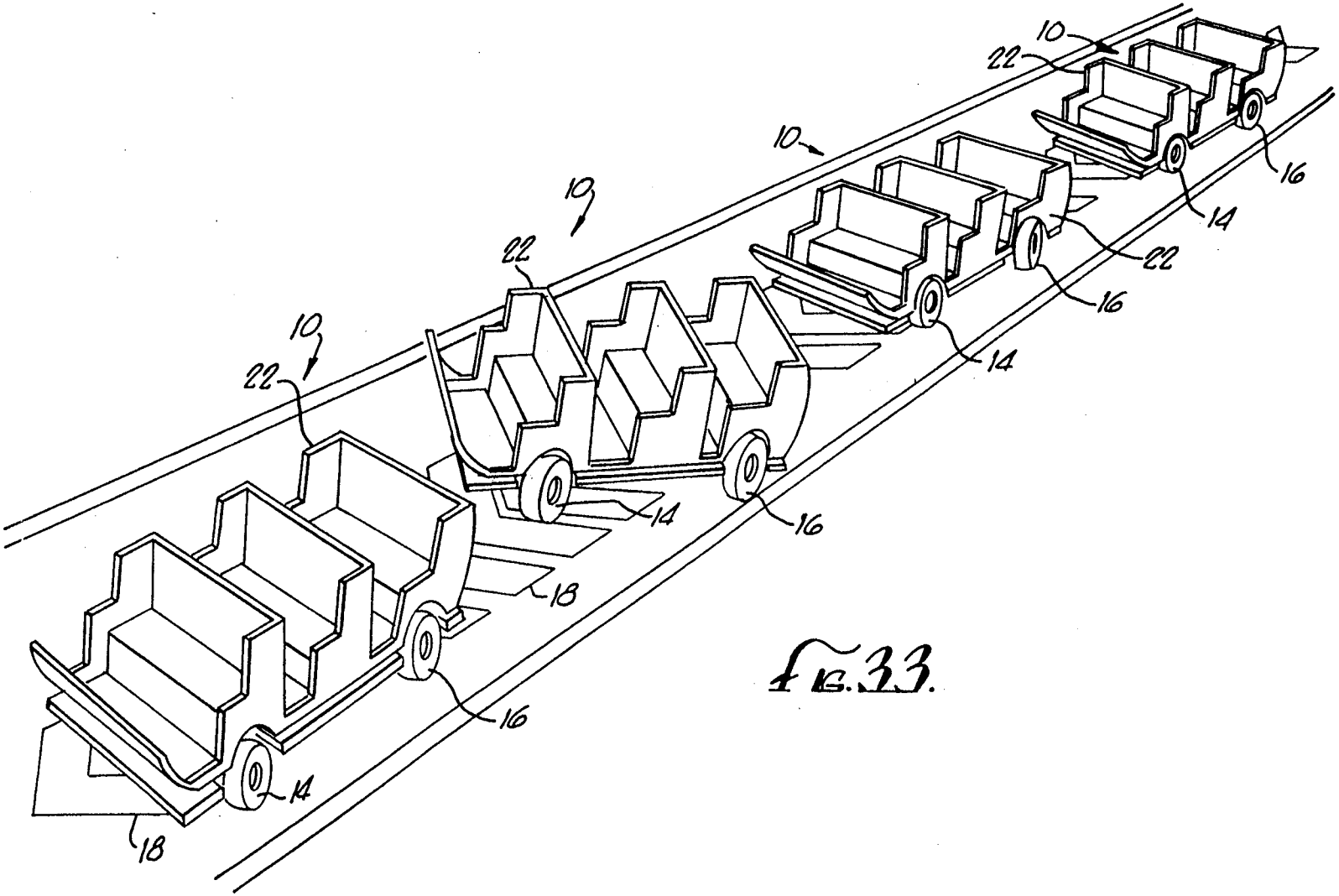
FIG. 33 is a perspective view of the ride vehicle showing it moving in a forward direction with four-wheel steering to simulate the effect of fishtailing.

FIG. 33 shows the ride vehicle 10 moving in a forward direction with four-wheel steering designed to simulate the effect of fishtailing. In this motion pattern, the vehicle 10 is initially moving forward along the path 18 in a substantially straight line. First, the rear wheels 16 are steered outwardly in one direction to initiate the fishtailing. Moments later, the front wheels 14 are also steered outwardly in the same direction such that both the front and rear wheels 14 and 16 are steered simultaneously in one direction. Both wheels 14 and 16 are then steered quickly in the opposition direction. This causes the vehicle 10 to move back and forth in the yaw direction, while keeping the center of gravity of the vehicle in substantially a straight line. Thus, even though the vehicle 10 is not actually fishtailing, the motion pattern described above accurately simulates that effect.

Figure 34:
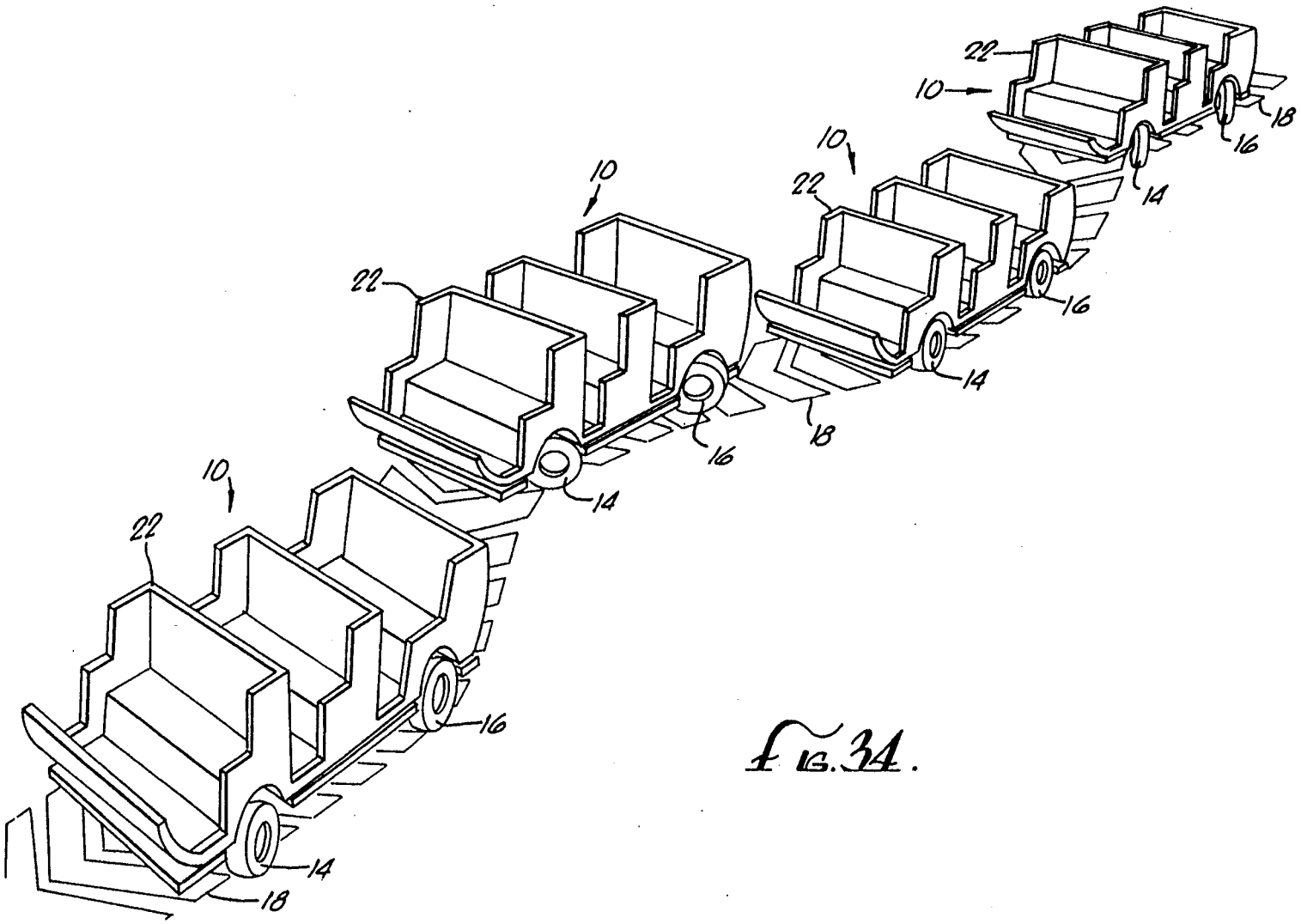
FIG. 34 is a perspective view of the ride vehicle showing it moving in a forward direction with four-wheel steering to simulate the effect of side to side swaying.

FIG. 34 shows the ride vehicle 10 moving in a forward direction with four-wheel steering designed to simulate the effect of side-to-side swaying. In this motion pattern, the vehicle 10 is initially moved forward along the path 18 in substantially a straight line. Both the front and rear wheels 14 and 16 are then steered simultaneously in one direction, causing the vehicle 10 to move to one side of the path 18. The wheels 14 and 16 are then straightened out momentarily to gradually move the vehicle 10 in the forward direction. Then, both the front and rear wheels 14 and 16 are steered simultaneously in the opposite direction causing the vehicle 10 to gradually move to the other side of the path 18. This vehicle motion caused by four-wheel steering can be repeated for as long as desired to simulate the effect of side-to-side swaying.

The motion patterns described above are only examples of some of the many motion patterns that can be executed by the vehicle 10. It will be appreciated that appropriate articulation of the body 22 in combination with the vehicle's speed and steering capabilities will enable additional motion patterns to be created beyond those illustrated here. Therefore, the invention should not be considered to be limited to only those specific motion patterns illustrated and described herein.

When the basic vehicle motion patterns described above are combined with scenery 42, props, and various special effects incorporated into an amusement park attraction or other environment, a vast multitude of ride experiences are possible. Thus, various ride experiences may be provided by appropriately moving the vehicle 10 along the path 18 at a selected direction and rate of speed, by providing scenery 42 and other props that are appropriate to the ride experience to be conveyed, and by articulating the vehicle's body 22 with respect to the chassis 12 in a predetermined motion pattern to enhance, diminish, or entirely simulate the effect of vehicle motion through the attraction at selected locations along the path 18. Special effects also can be introduced for enhancing the sensations experienced by the passengers as the vehicle 10 interacts with the path 18 and scenery 42. FIGS. 35–52 illustrate, by way of example, specific sections of an amusement park attraction which are combined with various motion patterns of the ride vehicle 10 and other effects to provide particular ride experiences to the passengers. These ride experiences will now be described.

Figure 35:
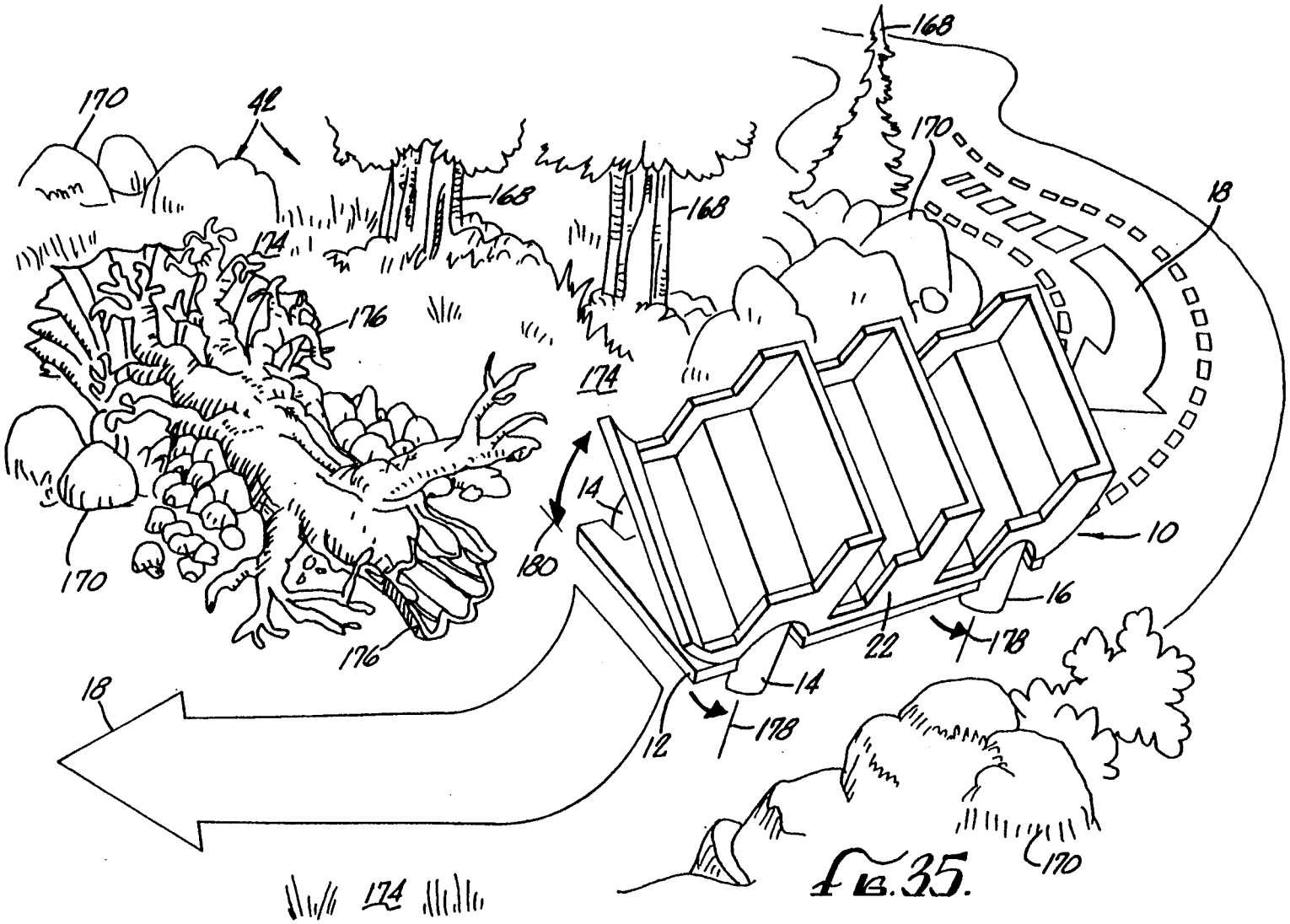
FIG. 35 is a perspective view of the dynamic ride vehicle as it moves through a section of an amusement park attraction, in which four-wheel steering, outward body roll and other effects are used to simulate the effect of a sliding turn on a twisting road.

FIG. 35 shows the ride vehicle 10 moving along the path 18 in one area of the amusement park attraction. In this area of the attraction, the ride experience to be provided is the simulated effect of a sliding turn on a twisting road. Accordingly, stationary scenery 42, having a horizontal horizon in the form of trees 168, rocks 170, bushes 172 and grass 174, is appropriately and artistically arranged along the path 18 that is to be followed by the vehicle. An object 176, such as a fallen tree or log, appears to protrude in the vehicle's path 18. As the ride vehicle 10 moves along the path 18 in a forward direction approaching the log 176, all four wheels 14 and 16 of the vehicle 10 are abruptly steered in a direction away from the log in the direction of the arrows 178. This quickly steers the vehicle 10 away from the log 176 in a manner that conveys the impression to the passengers that the log was almost hit by the vehicle. The four wheel steering thus simulates the effect of a sliding turn. As soon as all wheels 14 and 16 of the vehicle 10 are steered in a direction away from the log 176, the body 22 is also rolled simultaneously outwardly with respect to the chassis 12 in a direction away from the log 176. As shown by the motion arrow 180 in FIG. 35, this motion of the body 22 can be accomplished by rotational acceleration and raising of the right side of the body 22 with respect to the chassis 12.

As the vehicle 10 initiates and then completes its sliding turn, various special effects can be introduced to enhance the sensation of motion and the overall ride experience enjoyed by the passengers. These special effects include the sounds of engine roar and skidding corresponding to motion of the vehicle 10 along the path 18. The effect of flying gravel also can be introduced during the abrupt turning motion of the vehicle 10 away from the log 176, indicated by the arrows 178. Once the vehicle 10 safely passes the log 176, the body 22 can be returned to a normal level position with respect to the chassis 12 and the vehicle can continue along the path 18 through the attraction and towards the next ride experience.

Figure 36:
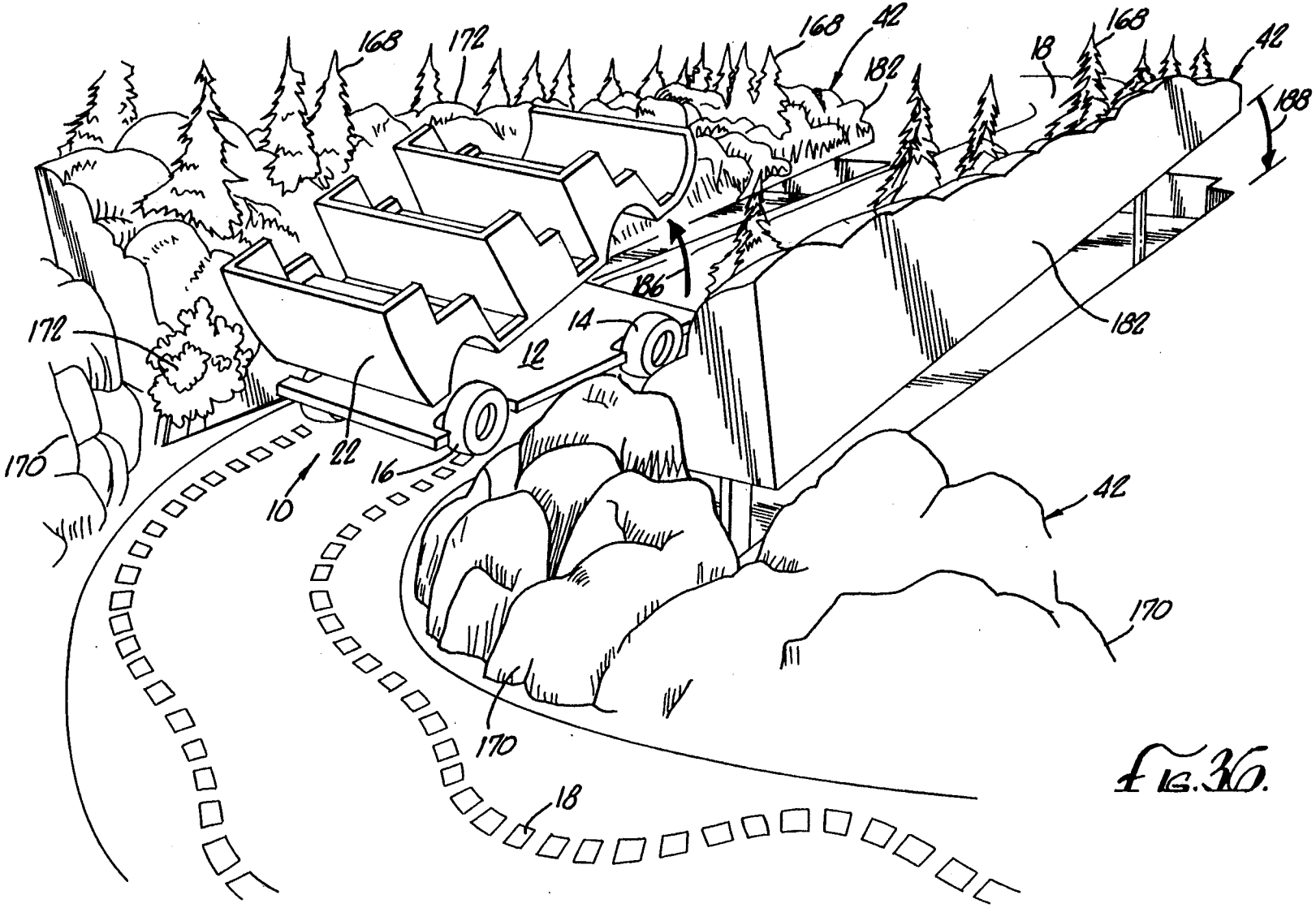
FIG. 36 is a perspective view of the ride vehicle as it moves through an attraction, in which rearward body pitch and other effects are used to simulate the effect of climbing a hill in the vehicle.

FIG. 36 shows the ride vehicle 10 in another area of the amusement park attraction, where the ride experience to be provided is the simulated effect of climbing a hill in the vehicle. In this ride experience, the vehicle 10 travels along the path 18 to a point where it reaches the bottom of the hill. At that point, passengers in the vehicle 10 will be presented with initially stationary scenery 42, which has a horizon that angles downwardly in a direction towards the vehicle as it approaches. This scenery 42 may be constructed on movable sets 182 on opposite sides of the path 18 in the form of trees 168, rocks 170 and bushes 172. Before the vehicle 10 actually approaches, the sets 182 are elevated by hydraulic actuators 184 or the like at the downward angle described above. After the vehicle 10 passes, the sets 182 can be returned to a normal horizontal position.

As will be described further below, there are a number of ways of actuating moving show sets such as those discussed above. The simplest way to do this is to have a sensor that is coupled to the hydraulic actuators 184, which detect the approach of a ride vehicle and trigger a predefined motion pattern of the sets 182. After a predefined period of time, or the sensed departure of the ride vehicle 10, the sets 182 can be moved back to their initial position and reset for actuation for the next ride vehicle and accompanying passengers.

However, as mentioned, in the preferred embodiment, articulation of the passenger supporting area 20 is ideally precisely synchronized with moving show sets 182. Consequently, each ride vehicle possesses an rf transceiver which is coupled by the computerized vehicle-control system 40 to communicate thereto selection of a particular ride program. Both of the ride vehicle 10 and the moving show sets 182 are precisely synchronized in their operation to produce a combined three-dimensional and motion effect upon the passengers. In one possible alternative embodiment, actuation of the moving show set may be instead by triggered by the central controller, which is directly coupled to each moving show set 182, and which signals the show set to commence its predefined movement pattern in response to selected ride program of the ride vehicle 10, and the attainment by the ride vehicle of a precise position along the path 18, measured by a number of feet. Position of each ride vehicle 10 is preferably maintained by each of the computers 193 and 195 of the computerized vehicle-control system 40, and periodically or specifically transmitted to the central controller by rf communication.

As the vehicle 10 reaches the base of the hill corresponding to the forward ends of the two sets of scenery 182, the vehicle's body 22 is pitched backward by rotational acceleration and raising of the front end about the pitch axis (indicated by the motion arrow 186). The body 22 is kept in that position as the vehicle moves along the path 18 past the stationary, angled sets of scenery 182. It is noted here that the pitched angle of the body 22 with respect to the chassis 12 is the same as the downward angle of the scenery sets 182. As the vehicle 10 begins climbing the hill, it is accelerated in the forward direction, while all four wheels 14 and 16 of the vehicle are steered in a motion pattern designed to create the simulated effect of fishtailing, as described previously.

During climbing of the hill, special effects are provided by introducing the sounds of a straining engine and wheels spinning on dirt. The special effect of flying gravel underneath the wheels 14 and 16 also may be provided. When the vehicle 10 has reached the top of the hill, the body 22 may be dropped back down to a substantially level position with respect to the chassis 12, and the scenery sets 182 may be retracted (as shown by the motion arrow 188) to their normal level position along the path 18.

Figure 37:
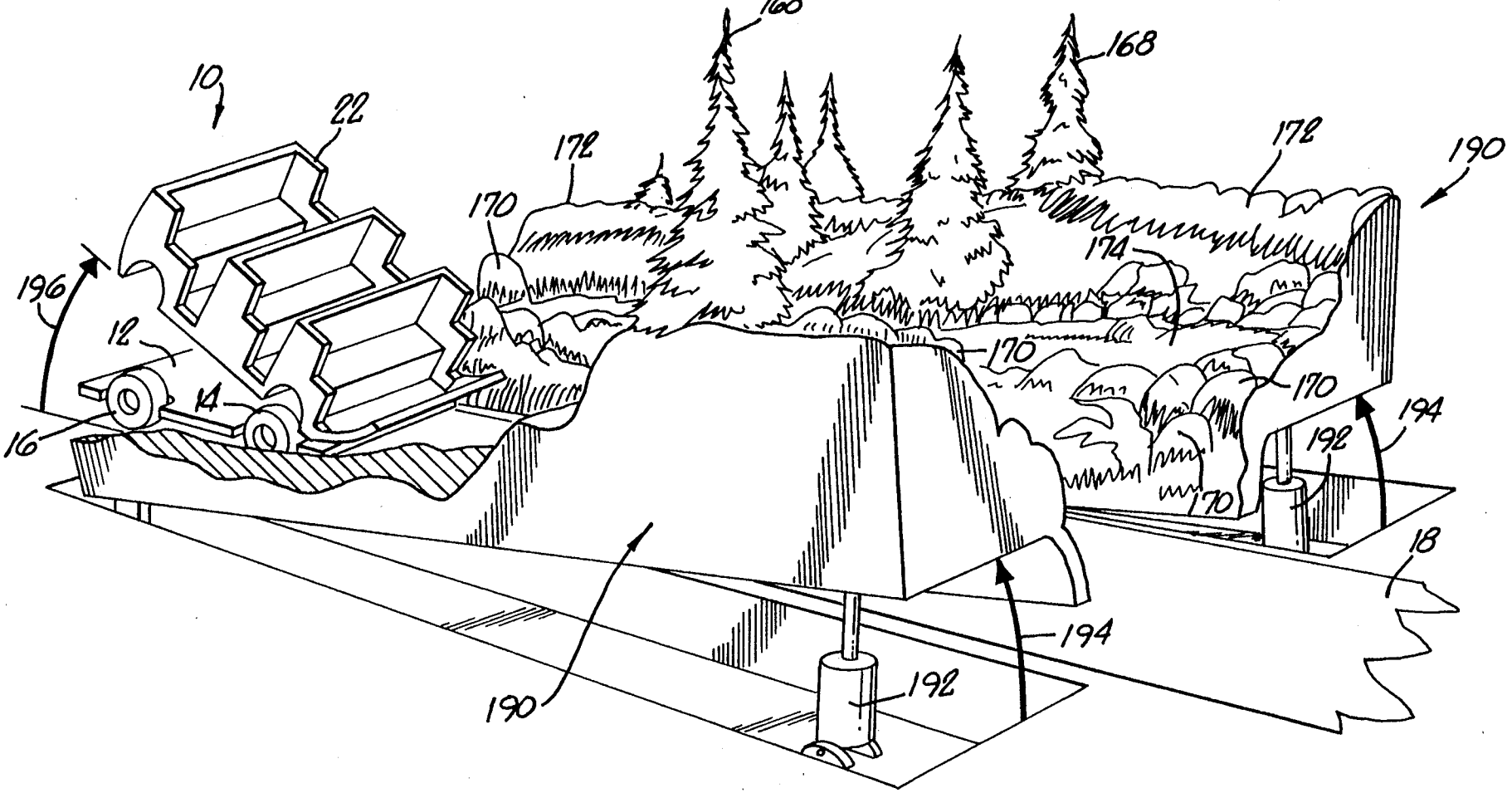
FIG. 37 is a perspective view of the ride vehicle as it moves through an attraction, in which forward body pitch and other effects are used to simulate the effect of descending a hill in the vehicle.

FIG. 37 shows the ride vehicle 10 in another area of the amusement park attraction, in which forward body pitch and other effects are used to simulate the effect of descending a hill in the vehicle. In this ride experience, initially stationary scenery 42 is provided with a horizon that angles upwardly in a direction away from the vehicle 10 as the vehicle approaches the scenery. The scenery 42 in this ride experience may comprise, for example, trees 168, rocks 170, bushes 172, grass 174 and other shrubbery incorporated into movable sets 190 along opposite sides of the path 18. Before the ride vehicle 10 reaches these sets 190, the sets are pivoted by hydraulic actuators 192 or the like causing the scenery 42 to angle upwardly in a direction away from the vehicle 10, as shown by the motion arrow 194. After the vehicle 10 passes the scenery 42, the sets 190 may be retracted to a level position with respect to the path.

As the vehicle 10 is moved forward along the path 18 and reaches a point corresponding to the top of the hill, the vehicle is decelerated and the body 22 is pitched forward by rotational acceleration and raising of the rear end about the pitch axis, as shown by the motion arrow 196. The body 22 is kept in this pitched position as the imaginary hill is descended. At the bottom of the hill, the rear end of the body 22 is lowered until it reaches a substantially level position with respect to the chassis 12.

As noted above, while the vehicle 10 is descending the imaginary hill, the vehicle is decelerated. Accordingly, special effects corresponding to the sounds of gear whine, a screaming engine and wheels sliding on dirt are appropriately provided as the vehicle 10 descends the hill. Other effects, such as slight fishtailing by four-wheel steering, and the effect of flying gravel underneath the wheels 14 and 16, also may be provided to enhance the ride experience even further.

Figure 38:
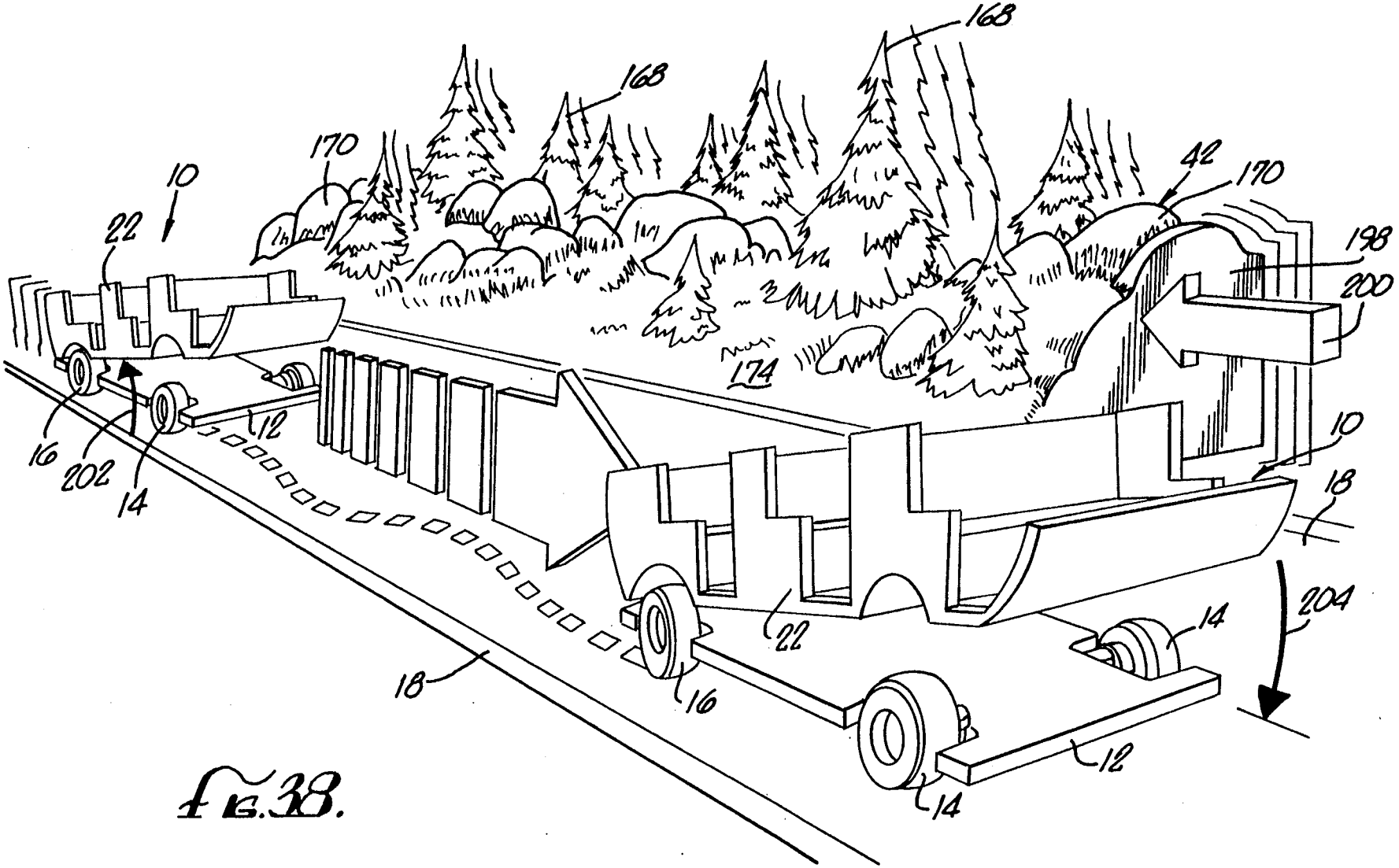
FIG. 38 is a perspective view of the ride vehicle as it moves through an attraction, in which rearward body pitch and other effects are used to enhance the effect of sudden forward acceleration of the vehicle.

FIG. 38 shows the vehicle 10 in another area of the amusement park attraction where the ride experience to be provided is the simulated effect of sudden forward acceleration of the vehicle. Here, distant objects are provided along the path 18, which remains stationary, while close objects are provided generally in the area of vehicle acceleration which are adapted to move backwards. In one form of the invention, the close objects comprise scenery 42 in the form of trees 168, rocks 170 and grass 174 built onto a moving set 198, with one set preferably on each side of the path 18. These sets 198 are adapted to accelerate rearwardly in a direction opposite from the vehicle 10 in the direction indicated by the arrow 200.

As the ride vehicle 10 moves along the path 18 and approaches the moving scenery sets 198, the vehicle is accelerated in a forward direction. Simultaneously, the vehicle's body 22 is pitched rearwardly by rotational acceleration and raising of the front end about the pitch axis, as indicated by the motion arrow 202, and kept in that position as the vehicle 10 continues to accelerate in a forward direction. Also, simultaneously, slight fishtailing of the vehicle 10 is provided by four-wheel steering in the motion pattern previously described. As the vehicle 10 accelerates along the path 18, the scenery sets 198 are accelerated rearwardly.

The rearward pitching of the body 22 during normal vehicle acceleration, in combination with the moving set of scenery 198, substantially enhances the feeling of sudden forward acceleration of the vehicle 10. To further enhance the ride experience, the sounds of a roaring engine and squealing tires are provided during acceleration of the vehicle 10. Blowing wind and the effect of flying gravel also may be included. When the vehicle 10 has stopped accelerating, and has passed the moving sets of scenery 198, the body 22 may be returned to a normal level position with respect to the chassis 12, as indicated by the arrow 204. The moving sets of scenery 198 also may be returned to their initial positions.

Figure 39:
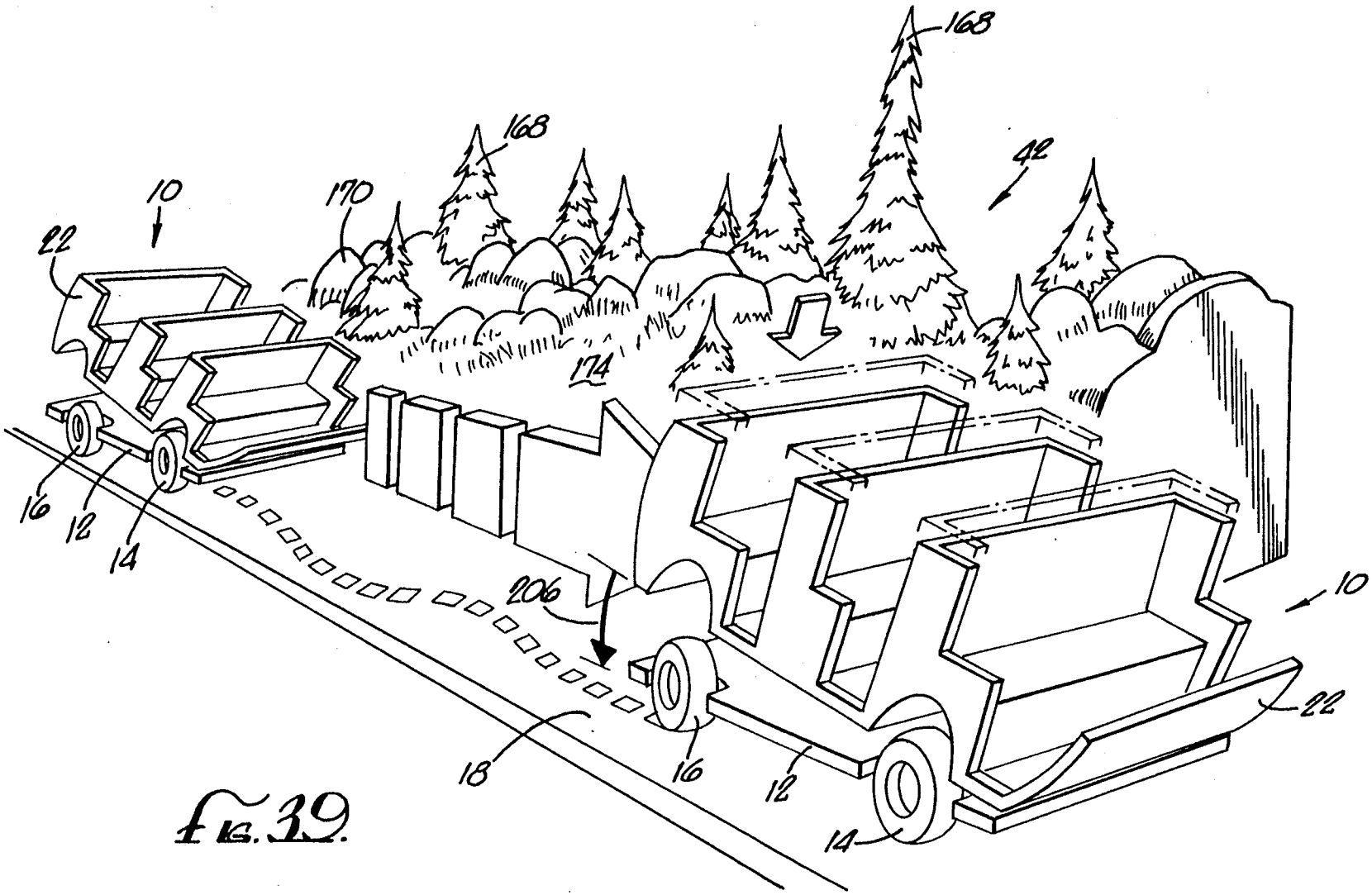
FIG. 39 is a perspective view of the ride vehicle as it moves through an attraction, in which forward body pitch and other effects are used to exaggerate the effect of sudden deceleration of the vehicle.

FIG. 39 illustrates the next ride experience. In this area of the amusement park attraction, the ride experience to be provided includes the simulated effect of a screeching stop by the vehicle 10. To this end, stationary scenery 42 in the form of trees 168, rocks 170, and grass 174 are appropriately and artistically arranged along the path 18 that is to be followed by the vehicle. As the vehicle 10 begins decelerating, the body 22 is pitched forward by rotational acceleration and raising of its rear end about the pitch axis to enhance the sensation of the stopping motion. The body 22 is kept in this position as the vehicle 10 continues to decelerate. Fishtailing of the vehicle 10 with four-wheel steering also may be provided to enhance the sensation of being somewhat out of control during the stop. When the vehicle 10 is fully stopped, the body 22 is rapidly dropped back down to a horizontal position with respect to the chassis 12, as indicated by the motion arrow 206, giving the feeling of a very abrupt stop. To further enhance the ride experience, the sounds of screeching brakes and sliding tires can be provided during deceleration of the vehicle 10. The effect of a forwardly blowing dust cloud when the vehicle 10 is stopped adds an additional special effect.

Figure 40:
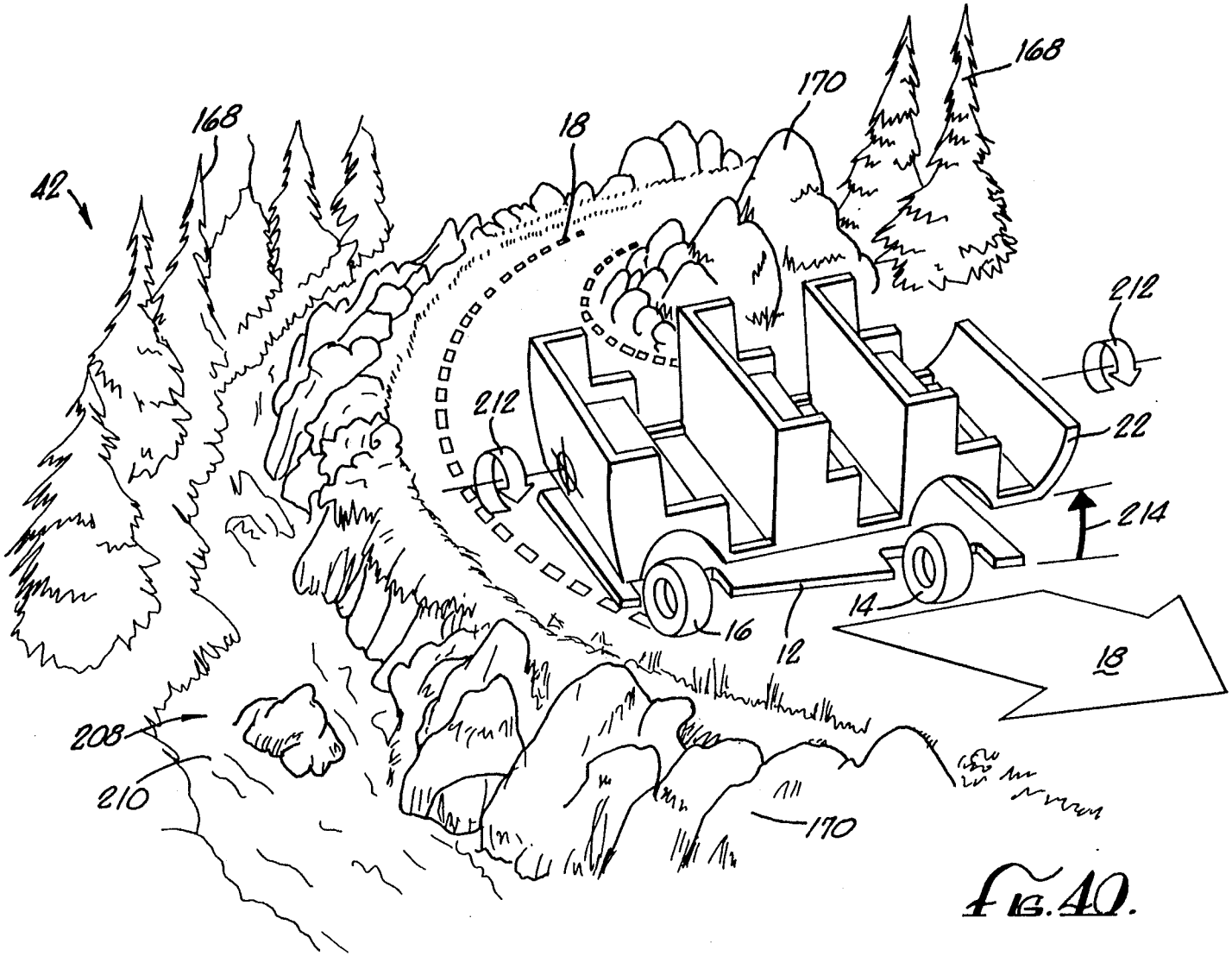
FIG. 40 is a perspective view of the ride vehicle as it moves through an attraction, in which four-wheel steering in combination with outward body roll, rearward body pitch and other effects are used to simulate the effect of sliding off the edge of a road while in a turn.

FIG. 40 illustrates a ride experience that includes the simulated effect of sliding off of the side of a road while in a turn. In this area of the amusement park attraction, the path 18 resembles a curved roadway, with stationary scenery 42 in the form of trees 168, rocks 170, bushes 172, and grass 174 along the path 18. Additionally, the appearance of a ditch 208, with a stream 210 that follows the curvature of the roadway 18, can be used to enhance the sensation of danger as the vehicle 10 appears to slide off the road while in the turn.

As the vehicle 10 enters the turn, four-wheel steering is used to turn the vehicle substantially sideways as it follows the curved path 18. This involves steering the rear wheels 16 more than the front wheels 14 causing the rear of the vehicle 10 to rotationally accelerate and swing outwardly. This outward swinging of the vehicle 10 is exaggerated by rolling the body 22 outwardly, as indicated by the arrow 212, and by pitching the body 22 backward by raising the front end, as indicated by the arrow 214. This combined motion simulates the effect of a sliding turn and, when the vehicle 10 approaches the outer portion of the road 18, gives the passengers the feeling that the vehicle will slide off the road.

To enhance the ride experience, the sounds of the tires sliding on the roadway 18, as well as thumping and scraping sounds, convey the impression that the vehicle 10 is sliding out of control. The effect of sparks flying out from under the vehicle 10 also may be introduced to heighten the passenger's sensation of danger and further enhance the ride experience.

Figure 41:
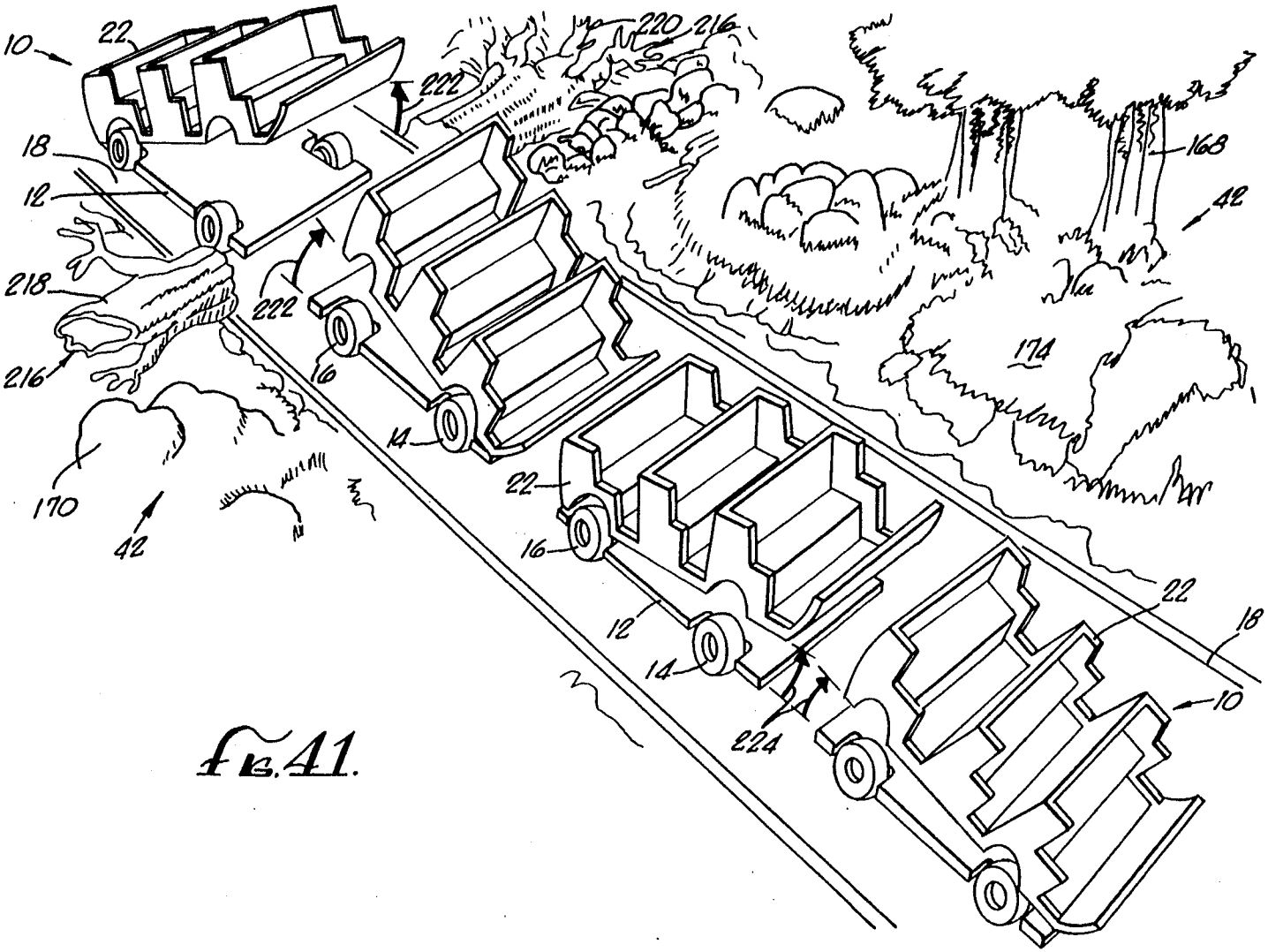
FIG. 41 is a perspective view of the ride vehicle as it moves through an attraction, in which pitching motion of the body and other effects are used to simulate the effect of driving over a log in the vehicle.

FIG. 41 shows the ride vehicle 10 in another area of the amusement park attraction, where the ride experience to be conveyed is the simulated effect of driving over a log. In this ride experience, stationary scenery 42 in the form of trees 168, rocks 170 and grass 174 are provided along the path 18 that is to be followed by the vehicle 10. A relatively large object 216, such as a log prop or fallen tree, is placed directly in the path 18 followed by the vehicle 10. This log 216 is divided into two sections 218 and 220, each of which is adapted to move quickly to one side of the path 18 and out of the way of the vehicle 10. Movement of the log 218 and 220 sections can be timed so that the vehicle 10 just misses them as it travels along the path 18.

As soon as the log sections 218 and 220 quickly move out of the way of the vehicle 10 and the vehicle is at the point which corresponds to the location of the log 216, the body 22 is quickly pitched backward and then forward by causing the front end of the body to quickly raise up and then down, as indicated by the arrows 222. This motion simulates the effect of the front wheels 14 traveling over the log 216. After waiting for an elapsed distance travelled by the vehicle 10 that corresponds to the rear of the vehicle 10 reaching the log 216, the body 22 is quickly pitched forward and then backward by causing the rear end of the body to quickly raise up and then down, as indicated by the arrows 224. This motion simulates the effect of the rear wheels 16 traveling over the log 216. When the vehicle 10 has safely passed, the log sections 218 and 220 are moved back to their initial position across the path 18. The ride experience is further enhanced by introducing the sounds of thumping and crashing while the body 22 is pitched forward and backward, at the point where the vehicle 10 simulates the effect of driving over the log 216.

In one aspect of this ride experience, pitching motion of the body 22 forward and backward may continue for several cycles after the vehicle 10 has passed the log 216. As the distance between the vehicle 10 and the log 216 increases, the amplitude of the pitching motion is decreased until the body 22 is eventually returned to a substantially level position with respect to the chassis 12. As discussed previously in connection with some of the motion patterns described above, this gives the passengers the simulated effect experienced in a conventional vehicle where shock absorbers dampen body motion after driving over an object.

Figure 42:
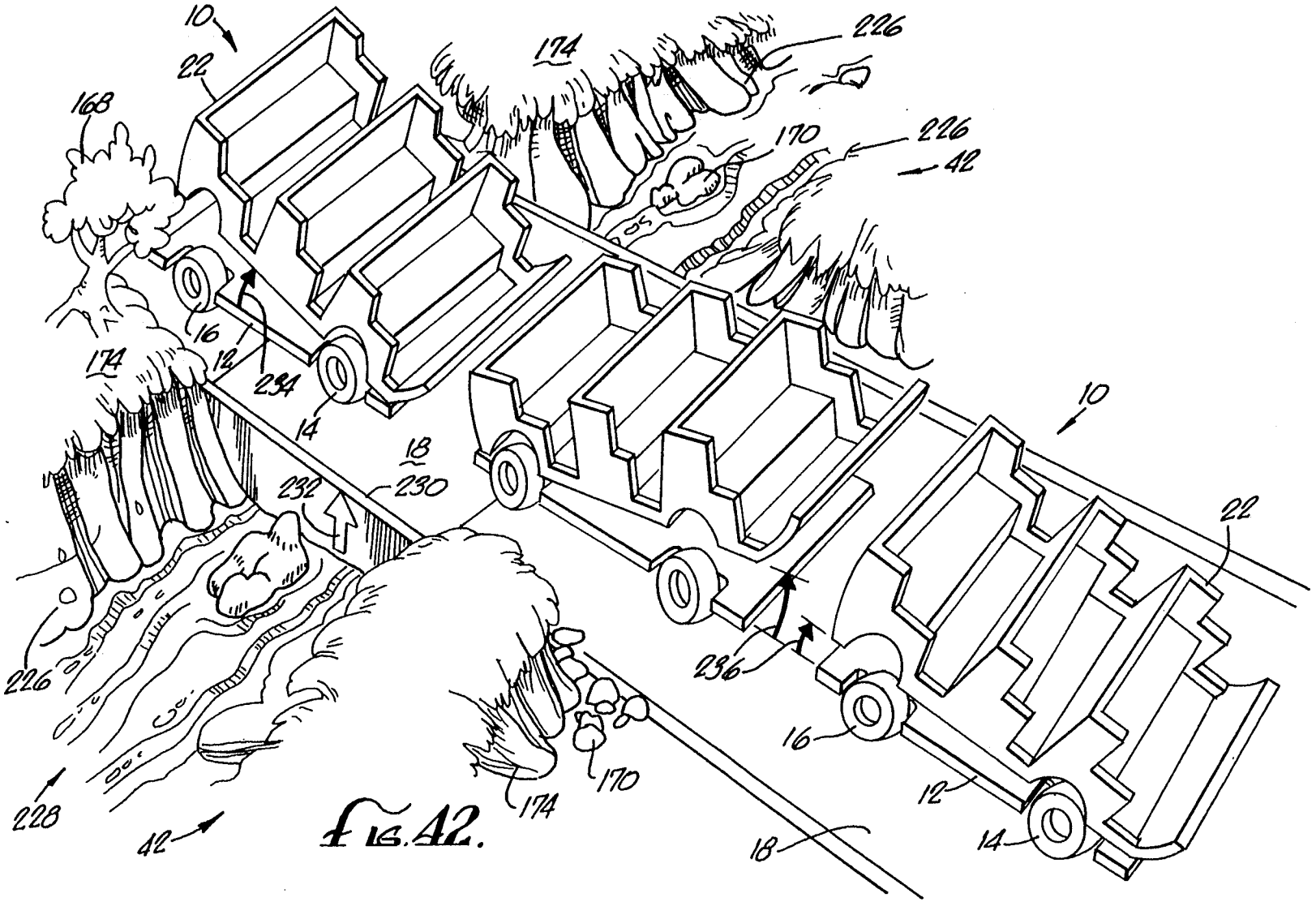
FIG. 42 is a perspective view of the ride vehicle as it moves through an attraction, in which pitching motion of the body and other effects are used to simulate the effect of driving over a ditch in the vehicle.

FIG. 42 illustrates a ride experience that includes the simulated effect of driving over a ditch. In this area of the attraction, stationary scenery 42 in the form of trees 168, rocks 170 and grass 174 are provided, along with river banks 226 on opposite sides of the path 18 giving the appearance of a ditch 228 that appears to be, but is not actually, present in the path 18 followed by the vehicle 10. Thus, before the vehicle 10 actually reaches the ditch 228, a movable section 230 of the path 18 corresponding to the location of the ditch 228 is lowered with respect to the normal roadway elevation. As soon as the vehicle 10 reaches the ditch 228, however, the section 230 of the path 18 is elevated to the same elevation as the normal roadway, as indicated by the arrow 232.

Once the front end of the vehicle 10 reaches a point corresponding to the location of the ditch 228, the rear end of the body 22 is raised up and then dropped back down with respect to the chassis 12, as indicated by the arrow 234. This motion simulates the effect of the front wheels 14 entering the ditch 228. After waiting for an elapsed distance travelled by the vehicle 10 that corresponds to the rear of the vehicle 10 reaching the ditch 228, the front end of the vehicle is then moved upwardly, as shown by the arrows 236, as the vehicle continues to move forward, passing the ditch. This motion simulates the effect of the rear wheels 16 leaving the ditch 228.

In one aspect of this ride experience, pitching motion of the body 22 in the forward and backward directions may continue for several cycles after the vehicle 10 has passed the ditch 228. As the distance between the vehicle 10 and the ditch 228 increases, the amplitude of the pitching motion is correspondingly decreased until the body 22 returns to a substantially level position with respect to the chassis 12. As discussed previously in connection with the ride experience which simulates the effect of driving over a log 216, pitching motion of the vehicle 10 for several cycles after it has passed the ditch 228 gives the passengers the experience of being in a conventional vehicle after it has driven through a ditch, and the effect of shock absorber dampening.

The ride experience of driving through a ditch 228 is further enhanced by introducing the sounds of thumping and splashing, and the effect of flying dirt and splashing water from underneath the vehicle 10 as it travels through the ditch 228. As soon as the vehicle 10 has passed the location corresponding to the ditch 228, the section 230 of the roadway 18 may be dropped back down so that the appearance of the ditch will be preserved by any curious, rearwardly looking passengers.

Figure 43:
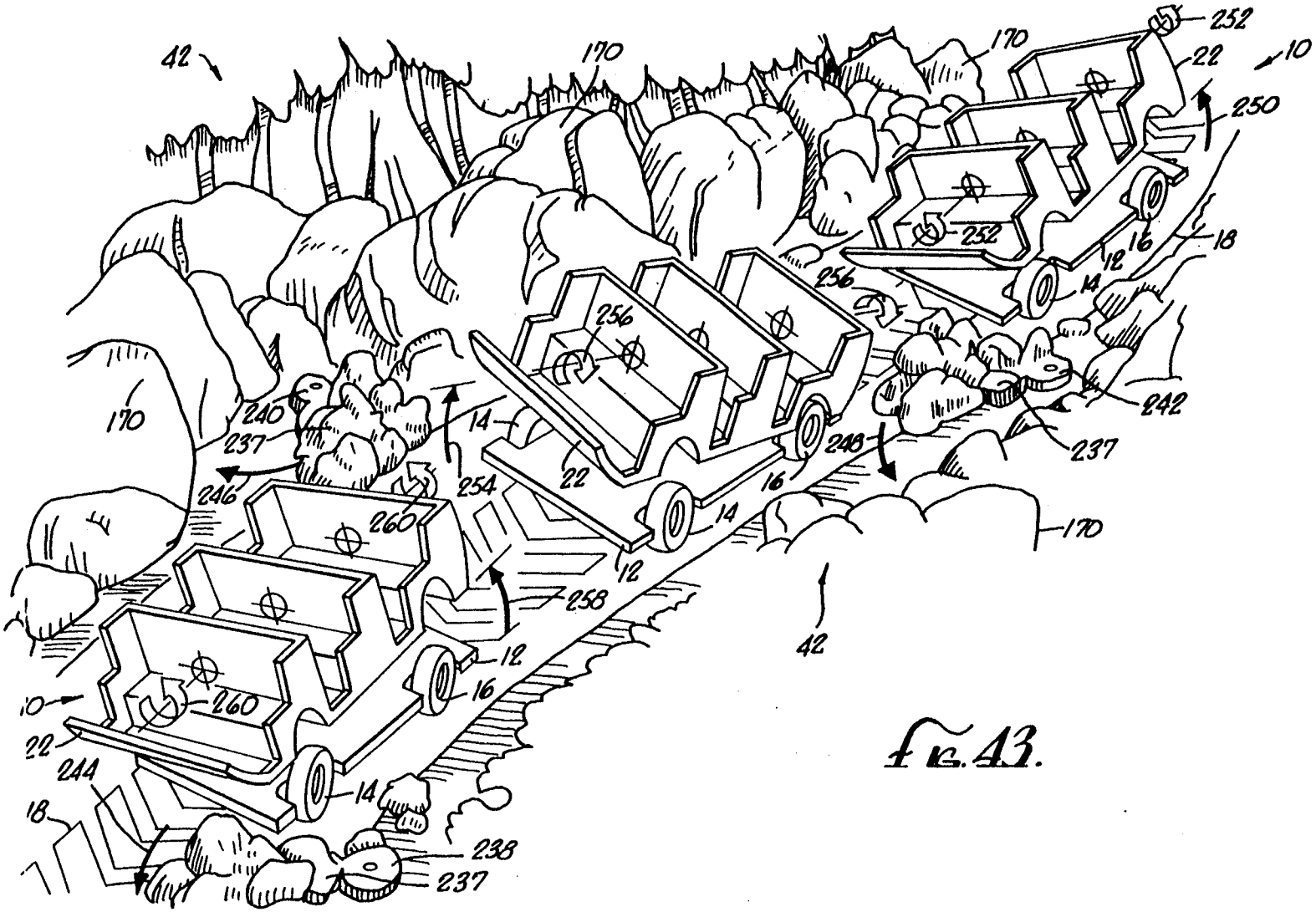
FIG. 43 is a perspective view of the ride vehicle as it moves through an attraction, in which forward and rearward body pitching and side-to-side body roll and other effects are used to simulate the effect of driving over rocks in the vehicle.

FIG. 43 shows the ride vehicle 10 as it moves through an amusement park attraction in which forward and rearward body-pitching, side-to-side body roll, and other effects are used to create a ride experience that simulates the effect of driving over rocks. In this ride experience, stationary scenery 42 in the form of trees 168 and rocks 170 are located along a curved path 18 followed by the vehicle 10. Second groups of artificial rocks 237 are also placed directly in the path 18 of the vehicle 10. These artificial rocks 237 are molded together or otherwise formed into a unitary set of rocks that is pivotally connected along the outer portions of the path 18 that is to be followed by the vehicle 10. Three sets 238, 240 and 242 of these artificial rocks 237 are shown in FIG. 43, and each is adapted to pivotally move out of the way, as indicated by the arrows 244, 246 and 248, just as the vehicle 10 is about to travel over them.

Just before one side of the vehicle 10 is about to run over the first set 238 of artificial rocks, the rocks 238 are quickly pivoted out of the way and the body 22 is pitched rearward by raising the front end and rolling the body outwardly away from the rocks, as indicated by the arrows 250 and 252. After the front of the vehicle 10 passes the location corresponding to the artificial rocks 238, the front end is dropped back down and the rear end is raised up, again with outward body roll away from the rocks. This combined motion, including pitching the body 22 rearwardly and then forwardly, in combination with outward body roll away from the location of the rocks 238, realistically simulates the effect of driving over the rocks. To further enhance the ride experience, the sounds of thumping and banging are introduced as the vehicle 10 passes the location of the rocks 238.

As the vehicle 10 continues to travel down the curved path 18, the other sets of movable rocks 240 and 242 are encountered. Accordingly, appropriate pitching of the body 22 rearwardly and then forwardly, in combination with outward body roll away from the location of the sets of rocks 240 and 242, as indicated by the motion arrows 254, 256, 258 and 260, will simulate the effect of driving over the rocks. This pattern may be repeated as many times as desired, depending upon the duration of the ride experience to be provided.

Figure 44:
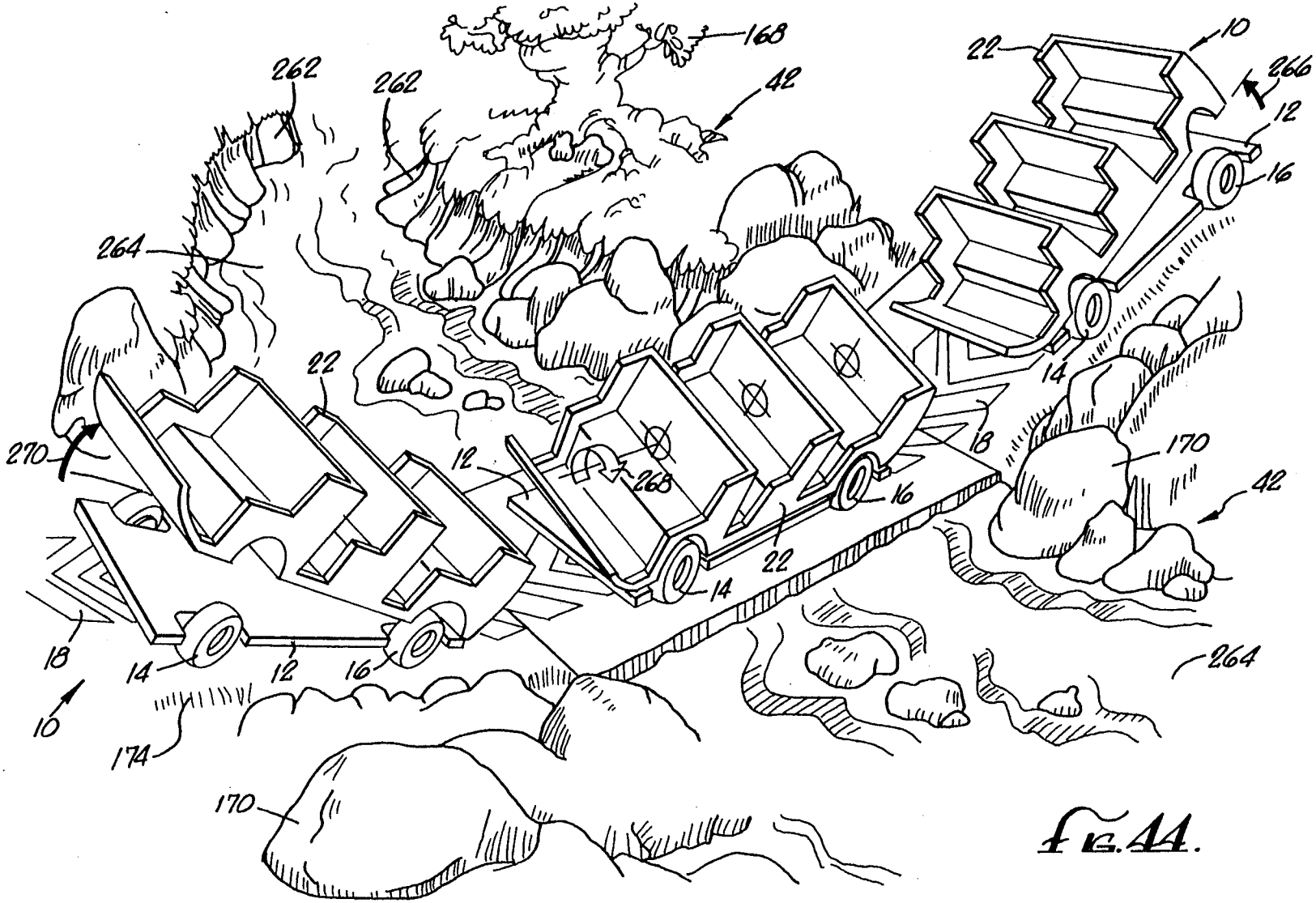
FIG. 44 is a perspective view of the ride vehicle as it moves through an attraction, in which pitching, bouncing and rolling body motion and other effects are used to simulate the effect of driving through a stream in the vehicle.

FIG. 44 illustrates the next ride experience. In this area of the amusement park attraction, the ride experience to be conveyed includes the simulated effect of driving through a stream. In one preferred form, the scenery 42 resembles stream banks 262 on opposite sides of the path 18, with water pools resembling a stream 264 that appears to, but actually does not, cross the path that is followed by the vehicle. Trees 168, rocks 170, grass 174, and other props may be provided to enhance the realism of the stream banks 262.

The path 18, which followed by the vehicle 10 towards the stream banks 262, angles downwardly where the vehicle enters the stream 264, relatively horizontal in the stream itself, and upwardly inclined as the path extends out of the stream. As soon as the vehicle 10 begins descending the downwardly inclined path 18, the body 22 is pitched forward by raising the rear end, as indicated by the arrow 266. This heightens the passenger's sensation of the steepness of the path 18 entering the stream 264. Upon entering the stream 264 and the horizontal portion of the path 18, the body 22 is leveled out and is then pitched slightly in the forward and rearward directions, in combination with outward body roll from side-to-side according to the motion arrow 268. This creates a bouncing and rolling motion of the body 22 with respect to the chassis 12, to simulate the effect of floating as the vehicle 10 appears to be but is not actually traveling through the stream 264.

While in the stream 264, the sounds of splashing, engine roar and spinning tires further simulate the effect of traveling through the stream. The effect of splashing and spraying from underneath the vehicle 10 also adds to this effect. When the vehicle 10 reaches the upwardly inclined path 18 leaving the stream bank 262, the body 22 is pitched backward by raising the front end relative to the chassis 12, as indicted by the arrow 270. This exaggerates the steepness of the path 18 leaving the stream bank 262.

Figure 45:
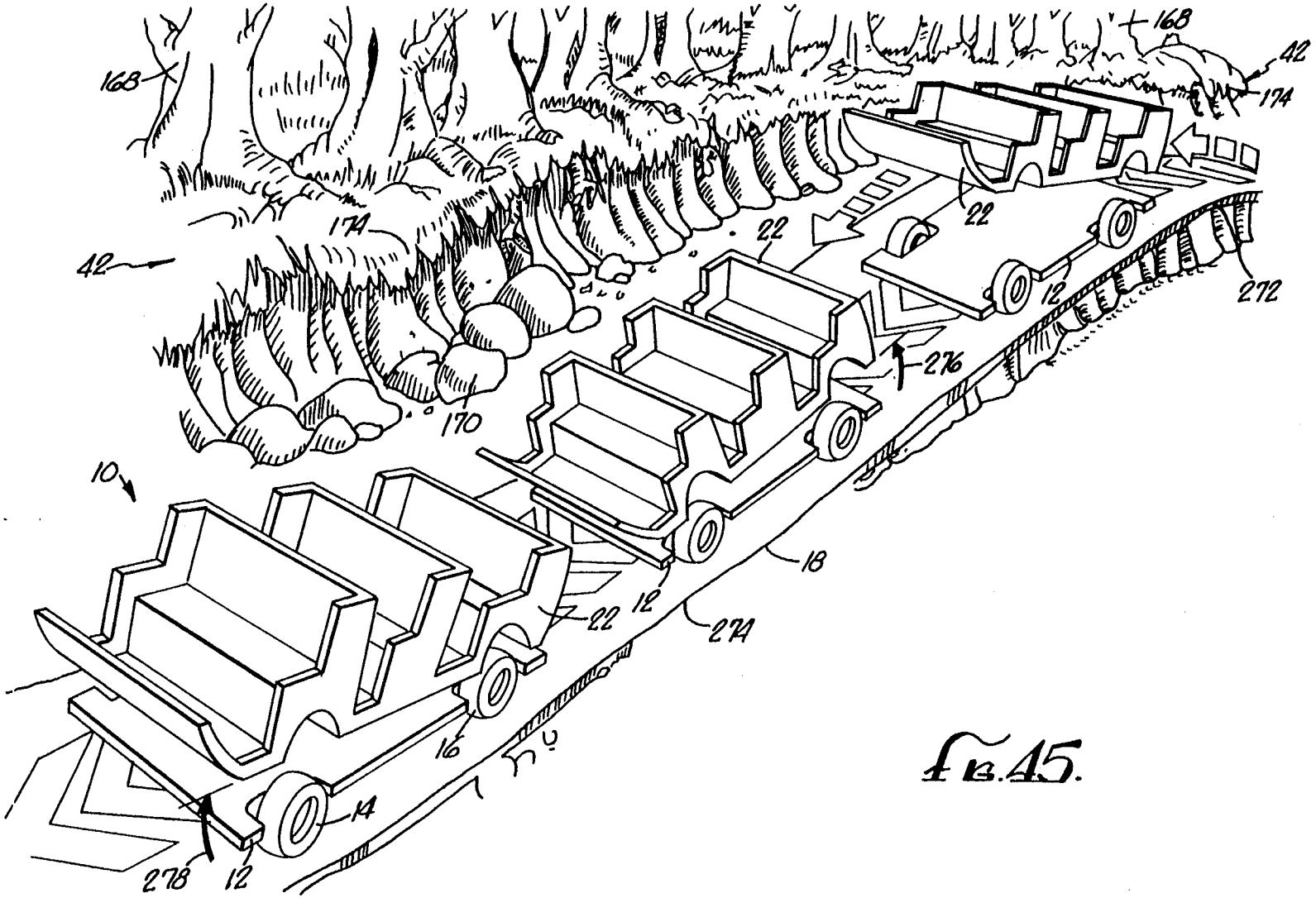
FIG. 45 is a perspective view of the ride vehicle as it moves through an attraction, in which pitching body motion and other effects are used to simulate the effect of cresting a hill and going airborne in the vehicle.

FIG. 45 shows the ride vehicle 10 moving along the path 18 in another area of the amusement park attraction. In this area of the attraction, the ride experience is the simulated effect of cresting a hill and becoming airborne in the vehicle. Accordingly, stationary scenery 42 is provided along the path 18 that is to be followed by the vehicle 10. The scenery 42 may include, for example, trees 168, rocks 170 and grass 174. The path 18 followed by the vehicle is relatively straight, but forms a small hill 272, and then a slight dip 274 at the base of the hill.

When the vehicle 10 reaches the crest of the hill 272 at a relatively fast pace, further travel of the vehicle actually causes the chassis 12 to go down the side of the hill towards the dip 274. At the crest of the hill 272, however, the entire body 22 is elevated relative to the chassis 12, with the front end being raised slightly more than the rear end. This simulates the effect of going airborne as the vehicle 10 crests the hill 272. As the distance between the vehicle 10 and the crest of the hill 272 increases, the body 22 is gradually pitched forwardly by dropping the front end faster than the rear end. By then abruptly dropping the rear end and quickly raising the front end at the location of the dip 274, as indicated by the motion arrows 276 and 278, a crashing drop can be simulated.

Additionally, when the vehicle 10 crests the hill 272 and simulates the effect of going airborne, the sounds of engine roar and free wheeling of the tires are introduced. During the crashing drop, the sounds of skidding and crashing also are introduced. The effect of sparks and dirt flying from underneath the vehicle 10 further enhance the effect of the crashing drop.

In a further aspect of this ride experience, forward and backward pitching motion of the body 22 continues for several cycles after the vehicle 10 has completed its crashing drop. As the distance between the vehicle 10 and the crest of the hill 272 increases, the amplitude of the pitching motion is decreased until the body 22 is eventually returned to a substantially level position with respect to the chassis 12.

Figure 46:
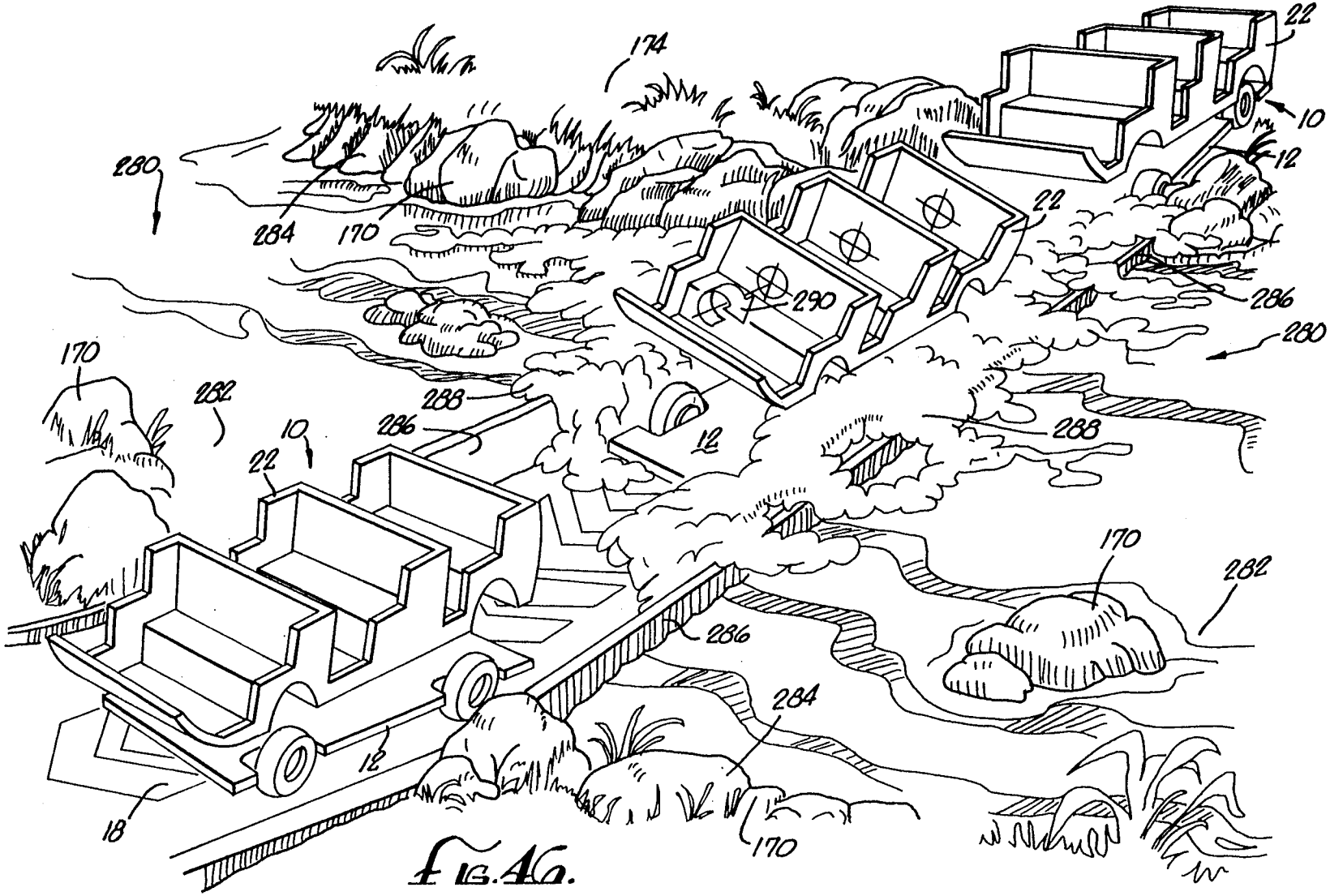
FIG. 46 is a perspective view of the ride vehicle as it moves through an attraction, in which gentle pitching and rolling body motion and other effects are used to simulate the effect of the vehicle floating in water.

FIG. 46 illustrates the next ride experience. In this area of the attraction, the ride experience comprises the simulated effect of floating in water. To this end, an appropriate water scene 280 is provided in the path 18 followed by the vehicle 10. As shown in FIG. 46, this scene 280 may resemble a river 282 with river banks 284, rocks 170, grass 174, and other shrubbery on opposite sides of the path 18. The path 18 in this area of the attraction is specially constructed, and includes retaining walls 286 on opposite sides of the path in the area where the path extends through the river 282. Thus, the path 18 is downwardly inclined as it enters the river 282 and upwardly inclined as it leaves. The section of the path 18 that actually traverses the river 282 includes the retaining walls 286 that keep water in the river from entering the path. A special effect, such as simulated fog 288, hides the section of the path 18 in the river 282 and creates the illusion that the vehicle 10 is actually traveling through the river 282.

As the vehicle 10 begins to travel down the path 18 into the river 282, the body 22 is pitched backwardly by raising the front end relative to the chassis 12. This corresponds to the front end of the vehicle 10 entering the river 282. As the vehicle 10 continues to travel along the path 18 through the river 282, the body 22 is first elevated, and then gently pitched forward and backward and rolled from side-to-side with respect to the chassis, as indicated by the motion arrow 290. This gentle pitching and rolling motion is designed to simulate the effect of floating in the river 282. Appropriate elevation of the body 22 with respect to the chassis 12, in combination with these body movements, keeps the body substantially in a horizontal, floating position while the vehicle seemingly fords the river 282.

While passing the river 282, the sounds of splashing water and waves are introduced. These sounds, in combination with the fog 290, realistically simulate the effect of floating in the river 282. When the vehicle 10 reaches the opposite side of the river 282, the body 22 is moved back down to its normal level position, in preparation for the next ride experience.

Figure 47:
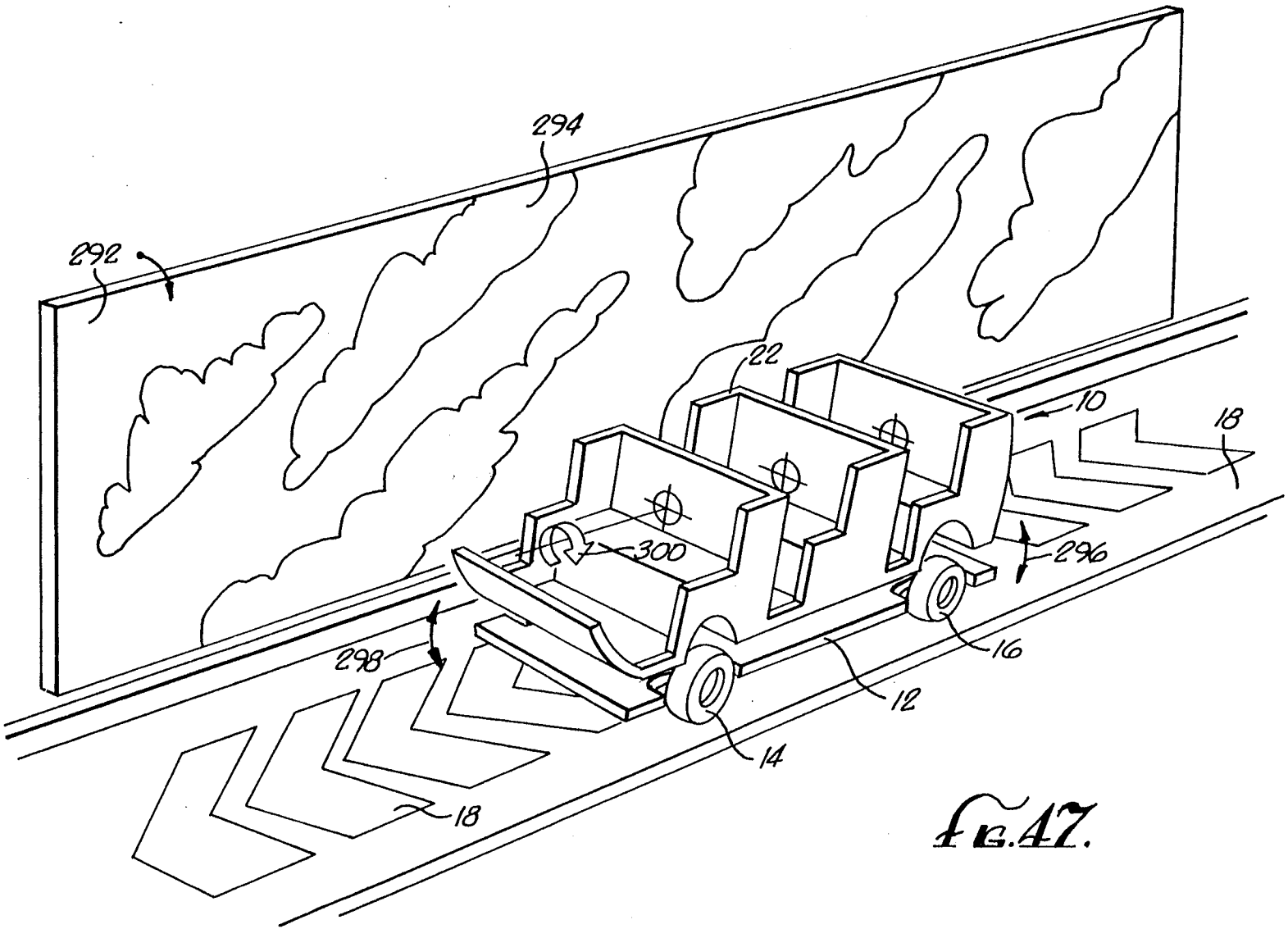
FIG. 47 is a perspective view of the ride vehicle as it moves through an attraction, in which gentle pitching and rolling body motion and other effects are used to simulate the effect of the vehicle flying or falling through the air.

FIG. 47 illustrates a ride experience that includes the simulated effect of flying or falling through air. Here, the vehicle 10 follows a relatively straight path 18 past a large projection screen 292. Although not illustrated for purposes of clarity, a projection screen 292 may be provided on both sides of the path 18 followed by the vehicle 10. In the preferred embodiment, the projection screen 292 is of the rear projection type and is adapted to project rapidly moving scenes, such as clouds 294.

Once the vehicle 10 has reached a location on the path 18 alongside the projection screen 292, the body 22 is gently pitched forward and backward and rolled from side-to-side with respect to the chassis 12, as indicated by the motion arrows 296, 298 and 300. Simultaneously, wind is blown against the passengers and the sounds of whistling air are introduced. These special effects, in combination with the body motion and rapidly moving scenes 294 on the projection screen 292, realistically simulate the effect of flying or falling through the air.

Figure 48:
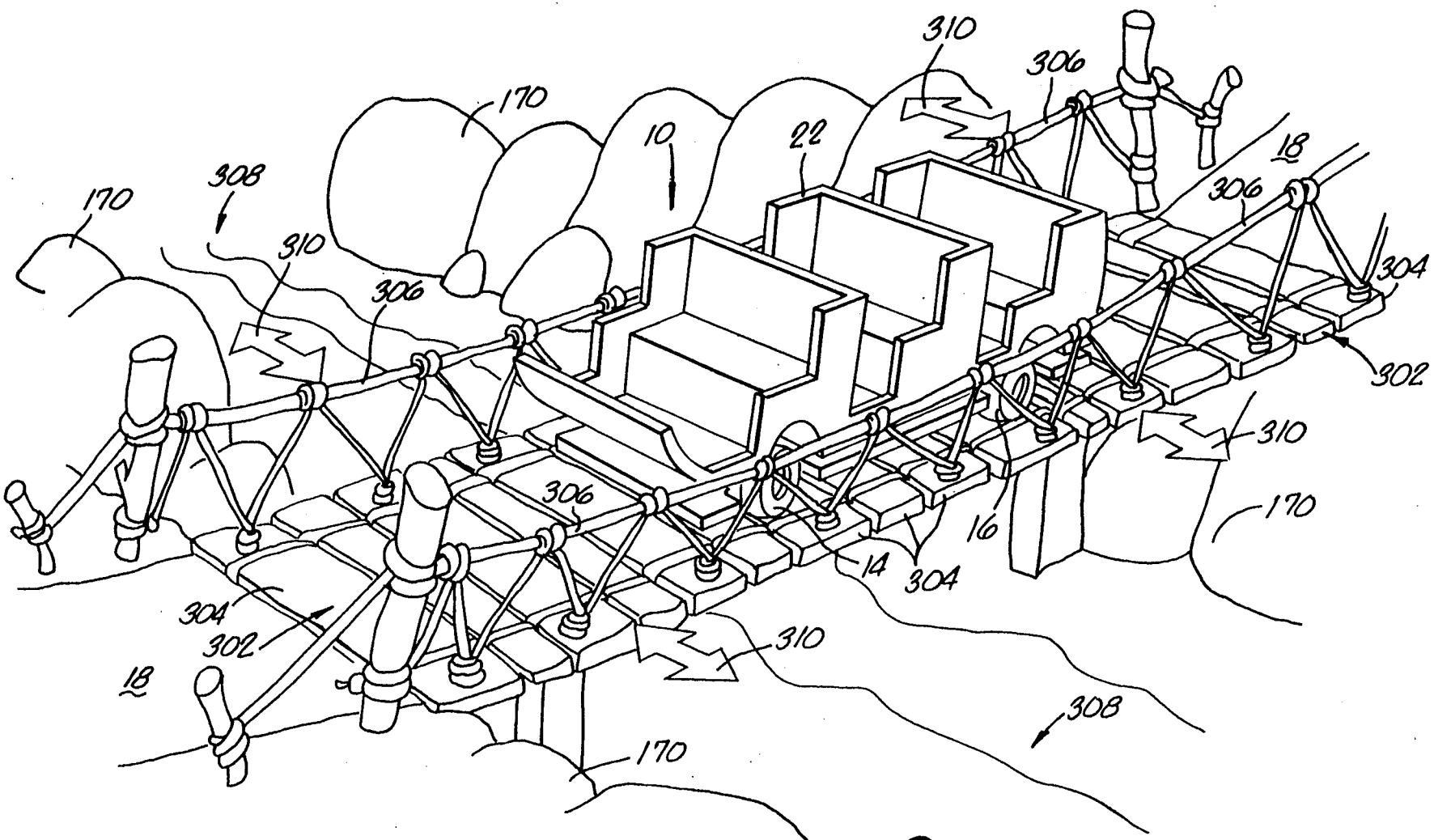
FIG. 48 is a perspective view of the ride vehicle as it moves through an attraction, in which four-wheel steering and other effects are used to simulate the effect of driving over a jungle bridge in the vehicle.

FIG. 48 illustrates the next ride experience, which involves the simulated effect of driving over a bridge 302. Here, the path 18 of the vehicle 10 extends directly onto the bridge 302 which, in the preferred embodiment, resembles a jungle-style bridge. Accordingly, the bridge 302 includes wooden planks 304 comprising the roadway surface, with rope side rails 306. Below the jungle bridge 302, a river 308 is flowing, with rocks 170 on opposite sides of the stream to demarcate the river and the distance traversed by the bridge. This bridge 302 is adapted to sway, or to appear to sway, from side to side in the direction of the arrows 310.

In this ride experience, the vehicle 10 is moved along the path 18 and across the bridge 302. As the vehicle 10 crosses the bridge 302, four-wheel steering, pursuant to one of the motion patterns previously described, causes the vehicle to sway from side-to-side across the bridge. The bridge 302 also may be moved from side-to-side at the same time to heighten the passenger's sensation of instability and lack of safety during the crossing of the bridge. The sounds of creaking and cracking wood add further to this sensation and the overall ride experience.

Figure 49:
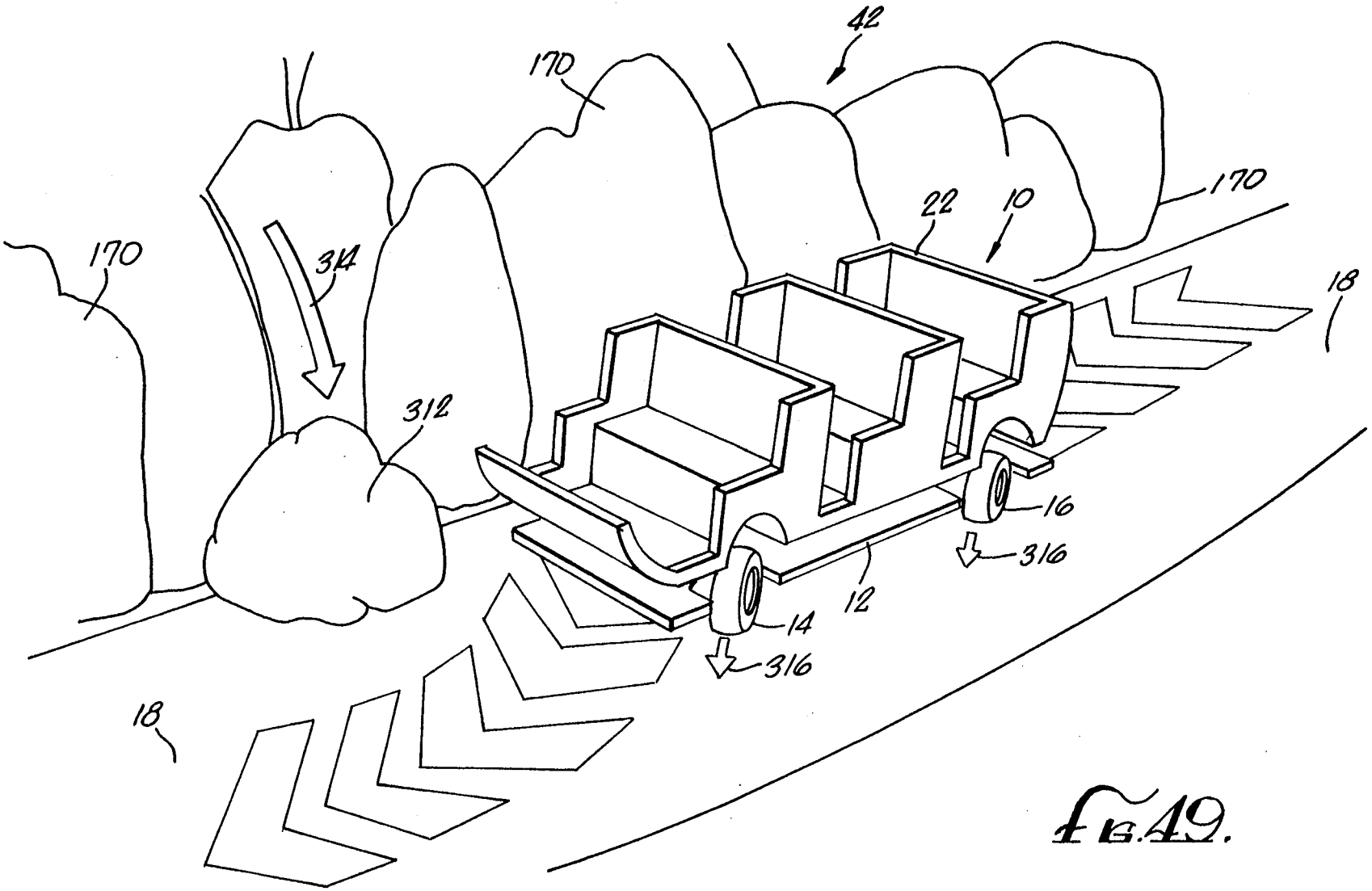
FIG. 49 is a perspective view of the ride vehicle as it moves through an attraction, in which four-wheel steering and other effects are used to simulate the effect of the vehicle swerving to miss a falling object.

FIG. 49 illustrates another area of the amusement park attraction, in which the ride experience to be conveyed is the simulated effect of swerving to miss a falling object. Stationary scenery 42 in the form of rocks 170, for example, are located along at least one side of the relatively straight path 18. A large object 312, such as an artificial boulder or rock, is adapted to move downwardly, as indicated by the arrow 314, into the path 18 of the vehicle 10. This movement of the rock 312 may be accomplished by appropriate mechanical devices that allow the rock to fall into the path 18, and to be subsequently retrieved after the vehicle passes, in preparation for falling in front of the next vehicle.

When the vehicle 10 reaches a location along the path 18 that is close to the falling rock 312, the rock begins to fall down into the path and the vehicle abruptly swerves out of its way. This swerving motion is accomplished by four-wheel steering in the direction of the arrows 316. This substantially exaggerates the sharpness and abruptness of the swerving motion. The four-wheel steering and falling of the rock 312 are appropriately timed so that the vehicle 10 just misses the rock as it crashes down onto the path 18. The sounds of crashing, while the rock 312 falls, and the sounds of skidding tires during the swerving motion add substantially to the ride experience.

Figure 50:
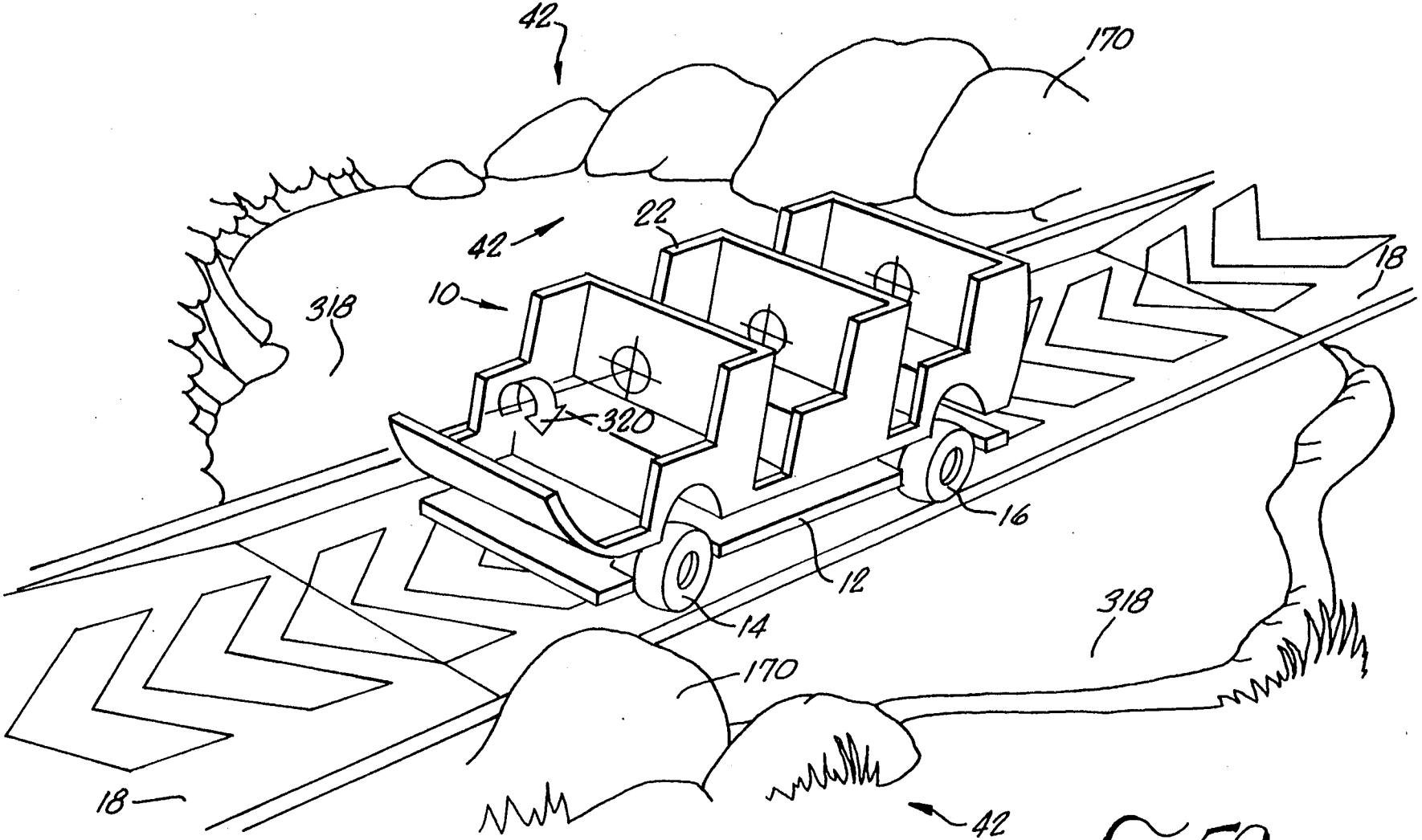
FIG. 50 is a perspective view of the ride vehicle as it moves through an attraction, in which slight rolling motion of the body and other effects are used to simulate the effect of the vehicle being stuck in the mud.

FIG. 50 shows the ride vehicle 10 in yet another area of the attraction. Here, the ride experience includes the simulated effect of being stuck in the mud. Accordingly, stationary scenery 42, in the form of rocks 170 bounding a pool of mud 318 in the path 18 of the vehicle 10, are provided. Of course, the path 18 does not actually extend into the mud 318, but rather over it in the manner shown in FIG. 50. The mud 318 itself need not be real, so long as it appears to be so.

Vehicle motion in this ride experience includes stopping the vehicle 10 at a location along the path 18 in the area of the surrounding mud pool 318. The vehicle 10 can be slowed in a manner that simulates the feeling that the vehicle is attempting to accelerate through the mud 318, but is being bogged down until it eventually stops. Then, a slight rolling motion may be imparted to the vehicle 10 by gently pitching the body 22 rearward and forward and rolling it from side-to-side with respect to the chassis 12, as indicated by the motion arrow 320. This body motion is designed to simulate the vehicle 10 attempting to drive out of the mud pool 318. Simultaneously, the sounds of a roaring engine and spinning tires are introduced. The effect of simulated mud also can be caused to fly away from the vehicle 10, to simulate the actual physical effects that relate to the sounds of the roaring engine that appear to be spinning the wheels 14 and 16, while the vehicle 10 appears to be stuck in the mud 318.

Figure 51:
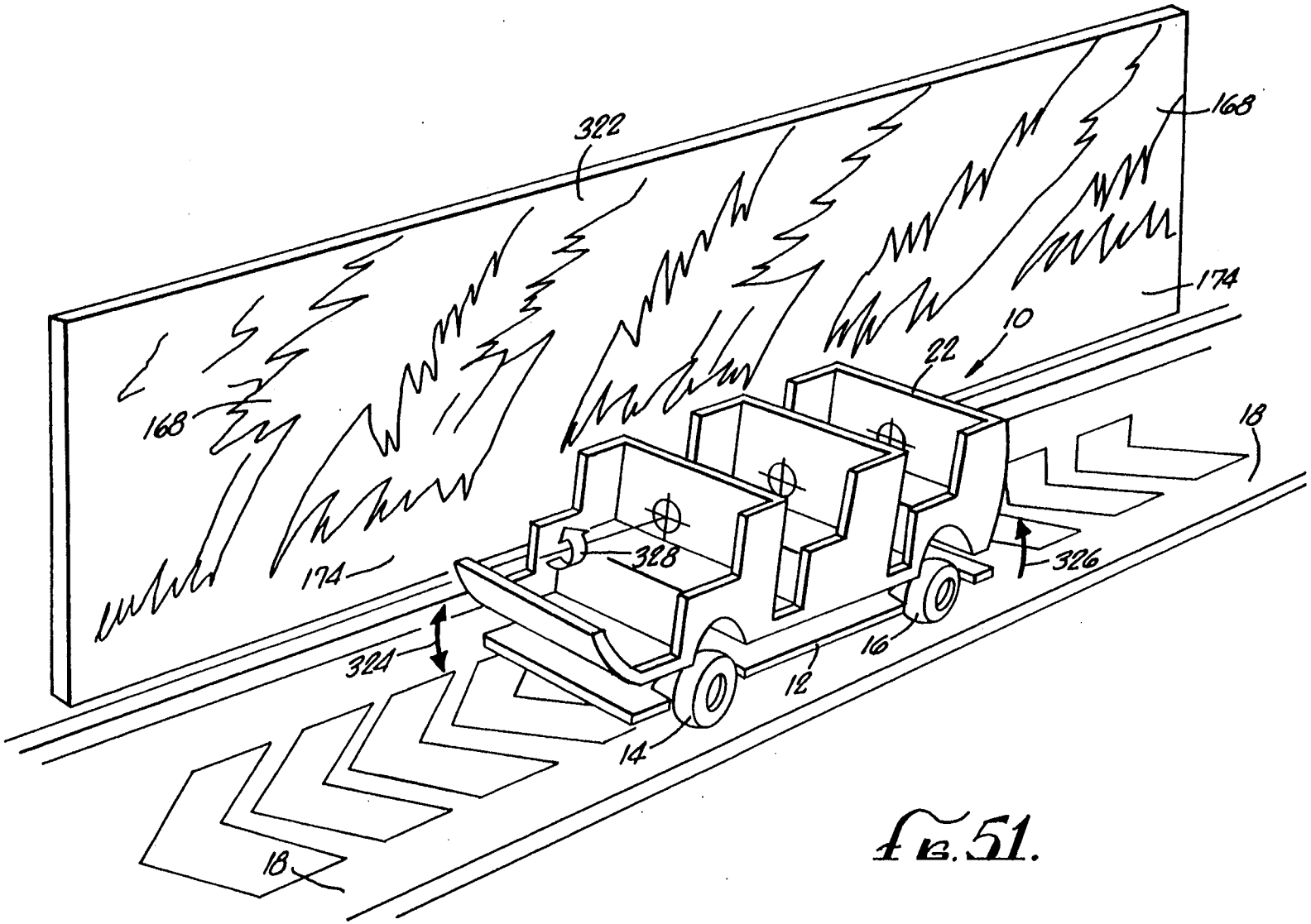
FIG. 51 is a perspective view of the ride vehicle as it moves through an attraction, in which gentle pitching and rolling motion of the body and other effects are used to simulate the effect of driving at high speed in the vehicle.

FIG. 51 illustrates a ride experience that includes the simulated effect of driving at high speed in the vehicle 10. Like the ride experience shown in FIG. 47, this ride experience also involves the use of a projection screen 322 alongside the path 18 to be followed by the vehicle 10. Again, the projection screen 322 is preferably a rear projection screen. The scenes projected on the screen 322 correspond to images moving rapidly in a rearward direction, such as trees 168 and grass 174 alongside a typical high-speed road or highway.

Once the vehicle 10 has reached the projection screen 322, the vehicle continues to travel forward. Simultaneously, the body 22 is gently pitched forward and backward and rolled from side-to-side with respect to the chassis, as indicated by the arrows 324, 326 and 328, to simulate the effect of the vehicle 10 traveling at high speed. The rapidly moving scenes 168 and 174 tend to heighten this sensation. Audio sounds, such as a roaring engine and fast moving tires also are included, as well as wind blowing against the passengers. These effects continue until the vehicle 10 has traveled to the end of the projection screen 322.

Figure 52:
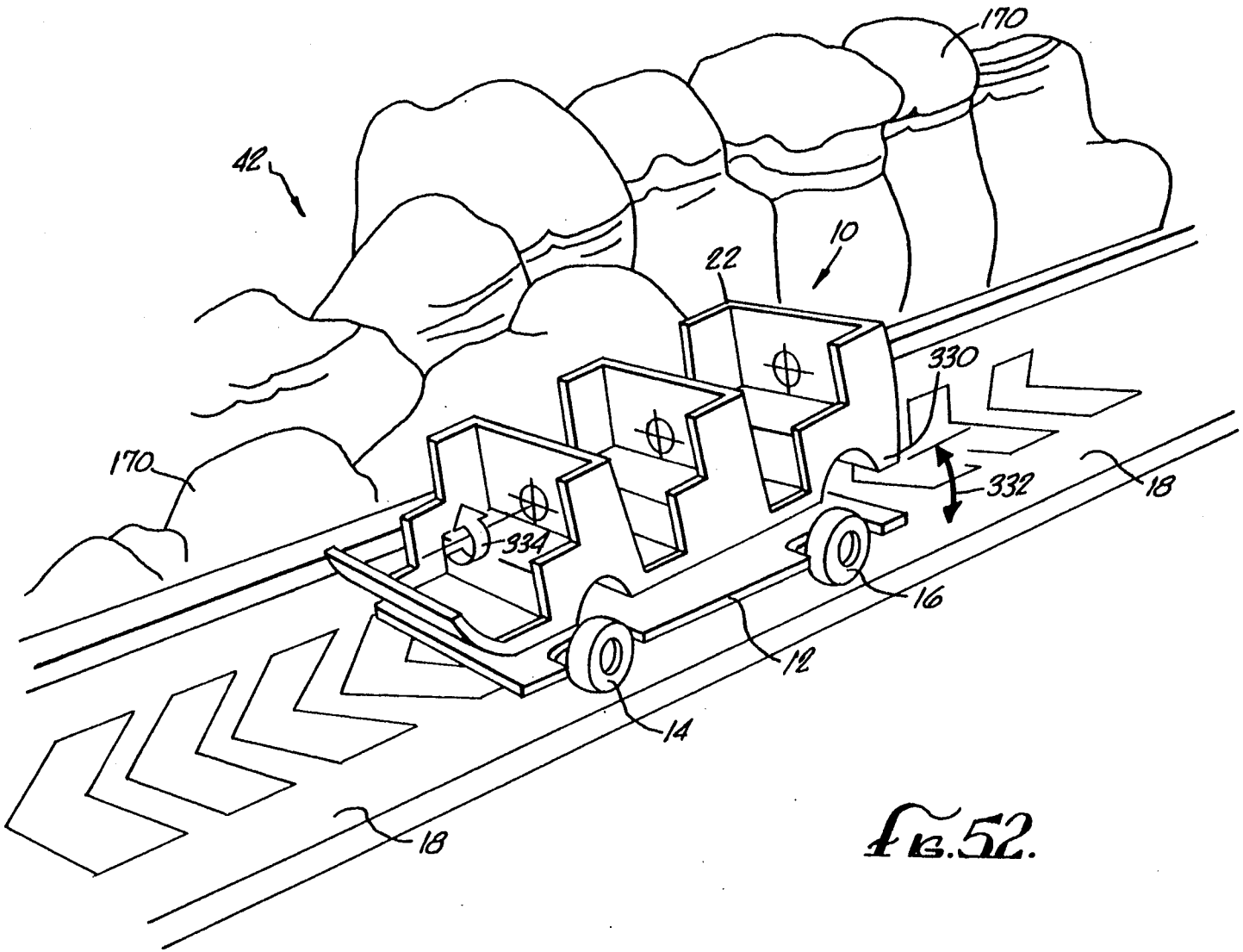
FIG. 52 is a perspective view of the ride vehicle as it moves through an attraction, in which a combination of pitching and rolling motion of the body and other effects are used to simulate the effect of driving the vehicle with a flat tire.

Finally, FIG. 52 illustrates a ride experience that includes the simulated effect of driving with a flat tire. In this ride experience, stationary scenery 42 of any form may be provided. In this embodiment, rocks 170, positioned alongside the path 18 followed by the vehicle 10, are illustrated. As the vehicle 10 moves along the path 18, a loud noise corresponding to a tire blow out is introduced. Thereafter, one corner 330 of the vehicle, such as the left rear corner illustrated in FIG. 52, is caused to bounce up and down by appropriately moving the rear end of the vehicle up and down, as indicated by the arrow 332, and by rolling the body 22 outwardly away from the affected tire, as indicated by the arrow 334. This body motion with respect to the chassis 12 is continued in a periodic or repeated manner for as long as desired. The sounds of a flapping tire also are introduced, to further simulate the effect of driving with a flat tire.

With these exemplary motions in mind, other aspects of the control system and the method of programming the ride vehicle 10 with one or more complete ride programs that direct the ride vehicle from start to finish around the closed-loop path (as seen in FIG. 53) will now be described.

One of the particular utilities of the present invention is the use of a programmable ride vehicle 10 that may be configured to have any desired number of ride programs, either with the same body 22 in a generic environment, or with a different body in an alternative environment. Even in a multiplicity of environments, a single ride vehicle 10 is all that is needed to impart an infinite variability of ride experiences that may be alternatively selected and easily created.

The programming steps described herein are set forth in a manner that enables anyone familiar with computer programming to implement appropriate software to provide the programming functions. At a macroscopic level, the programming tasks consist of (1) developing each ride program to synchronize vehicle motion and show set motion, projection and other effects with articulation of the motion apparatus 24, (2) programming the vehicle control system 40 to initialize vehicle operation, monitor vehicle status and execute one of a plurality of ride programs, by loading a sequence of data, divided into parallel data tracks, to the vehicle actuators, for use as actuation signals, and (3) programming the Wayside Interface to interact with the human operator 409 at the Wayside Station 407. The functions of these various programs are set forth below in a manner to enable a computer programmer to implement a ride vehicle that accomplishes the above-described motion patterns, or other motion patterns, for nearly any desired amusement attraction.

Figure 56:
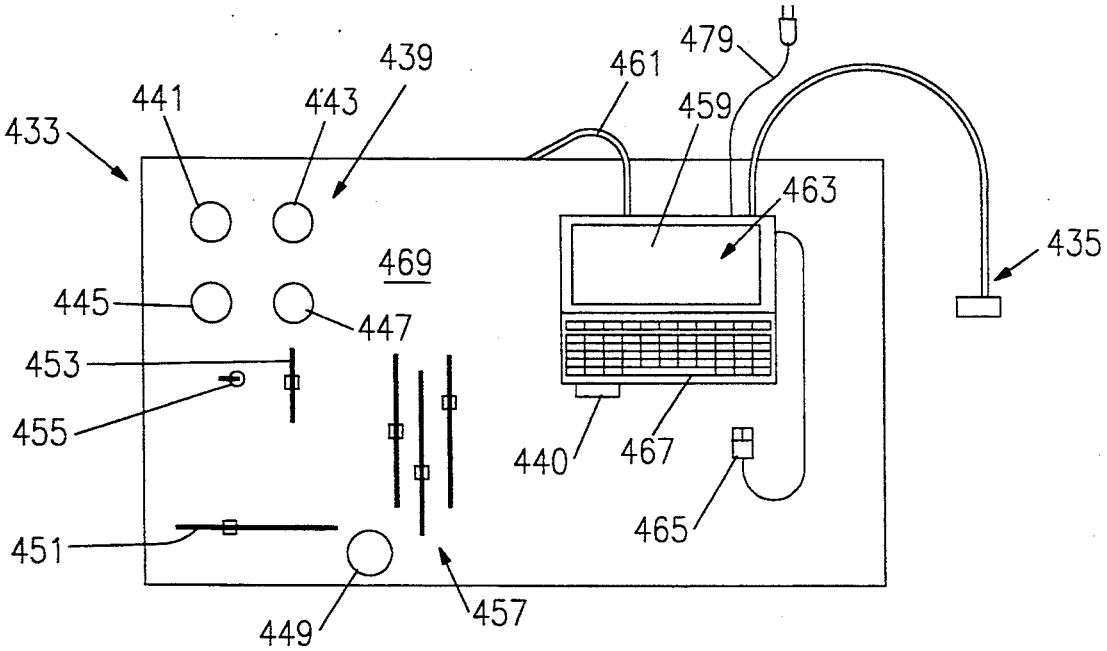
FIG. 56 is a plan view of a detachable programming console used to create each ride program that controls vehicle conduct and provision of the ride experience to the passengers.
Figure 57:
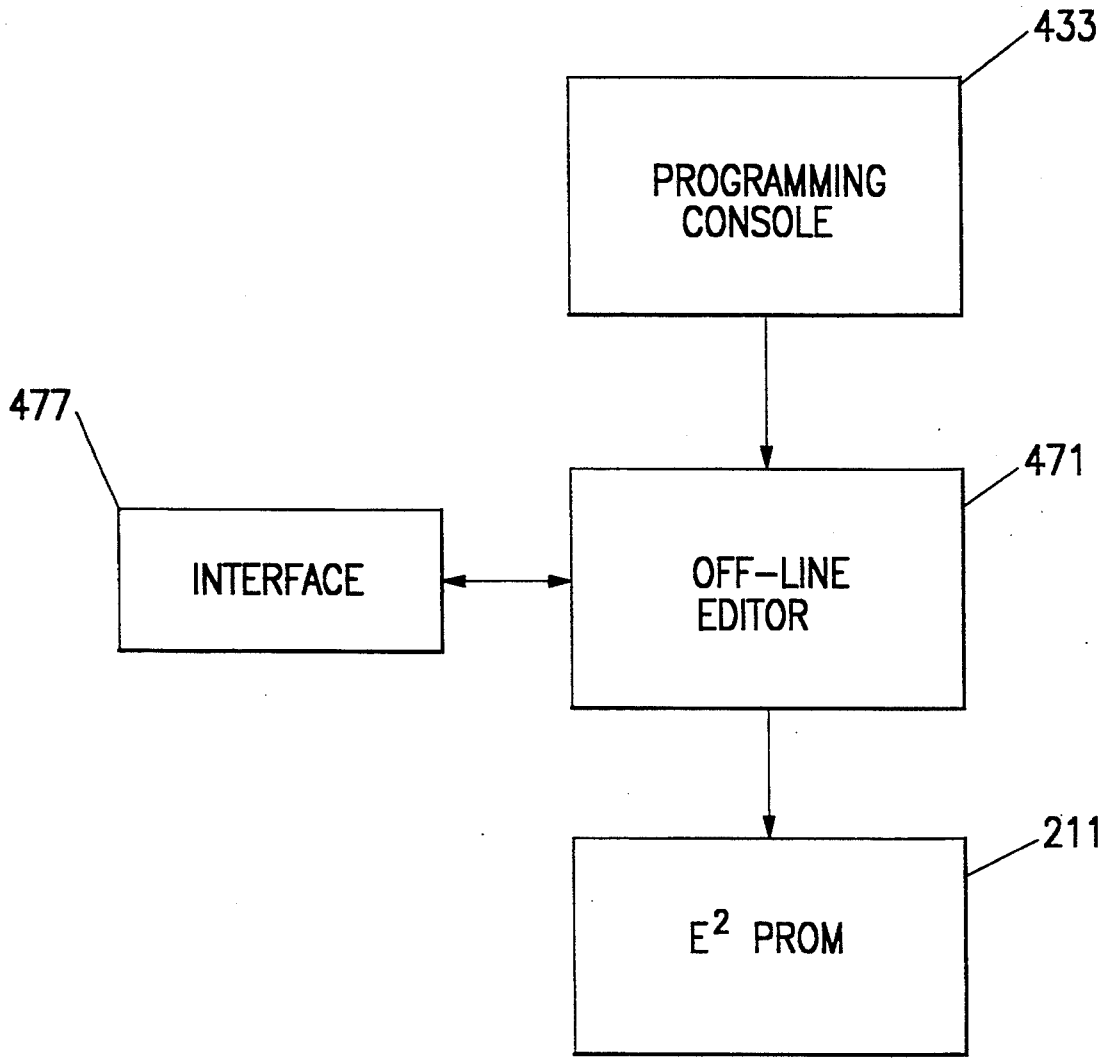
FIG. 57 is a functional flow chart that shows the different pieces of equipment used to generate a ride program, including a programming console and an off-line editor.

To create a particular ride program, and associated ride experience, a special programming console 433, shown in FIG. 56 is connected by an appropriate coupling to the vehicle control system 40. An operator sits within the ride vehicle 10 and uses the console 433 to control and record actions of the various mechanical elements that are important to the ride experience. The console 433 includes various controls for manipulating these various mechanical elements, and a removable memory, such as a floppy disk 440, onto which recorded actions of the ride vehicle 10 may be stored for later edit. Thus, using the console 433, the programmer may experiment with various movements of both of the ride vehicle 10 and the motion apparatus 24 to interact with each other and with show sets, which are external to the vehicle. An off-line editor (not shown in FIG. 56) is then used to add a soundtrack, and to alter and smooth motions and correct errors in the recorded program.

The console panel 433 includes a number of switches, slider potentiometers, and connectors required for console operation. These controls 439 include a vehicle manual power disconnect switch 441, a restart switch 443, a program stop switch 445, a program start switch 447, a recording on/off switch 449, a rear offset slider potentiometer 451, a vertically-oriented velocity slider potentiometer 453, a vehicle direction (forward-/reverse) toggle switch 455, and three vertically-oriented slider potentiometers 457 for the three actuators which are used to articulate the motion apparatus. Also integrally mounted to the console panel is a laptop "IBM" compatible personal computer 459. Ideally, this computer uses a "80386SX" CPU microprocessor running at 20 megahertz or greater speed and having at least 6 megabytes of RAM and 60 megabytes of hard drive for data and program storage. Ideally, the personal computer also has a 3.5 inch disk drive 440, to which ride programs can be saved and removed for later processing at the off-line editor 471. Each of the output signals from the aforementioned controls 439 are converted to digital format and multiplexed to a common data bus 461, which is fed as an input to the personal computer 459. Accordingly, the program software selects one of the multiplexed inputs for sampling, and loads a digital value corresponding to the control's position into the RAM of the personal computer 459, for modification and output as an actuation signal, used to control one of the plurality of mechanical elements of the ride vehicle 10. Importantly, the manual power disconnect switch 441 causes both of the RCC 193 and the RMC 195 to disconnect power to all vehicle controls, so as to disable all motion in an emergency condition. By contrast, the program stop switch 445 disables the motion apparatus 24 and vehicle velocity, but permits continued steering of the ride vehicle 10 until it comes to a stop.

Each mechanical element, for example, rear steering actuators, vehicle velocity (swashplate), and each of the three servo actuators 50, 52 and 54 of the motion apparatus, has a parallel data track dedicated to control of that actuator during the ride program. In other words, each parallel data track includes a sequence of data that describes the movements of the corresponding actuator during the duration of the ride program. This duration is, in the preferred embodiment, measured by the position of the ride vehicle 10 in feet along the path 18, and extends to a full loop of the path. Thus, as the ride vehicle 10 moves forward, the computers 193 and 195 obtain instructions from the selected ride program which defines increase or decrease in velocity, change in rear offset, and new articulation of the passenger holding structure 20. The parallel data tracks also include tracks that correspond to audio cues, vehicle headlights (on/off) and safety functions, which include follower rear offset lock-out, seat belt disengagement, and motion apparatus actuator block and settling valve actuation. In addition, each ride program includes identifying information, including name, date of creation, remarks, but most importantly, an error detection code that permits each of the RCC 193 and RMC 195 to identify data errors to ensure proper performance of the selected ride program.

Time-based sequences may also be used, either in lieu of, or in combination with, the vehicle position. In fact, each ride vehicle includes hold-patterns which are designed to entertain and amuse the passengers 48 during a ride stoppage. That is, if the ride vehicle 10 is stopped, the motion apparatus 24 or other mechanical element may be actuated in a predefined, timed pattern, pending renewed motion of the vehicle in accordance with the ride program. In addition, however, time-based sequences are also preferably used at intermittent locations around the path 18, for example, to create a "stuck-in-the-mud" or other similar sequence, or to simulate the effect of a rock slide.

The programming console 433 includes controls 439 that manipulate each of the mechanical elements, and a "80386SX" CPU laptop as the personal computer 459, which digitizes the values of the controls, and modifies them in accordance with a special program, described below, to output a set of actuation signals that Will be used to instantaneously direct each of the mechanical elements. The special program displays the mode for each parallel data track on the computer monitor 463, and allows the guest to select one of several operating modes for actuation of selected ones of the plurality of mechanical elements that contribute to the ride experience, using a mouse 465, keyboard 467 or other interface device. Subsequent to the selection of mode and loading of a particular, or alternatively, a blank, ride program, the programmer may scroll through the ride program in a continuous manner, with the prerecorded or default actuation signals being fed to the vehicle control system 40 and controlling the actions of the various mechanical elements. Either of vehicle position along the path, or elapsed time, may be selected in the preferred embodiment as an index by which to record vehicle actions and actions of the mechanical elements.

Prior to recording actions that are directed by the programming console 433, the programmer defines one of four modes in the special software for each of the actuator-driven parallel data tracks, the selection of modes and recording being toggled on and off by the programmer, as desired, through the programmer's depression of a record on/off button on the control panel 469. The programmer also, prior to recording, defines gain and response parameters for the controls 439 of the programming console 433, which determine the extent to which the actuation signals track their corresponding output signal for a particular mechanical element. For example, this special menu allows the programmer to scale a very small range of actuator motion, i.e., between zero and five inches of motion, to the particular control of the programming console, and accordingly shape the actuation signal corresponding to each of the vertically oriented slider potentiometers 451, 453 and 457. In addition to these gain parameters, the software also allows definition of change or response parameters, which determine how quickly or slowly the actuation signal changes to reflect change in a control setting. For example, should the programmer decide to instantaneously stroke one of the motion apparatus actuators 50, 52 or 54 to an extreme position, this change parameter could be set to allow the actuation signal to trigger only a defined maximum rate of change, even the corresponding control may be instantaneously moved between two extremes.

In this manner, the output signals may be processed and modified to allow them to control each of the plurality of mechanical elements used to provide the ride experience, and also be selectively recorded by the personal computer 459 for editing and use as one of the resident plurality of ride programs that will be stored upon the ride vehicles 10 actually used in an amusement attraction.

Of the four aforementioned modes, a play mode may be selected as a first mode for each mechanical element, where the sequence of data of a corresponding parallel data track in the loaded ride program is directly fed as the actuation signal fed to the ride vehicle 10. If a blank ride program (the default) is being used to generate a new ride program, then a zero actuation value is fed to the corresponding mechanical element, to indicate no actuation, for all mechanical elements save vehicle velocity, to which a minimal velocity signal is supplied.

Second, a record mode may be selected for each mechanical element, wherein output signals from the controls 439 are directly supplied to the vehicle as actuation signals for their corresponding mechanical element, and the output signals simultaneously recorded as the new sequence of data in the corresponding parallel data track. If any prerecorded parallel data tracks exist which are loaded into memory as part of the loaded ride program, they are overwritten, and the newly-recorded values may be subsequently saved to floppy disk 440 or other remote memory.

Third, a hybrid mode may be utilized where a prerecorded track is selected for playback for a mechanical element, but for which the output signal from the corresponding control is used to fine tune the prerecorded track and provide an adjusted signal as the actuation signal for the corresponding mechanical element. The amount of such adjustment is determined by gain values which, as stated above, are definably adjusted by the programmer prior to recording. Accordingly, the new parallel data track, if the adjusted signal is in fact recorded, is used to overwrite the old parallel data track for the corresponding one of the plurality of mechanical elements.

Fourth, a mute mode may be executed where no actuation signal is fed to selected ones of the plurality of mechanical elements, save a minimum velocity signal, but wherein prerecorded tracks retain their data values without being overwritten by the actuation signals generated by the personal computer 459.

The programming console software is configured to allow menu selection of a display that shows the programmer each of a large number of preassigned position marker locations around the path 18. All of these are assigned a default value of negative one, which is beyond the range acceptable to the vehicle software. The programmer assigns, for each position marker 473 that the proximity sensors of the vehicle will sense as the ride vehicle 10 travels around the path 18, a specific number of feet that corresponds to a premeasured distance from a point of origin 475 (which is, under normal conditions, the Wayside Station 407). Accordingly, while forty or more position markers 473 may be utilized, it is typical for each ride vehicle 10 to utilize a few of these position markers 473 along the path, depending upon length of the path 18. It is presently contemplated that position markers 473 will be placed at approximately every five hundred feet along the path 18, and substantially more closely together in the vicinity of the Wayside Station 407. While position markers may be placed within a few feet of each other there should be no need for verification of vehicle position that often.

The off-line editor 471 consists of an "IBM" compatible computer running "Microsoft Windows" TM and a special program which allows the off-line editor to selectively graph actuator position as a function of one of, or both of, elapsed time and distance along the path 18. This special program enables the programmer to use a mouse or other input device 477 to smooth curves in the graphed motion, or to change the actuation signal associated with the particular mechanical element and position of the ride vehicle 10 along the path 18. In other words, the off-line editor 471 simply displays a graph having lines and curves that represent motion of the various actuators and, using the mouse or other input device 477, the programmer smooths or adjusts the curves using a drawing program. By adjusting these curvilinear representations of the state of each of the mechanical elements, the programmer is able to perfect motions and remove the effects of influence of motion of the vehicle upon the programmer during the actual recording sequences or add other special effects such as vibration. The software for these drawing functions of the off-line editor is considered to be well within the skill of any competent computer programmer.

Once the motions of the mechanical elements are perfected, it is necessary to synchronize the activities of the moving show sets and add audio to enhance the ride experience provided to the passengers 48 by the particular ride program.

For purposes of adding actuation of moving show sets and audio, it is contemplated that yet an additional programming session aboard the ride vehicle 10 is needed to ascertain positions when it is desired to add special audio effects for a particular audio channel, or to precisely actuate moving show sets which are external to the vehicle. To this effect, the ride vehicle 10 is actuated in accordance with the revised ride program to move around the path 18. Careful notes are made of specific vehicle position as to when and where it is desired to actuate each of the moving show sets and specific audio. These motions and actuations are then added to a show control program maintained by the Wayside Interface and edited using appropriate editing tools. Also, one of the parallel data tracks associated with audio enables the off-line editor 471 to load and format a particular MIDI command for actuation of a specific speaker and a specific sound, for example, tire screeching, engine roar, gravel spray, etc., in combination with the actions of the vehicle and moving show sets. Again, implementation of software functions that allow the off-line editor's definition of audio and actuation of the infrared transmitter 429 are considered to be well within the skill of a skilled computer programmer.

While the programming console 433 permits the programmer 437 to generate ride programs which are based upon either position or elapse of time, there are other forms of motion indexing which can be utilized, for example, detection of predefined vehicle motion, external signals (using sensors), or a combination of any of the above. In fact, the preferred embodiment uses distance of the ride vehicle 10 along the path 18 as the index by which to synchronize the motion base 24, vehicle motion, audio, moving show sets, etc., and in addition, time-based patterns which may be implemented at any position of the ride vehicle 10 along the path 18. Time, as used for developing ride programs in the context of the present invention, may be used as either a velocity-dependent position-measure, or as an index for motion base actions which is not a function of the position of the ride vehicle 10 along the path 18.

A time-based pattern is a specific set of vehicle actions, motions and sounds that can be optionally performed within any particular ride program, depending on specified conditions which are selected by the programmer 437. These conditions may either be attainment of a specific position, or lowering of a zone-specific, go signal, which halts the forward progress of the ride vehicle 10. The latter condition may be used to trigger a hold-pattern, in which the motion base 24, other mechanical elements, and the sound module 41 may be used to entertain passengers 48 pending recommencement of forward motion of the ride vehicle 10. The programming console 433 is used to program, edit, and combine these time-based patterns, and to specify implementation of time-based patterns by position, including specific hold-patterns according to zone of stoppage.

The software of the programming console 433 is configured to allow inclusion of time-based patterns after the generation of a base ride program which is based upon distance travelled by the ride vehicle 10. Position-actuated, time-based patterns are implemented in the manner of the steps, described above, except that the programmer 437 first moves the vehicle to a desired position along the path 18, specifies time as the index for recorded motions, and proceeds in accordance with the aforementioned steps. At any point, the programmer 437 may change the recorded criteria, and return to position-based ride program development.

With respect to hold-patterns, the programmer 437 may record specific actions without regard to the position of the ride vehicle 10 and without the necessity of actually moving the vehicle. The programmer 437 proceeds in accordance with the generic programming steps, described above, but mutes the parallel data track of vehicle velocity and, in addition, specifies (1) range of position in which the hold-pattern may be implemented (2) minimum duration of the hold-pattern, and (3) maximum number of iterations of the hold-pattern. Alternatively, the programmer may permits small amounts of velocity, for example, rolling back and forth to create a "stuck in the mud" sequence. Since execution of a hold-pattern program is, using the personal computer 433, defined to occur within a range of vehicle position, or as a randomly-selected one of a plurality of hold-patterns, the ride vehicle 10 need not be actually moved to a specific position along the path 18 for programming of the hold-patterns. Hold-patterns are terminated by the ride execution software of the computerized vehicle-control system 40, either at the end of the specific time-based pattern, or once both the go signal has been restored and the minimum duration has been exceeded. When the time-based segment terminates the ride execution software of the computerized-vehicle control system 40 is effective to transition back to the point where the ride vehicle left-off within the normal position-based playback, allowing the ride vehicle 10 to recommence normal programming or program playback.

When the go signal is lowered or raised for a particular ride vehicle, the transition between the ride program and the hold-pattern is smoothly controlled by the ride execution software, for vehicle velocity, rear offset, and motion base operation, such that abrupt motion or excessive acceleration do not occur.

Thus, using the time-based features of the preferred programming console, a ride vehicle 10 along the path 18 may be instructed to stop all motion at a particular position, measured in terms of one of distance and elapsed time, and a MIDI sequence executed while the ride vehicle 10 is at that particular position. For example, a ride vehicle 10 may be instructed to, after travelling 1000 feet along the path 18, come to a full stop and articulate the motion base 24 in accordance with a short time-based sequence to simulate the effects of an earthquake, "stuck in the mud" sequence, or other activity. At the end of the time-based sequence, the sequence of data may again instruct the ride vehicle 10 to proceed and rely upon an advance in vehicle position, including distance, to derive further actions of the plurality of mechanical elements aboard the ride vehicle, including the use of further time-based patterns.

In addition to the plurality of ride programs, which are stored in the $E^2$PROM 211 for each of the two computers 193 and 195, each computer has memory that contains the initialization, ride execution and monitoring software which is used to govern execution of the sequences of data that correspond to each ride program and the implementation of ride vehicle or motion base shutdown, if required.

Initialization is performed anytime the ride vehicle 10 is stopped by a loss of electrical power or due to an emergency condition. The power-up steps of each ride vehicle 10 perform the tasks of zeroing each of the actuators, to ensure that no vehicle motion or actuation of the motion base 24 is triggered upon power-up, and charging the high-pressure accumulator 157 to have sufficient hydraulic pressure to drive all actions of the motion base and vehicle. A hydraulic pressure sensor signal 225 is used by each computer to ascertain when hydraulic pressure is approximately 2500 lbs. per square inch, and within a range, to regulate pressure supplied by the hydraulic power unit 34. Once the minimum hydraulic pressure has been reached, each of the vehicle's actuators may then be actuated in accordance with the ride program and the vehicle advanced along the path 18.

During initialization, the computerized vehicle-control system 40 first disables the motion base 24, and the servo actuators 126 that control steering are driven to correspond to no lateral offset. As soon thereafter as the go signal is raised by the Wayside Interface, the ride vehicle 10 is advanced at minimum velocity along the path 18 until the next two consecutive position markers are detected by the vehicle. The default ride program is then automatically selected to govern ride vehicle actions, and the vehicle is moved with its motion base 24 inactive towards the hold area, until it can no longer proceed due to the lowering of the go signal, indicating that the vehicle is in a queue for the hold area.

Use of this sequence, and confirmation of instructions from the Wayside Interface of a new ride program selection may be quite important for safety depending upon the particular implementation of the amusement attraction. In addition, it is also desirable to clear ride program selection for each ride vehicle as it enters the Wayside Station 407. Since different ride programs will be used throughout the attraction, it may be quite important that moving show sets and other equipment are exactly at their proper positions for approaching ride vehicles, which may be programmed to just miss obstacles, etc. Consequently, it is important for some alternative embodiments, e.g., where moving show sets may have differing reactions depending upon ride program selection, that the Wayside Interface have precise knowledge of the ride program selected for each ride vehicle 10 that is actively operating within the attraction 413, so that show sets may be commanded (by the Wayside Interface) to be in their proper positions. To this effect, ride vehicles 10 that have no memory of a ride program are advanced at minimum velocity, with no motion base actuation.

For ride vehicles 10 that may be activated from the branched-track portion 417, within the maintenance yard 415, activation and removal onto the closed-loop path 18 may be accomplished by manually turning power on within the ride vehicle, and either automatically advancing the vehicle onto the path using minimum velocity, until the first position marker 475 is detected, or manually controlling advancement of the vehicle using the programming console 433. Once the ride vehicle 10 is switched onto the closed-loop of the path 18 and has contacted the first position marker 475, it is ready for execution of one of the plurality of ride programs and entertainment of passengers 48. At the first position marker 475, which is preferably adjacent to the Wayside Station 407, the initialization software initializes the ride vehicle 10's position along the path 18, and the ride vehicle is ready for operation in accordance with one of its ride programs. The initialization software is also effective to select a default ride program, pending instructions from the Wayside Interface.

As each ride vehicle 10 enters the Wayside Station 407, each ride program instructs the vehicle to proceed at minimum velocity, while the Wayside Interface uses raising and lowering of the go signal to each zone 405 to move the vehicle from the hold area 419 to the passenger loading/unloading area 421 to a departure-ready area 423, etc. Zones 405 in the station area will be spaced much closer together and shorter in length, and the ride vehicles 10 are permitted to run closely together, almost bumper-to-bumper. Status information, including ride vehicle position, operating status, and ride program selection, is displayed for the human operator 409 at the control tower 401 for each vehicle that is operating on the system.

After the motion base 24 has been blocked at the hold area 419 and the ride vehicle 10 is stopped at the passenger loading/unloading area 421, the computerized vehicle-control system 40 releases the seat belt lock (not shown in FIG. 51) and seat belt retractor (not shown in FIG. 51). This will permit the passengers 48 to manually release the seat belt buckles. Operators will instruct the passengers 48 to release their buckles and step out to their left of the vehicle at this time. As passengers 48 are stepping off the ride vehicle 10, new passengers will be directed to load onto the vehicle and to buckle their seat belts. The vehicle will then leave the passenger loading-/unloading area 421 and advance to the departure-ready area 423. As the ride vehicle 10 is being advanced to the departure-ready area 423, the RCC 193 causes the application of air to the seat belt lock bladders. If the seat belt tongue has been properly inserted and the seat belt is locked, the seat belt hard-wired contact and relay logic will automatically lock the seat belt reel retractor solenoid and illuminate a light-emitting diode (LED) (not shown) that corresponds to the particular seat.

A human operator 409 then is called upon to visually check that each passenger 48 has a belt on and that the seat belt display LED for each seat occupied is illuminated. If all LEDs are not illuminated, the operator 409 will take correction action before allowing the ride vehicle 10 to proceed into the attraction 413. Once all of the belts are fastened, however, a go button 425 corresponding to the departure-ready area is depressed on the control tower 401, and the go signal for the ride vehicle 10 is raised to permit it to commence the selected ride program.

The ride execution software of the RCC 193 then commences ride program operation by selecting initial data from the sequence of data of the selected one of the plurality of ride programs. As a practical matter, the initial data will set ride vehicle velocity as part of a sequence of vehicle motion data to move the ride vehicle 10 away from the Wayside Station 407. As the ride vehicle 10 moves in position along the path 18, additional data is retrieved from the $E^2$PROM 211 in parallel data tracks, to define the state of each of the mechanical elements that combine to create the ride experience, at any given moment. As indicated above, this data will include vehicle velocity, rear offset, and motion base actuation data.

In an alternative embodiment, a plurality of different paths 18 may be provided, each ride vehicle 10 storing ride programs that enable it to execute movements along each of the various paths. For example, a number of roads may be provided through a particular terrain, and the Wayside Interface controlled to elect one of these various paths for the vehicle to follow in accordance with a stored ride program. However, in the preferred implementation, a single path 18 is utilized with each ride program, creating different interaction with the three-dimensionally vivid images observed by the passengers 48.

Accordingly, the ride vehicle 10 is first called upon to leave the Wayside Station 407 and begin its movement along the path 18. The computers 193 and 195 aboard the ride vehicle 10 utilize their distance registers and high-speed counters 215 to maintain an accurate indication of the vehicle's position along the path 18 as measured in feet, time of day, and also an elapsed time since commencement of the program. In this sense, the high-speed counters 215 are incremented 360 times with each rotation of the wheels, and computer software is relied upon to derive a specific foot position around the path 18. Notably, each of the RCC 193 and RMC 195 receives two signals, one from each rotary encoder, which may produce different numbers of pulses as the ride vehicle enters a turn. Thus, the software of the computerized vehicle-control system 40 simply takes an average of the two numbers (tracked with the high-speed counters 215), producing an error if their difference is too disparate. One of distance from the Wayside Station 407 and the elapsed time from commencement of the ride program, or a combination of both, is used by software in the preferred embodiment to index the selected ride program and to actuate the plurality of mechanical elements aboard each ride vehicle 10 as it follows the path 18. With each increment in position, either distance in terms of feet or elapsed time, the $E^2$-PROM is checked for subsequent data in the sequence of data that it contains. Accordingly, the computers 193 and 195 are continuously retrieving data from the sequence of data that define instantaneous vehicle actions in accordance with the selected ride program.

As mentioned above, the rotary position encoders are not only the mechanism that the ride vehicle 10 has for determining its position along the path 18. In addition, position markers positioned at various points along the path are defined in program memory to be associated with specific foot positions along the path. Accordingly, each time the ride vehicle 18 reaches one of the various position markers 473 and 475 located around the path 18, the distance registers are checked to ensure that they reflect actual position of the ride vehicle 10 and the rotary encoders are used to supply incremental distance beyond the previous position marker.

The ride execution and monitoring software calls for each of the RCC 193 and the RMC 195 to monitor vehicle activities in accordance with the instructions of the parallel data tracks of the selected ride program, and to utilize the aforementioned voting procedure to agree or disagree as to status, indicating (1) proper operation, or an agreed fault condition, or (2) a logic fault. In addition to its other activities, the ride execution and monitoring software is also called upon to perform certain safety functions, including a power disconnect and motion base shutdown if it is determined that specified errors, including logic errors, exist.

The vehicle control system 40 exercises control over vehicle power using a number of switches, 239, 241, 257 and 259. The software of the ride vehicle 10 monitors vehicle activity and initiates a power disconnect, informing the Wayside Interface of the same, for any of the following reasons:

a. Failure to respond to the power bus controls, or a logic fault.
b. Hydraulic fluid level low, shutdown.
c. Loss of steering position sensor signal.
d. Excess lateral position (offset) error.
e. Excess longitudinal position error.
f. Hydraulic fluid over-temperature, shutdown.
g. Return accumulator pressure too low.
h. Seat belt lock air pressure too low.
i. Excessive vehicle speed.
j. Rear offset lock-out state error.
k. Loss of longitudinal position sensor signal.

The power disconnect function remains in effect until the condition causing the disconnect has been corrected and service personnel activate a reset key switch on the ride vehicle 10, or initiate a reset using the special programming console 433, which may be connected to the vehicle for maintenance and diagnostics, as mentioned. If the problem cannot be corrected, then service personnel use the programming console 433 in the drive mode, to drive the ride vehicle 10 along the path 18 and into the maintenance area 415.

As also mentioned above, the software of the ride vehicle 10 is also called upon to disable the motion apparatus 24 and bleed pressure from the motion apparatus actuators 50, 52 and 54. However, certain errors, such as positional errors which may signify that the ride vehicle 10 is inappropriately positioned with respect to moving show sets, may also require a deactivation of the motion apparatus 24 for reasons of passenger safety. A motion apparatus stop command is utilized in the preferred embodiment when there is (a) a loss of signal from a sensor corresponding to one of the vehicle's mechanical elements, such as a motion base servo actuator, (b) excessive motion apparatus servo-actuator stroke, as determined from the corresponding sensor feedback signal, or (c) unacceptable position error, which requires shutdown if there is a question concerning clearance of the motion apparatus 24.

When the vehicle motion apparatus stop command is activated, the vehicle software immediately informs the Wayside Interface and de-energizes the motion apparatus 24, thereby stopping all servo-actuator movement and causing the motion apparatus to settle to the home or fully down position, with no further movement. In addition, the software commands the use of the current ride program parallel data track values for steering and rear offset lock-outs, audio, vehicle headlights on/off, hydraulic and safety functions, and other functions not relating or affecting the motion apparatus control, to direct the ride vehicle 10 to return to the Wayside Station 407. Once the ride vehicle 10 has been returned to the Wayside Station 407, the motion apparatus 24 may either be reset, allowing for renewed activity, or the ride vehicle may be removed to the maintenance area 415, or otherwise taken off-line, for diagnostics.

The Wayside Interface, as mentioned, includes a computer system 403 and monitor 411 for interaction with a human operator 409, and a number of manually-operated dispatch controls 425 that control activation of the go signal in corresponding zones 405, within the Wayside Station 407. These dispatch controls 425 govern motion of each ride vehicle 10 (at minimum velocity within the Wayside Station 407), providing that no ride vehicle 10 occupies an adjacent zone. In addition, the computer system 403 displays messages transmitted from each ride vehicle 10 as it enters the Wayside Station 407, and permits ride program selection in either of a random mode or a controlled mode, where the human operator 409 of the Wayside Interface is called upon to select a particular ride program. Suitable programming of the computer of the Wayside Interface, to receive these messages from a rf transceiver 481, and to display those messages in the order received, for the human operator 409, is considered to be a simple task of computer programming and will not be further discussed.

In addition, the computer system 403 of the Wayside Station 407 is called upon to monitor the no-go signals in each zone 405 of the path 18, and for each (first) zone having an active no-go signal, disable the go signal in the immediately previous (second) zone until the no-go signal disappears from the first zone. This monitoring occurs both for the Wayside Station 407 and at other portions of the path 18, and thus, the computer system 403 is effective to gate the manually-operated dispatch controls to block dispatch if another ride vehicle already occupies the immediately adjacent zone in the forward direction of vehicle travel.

Finally, when each ride vehicle 10 is at the Wayside Station, the ride vehicle's selection of the previous ride program is preferably cleared, and the Wayside Interface transmits a new ride program selection. The vehicle control system 40 of each vehicle receives this rf transmission, and confirms the particular ride program selection. As mentioned, depending upon the particular attraction, vehicle confirmation of the particular ride program selection may be considered necessary to ensure that show elements are in known positions for a given vehicle ID, and vehicle dispatch from the Wayside Station 407 is not granted until confirmation is received from the departing vehicle.

Implementation of these above-recited tasks of the computer of the Wayside Interface is considered to be a relatively simple task, within the skill of any computer programmer.

The invention defined in the claims which follow may be implemented in many different ways. Another example, quite similar to the preferred implementation, discussed above, would be to implement the ride vehicle 10 as a raft that apparently travels down a set of rapids. Motion of the ride vehicle 10 can be quite precisely controlled along a path, with motion (seemingly created by water currents and obstacles) imparted by revving, etc. Thus, the passengers 48 may be induced to believe that they are travelling at far greater speeds than the actual speed of the vehicle.

From the foregoing, it will be appreciated that the dynamic ride vehicle 10 of the present invention provides several unique motion patterns that may be executed in various sequences in an amusement park attraction, along with appropriate scenery, audio sounds and various other special effects, to create a very unique ride experience for the passengers in the vehicle. The ride vehicle 10 is capable of enhancing the sensation of vehicle movement that is actually taking place, as well as providing the passengers with realistic moving ride vehicle experiences that are not actually happening.

While a particular form of the invention has been illustrated and described, it will be apparent that various modifications can be made without departing from the spirit and scope of the invention. Accordingly, it is not intended that the invention be limited, except as by the appended claims.

APPENDIX

Attached as Appendix "A" to this detailed description is an example audio cue list that identifies how audio data is configured in one of several parallel data tracks as part of each ride program, with the generation of audio sounds cued to other vehicle activities.

APPENDIX A

| | SOURCE NAME | SRC NO. | SPEAKER | START | SPL dB | STOP | SYNC TO | COMMENTS |
|---|---|---|---|---|---|---|---|---|
| 1 | Engine Idle | 1 | Engine | From previous show | 75 | x-fade on cue #2 | | Continuous from unload last show through load new show |
| 2 | Gear shifting | 2 | Engine | Triggered | 85 | Auto | | |
| 3 | Engine run up #1 | 3 | Engine | Triggered | 85 | | Vehicle speed | |
| 4 | Gear shifting | 2 | Engine | Triggered | 85 | Auto | | |
| 5 | Engine run up #2 | 4 | Engine | Triggered | 85 | | Vehicle speed | |
| 6 | Backfire | 5 | Right rear | Triggered | 95 | | | |
| 7 | Engine continuous #1 | 6 | Engine | Triggered | 85 | | Vehicle speed | As vehicle attains constant speed |
| 20 | Skid | 11 | All wheels | Triggered | 95 | Cut at cue #21 | | |
| 21 | Thump | 8 | Left rear | Triggered | 95 | Auto | Ext. tree hit | Set sensor detects proximity to tree and initiates cue |
| | Tree hit | 51 | At tree | Triggered | 95 | Auto | thump | Set sensor detects proximity to tree and initiates cue |
| 22 | Tree crash | 52 | At tree | Triggered | 95 | Auto | 2 seconds after tree hit | |
| 23 | Shift down | 8 | Engine | Triggered | 90 | Auto | | |
| 24 | Engine speed #3 | 7 | Engine | Triggered | 90 | | Vehicle speed | |
| 40 | Gunshot | 59 | Spkr 28 | Triggered | 95 | Auto | | |
| | Blowout | 12 | Right front | Triggered | 100 | Auto | | 1 second after gunshot |
| | Skid | 11 | All wheels | Triggered | 95 | Auto | | |
| | Squeal | 14 | Rear wheels | Triggered | 95 | Auto | | |

©1991 Walt Disney Imagineering the motion apparatus 24.

Alternatively, motion of the ride vehicle 10 may be controlled by a human operator, who directs a vehicle along a path which is not predefined. Although the ride vehicle 10 is not operated at high speeds, the vehicle control system 40 is programmed to detect specific vehicle motions, and to provide corresponding, synchronized articulation of the motion apparatus 24 and control of the sound module 41. As one example, the human operator could be employed to steer a all-terrain style vehicle at slow speed, with accelerations, decelerations and turns of the ride vehicle detected by the vehicle control system 40 and responsive actuation of the motion apparatus 24 to significantly enhance these effects. The sound module 41 can similarly be called upon to create sounds of screeching brakes, engine

We claim:

1. An amusement park attraction, comprising:

a path adapted to be followed throughout the attraction;

scenery positioned along said path at selected locations; and a ride vehicle adapted to follow said path, said ride vehicle including a passenger supporting structure, a motion base supporting said passenger supporting structure that articulates said passenger supporting structure in a plurality of degrees of freedom relative to and independent of motion of said ride vehicle along the path, and a control system that controls said motion base to articulate said passenger supporting structure.

2. An amusement park attraction according to claim 1, wherein said control system controls said motion base to articulate said passenger supporting structure at said selected locations to impart a specific effect in relation to a specific show set among said scenery, said specific show set and corresponding effect respectively including at least one of providing and obstacle and traversing that obstacle, providing an obstacle and lurching to avoid that obstacle, providing an incline and ascending that incline, providing a decline and descending that decline, providing a body of water and fording that body of water, providing a bridge and falling off that bridge, and providing a roadway and skidding off that roadway.

3. An amusement park attraction according to claim 1, wherein said ride vehicle has a body that resembles a living animal.

4. An amusement park attraction according to claim 1, wherein said control system includes:

a ride control device that controls actuation of said motion base to thereby articulate said passenger supporting structure independent of motion of said ride vehicle along said path; and a program memory that is coupled to, and accessed by, said ride control device, said ride control device controlling actuation of said motion base in accordance with a ride program having sequenced data stored in said program memory, said sequenced data being accessed by said ride control device in synchronization with motion of the vehicle chassis along said path, to thereby cause specific articulation of said passenger supporting structure at selected points along said path, said program memory being selectively alterable to thereby permit programmatic change to an overall ride experience provided by said sequenced data.

5. An amusement park attraction according to claim 4, wherein said program memory is adapted to store a plurality of ride programs, each having different sequenced data corresponding to different patterns of motion of said passenger holding structure, said ride control device having one of software and logic that permits selection of one of said plurality of ride programs, to thereby provide for selection of one ride experience from among differing ride experiences provided by each of said plurality of ride programs.

6. An amusement park attraction according to claim 1, further comprising means for moving said scenery with respect to said ride vehicle to selectively enhance or subdue the sensation by passengers of their visual-perceptions of motion of said ride vehicle, independent of motion of said ride vehicle along said path.

7. An amusement park attraction according to claim 1, further comprising:

audio means for presenting sounds to passengers in said ride vehicle; and means for introducing special effects along said path to enhance the ride experience of the passengers through said amusement park attraction.

8. An amusement park attraction according to claim 1, wherein said ride vehicle includes a chassis and said motion base includes a plurality of actuators of said ride vehicle connected between said passenger supporting structure and said chassis for imparting motion to said passenger supporting structure independent of motion of said ride vehicle.

9. An amusement park attraction according to claim 7, wherein said motion base includes three actuators for imparting multiple axes of movement to said passenger supporting structure, including pitch, roll and elevation.

10. An amusement park attraction according to claim 8, wherein said actuators are hydraulic actuators and wherein each of said plurality of actuators has a position sensor that provides information to said control system for controlling the movement of said actuators independently of each other.

11. An amusement park attraction according to claim 1, wherein said passenger supporting structure is adapted to be selectively pitched from front to back, rolled from side to side, and elevated with respect to said ride vehicle by said motion base.

12. An amusement park attraction according to claim 1, wherein said vehicle has wheels in rolling contact with said path followed by said vehicle.

13. An amusement park attraction according to claim 12, wherein said vehicle includes two front wheels and two rear wheels connected to said chassis.

14. An amusement park attraction according to claim 13, further comprising steering means for steering said front wheels and said rear wheels.

15. An amusement park attraction according to claim 13, further comprising steering means for steering said rear wheels independently of said front wheels.

16. An amusement park attraction, comprising a path and a plurality of ride vehicles that each follow said path, each of said ride vehicles having a motion base that articulates a passenger supporting structure in a plurality of degrees of freedom relative to and independent of motion of the vehicle along said path, said path including a passenger loading point and a passenger unloading point, wherein said plurality of ride vehicles are adapted to be operated concurrently at different locations along said path between said passenger loading point and said passenger unloading point, such that a departure of vehicles from said passenger loading point can be staggered in time.

17. An amusement park attraction according to claim 16, further comprising at least one show set positioned along said path to present a three dimensional visual image to passengers, said at least one show set actuated to move in at least one predefined pattern in response to a position of at least one of said plurality of ride vehicles.

18. An amusement park attraction according to claim 16, further comprising at least one speaker that produces predefined sounds in response to a position of at least one of said plurality of ride vehicles.

19. An amusement park attraction according to claim 18, wherein at least one speaker is mounted within each ride vehicle at a location that is adapted to simulate sounds of at least one of gear whine, engine revving, screeching tires, sounds of a flat tire and screeching brakes.

20. An amusement park attraction according to claim 18, wherein said at least one speaker is mounted at a location adjacent to said path and is synchronized to produce predefined sounds during concurrent passing of one of said plurality of ride vehicles by said location, said predefined sounds selected to include at least one of splashing water, thumping, scraping, crashing, banging, whistling air, creaking and cracking wood sounds.

21. An amusement park attraction according to claim 16, further comprising a path-mounted special effects device that produces, for sensation by passengers of said plurality of ride vehicles, at least one of wind, dust clouds, flying gravel, dirt, mud, sparks, water spray and fog.

22. An amusement park attraction according to claim 16, wherein said motion base articulates said passenger supporting structure in accordance with stored program instructions maintained by a vehicle computer system of each ride vehicle and indexed by one of a position of the particular ride vehicle and time, position defined by one of elapsed distance and elapsed time from a reference, each vehicle computer system maintaining at least one ride program consisting of a particular sequence of said stored program instructions.

23. An amusement park attraction according to claim 16, wherein each one of said plurality of ride vehicles includes a steering actuator, said steering actuator of each ride vehicle actuated to steer the particular vehicle in accordance with stored program instructions maintained by a vehicle computer system of each ride vehicle and indexed by one of a position of the particular ride vehicle and time, position defined by one of elapsed distance and elapsed time from a reference, each vehicle computer system maintaining at least one ride program consisting of a particular sequence of said stored program instructions.

24. An amusement park attraction according to claim 23, further comprising a plurality of different paths that said ride vehicles may each alternatively follow, said steering actuator of said ride vehicles actuated to steer the particular vehicle to select one of said plurality of different paths, in accordance with said stored program instructions, each vehicle computer system maintaining a plurality of alternative ride programs that correspond to said different paths and that cause the particular ride vehicle to follow different ones of said paths.

25. An amusement park attraction according to claim 16, wherein each one of said plurality of ride vehicles includes a velocity control, said velocity control of each ride vehicle actuated to move the particular vehicle in accordance with stored program instructions maintained by a vehicle computer system of each ride vehicle and indexed by one of a position of the particular ride vehicle and time, position defined by one of elapsed distance and elapsed time from a reference, each vehicle computer system maintaining at least one ride program consisting of a particular sequence of said stored program instructions.

26. A method of providing a ride experience to an occupant in an amusement park attraction having a ride vehicle of the type having a chassis that follows a path, a passenger supporting structure, and a motion base that moves the passenger supporting structure in multiple degrees of freedom independent of motion of the chassis, said method comprising the steps of:

(a) moving the vehicle along the path in the amusement park attraction;

(b) providing scenery positioned along the path at selected locations;

(c) articulating the passenger supporting structure with respect to the chassis to thereby enhancing or diminishing the effect of vehicle motion through the attraction at selected locations along the path; and (d) providing special effects for enhancing the sensations experienced by the occupant as the vehicle interacts with the path and scenery.

27. A method according to claim 26, wherein the ride vehicle also has a control device that controls actuation of the motion base, to thereby control articulation of the passenger supporting structure with respect to the chassis, and a program memory that is coupled to, and accessed by, the control device, the control device controlling articulation of the passenger supporting structure with respect to the chassis in accordance with a ride program having sequenced motion data stored in and accessed from the program memory, the data including individual data units that each describe at least one of (1) an orientation and position of the passenger supporting structure with respect to the chassis and (2) an incremental movement of the passenger supporting structure with respect to the chassis, said method further comprising the steps of:

(a) determining a position of the vehicle along the path in the amusement park attraction;

(b) accessing the program memory with the control device to obtain therefrom motion data associated with the position of the vehicle; and (c) actuating the motion base in accordance with the motion data to move the passenger supporting structure with respect to the chassis to a predefined orientation and position represented by the motion data.

28. A method according to claim 27, wherein the program memory is adapted to store a plurality of ride programs, each having different sequenced motion data, wherein:

(a) said method further comprises the step of selecting one ride program from among the plurality of ride programs; and (b) the step of accessing the program memory with the ride control device includes accessing the selected one ride program to obtain therefrom motion data associated with the position of the vehicle, corresponding to the selected one ride program.

29. A method according to claim 26, wherein the ride experience is the simulated effect of a sliding turn on a twisting road, and wherein:

(a) the step of providing scenery includes providing stationary scenery with a horizontal horizon, and objects that appear to protrude into the path;

(b) the step of articulating the passenger supporting structure includes steering all wheels of the vehicle in a direction away from the protruding objects to thereby simulate the effect of a sliding turn, while simultaneously causing rotational acceleration of the passenger supporting structure with respect to the chassis about a roll axis in an outward direction with respect to the turn to enhance the sensation of the turning motion; and (c) the step of providing special effects includes introducing the sounds of engine roar and skidding corresponding to motion of the vehicle along the path, and further introducing the effect of flying gravel as the vehicle initiates and then completes its sliding turn.

30. A method according to claim 26, wherein the ride experience includes the simulated effect of climbing a steep hill, and wherein:

(a) the step of providing scenery includes providing stationary scenery with a horizon that angles downward in a direction toward the vehicle as it approaches such scenery;

(b) the step of articulating the passenger supporting structure includes pitching the passenger supporting structure backward by raising and causing rotational acceleration of the front end about a pitch axis and keeping the passenger supporting structure in this position as the vehicle moves along the path past the stationary scenery, with forward acceleration of the vehicle and fish-tailing provided by steering all four wheels of the vehicle; and (c) the step of providing special effects includes introducing the sounds of a straining engine and wheels spinning during climbing of the hill.

31. A method according to claim 26, wherein the ride experience is the simulated effect of descending a steep hill, and wherein:

(a) the step of providing scenery includes providing stationary scenery with a horizon that angles upward in a direction away from the vehicle as it approaches the scenery;

(b) the step of articulating the passenger supporting structure includes pitching the passenger supporting structure forward by raising and causing rotational acceleration of the rear end about a pitch axis and keeping the passenger supporting structure in this position as the imaginary hill is descended, and then dropping the rear of the passenger supporting structure down until it reaches a position substantially level with respect to the path; and (c) the step of providing special effects includes introducing the sounds of gear whine, a screaming engine and wheels sliding as the vehicle descends the hill.

32. A method according to claim 26, wherein the ride experience includes the simulated effect of sudden forward acceleration of the vehicle, and wherein:

(a) the step of providing scenery includes providing far stationary objects at a predetermined distance from the vehicle and close moving objects that accelerate rearward as the vehicle begins its forward acceleration;

(b) the step of articulating the passenger supporting structure includes pitching the passenger supporting structure rearward by raising and causing rotational acceleration of the front end about a pitch axis and keeping the passenger supporting structure in this position as the vehicle accelerates in a forward direction, while simultaneously providing four-wheel steering to simulate the effect of fish-tailing during acceleration; and (c) the step of providing special effects includes introducing the sounds of a roaring engine and squealing tires during acceleration of the vehicle.

33. A method according to claim 26, wherein the ride experience includes the simulated effect of a screeching stop by the vehicle, and wherein:

(a) the step of providing scenery includes providing stationary scenery;

(b) the step of articulating the passenger supporting structure includes pitching the passenger supporting structure forward by raising and causing rotational acceleration of its rear end about a pitch axis and keeping the passenger supporting structure in this position as the vehicle decelerates, providing fish-tailing of the vehicle with four-wheel steering and then dropping the rear end of the passenger supporting structure down rapidly to a horizontal position when the vehicle is fully stopped; and (c) the step of providing special effects includes introducing the sounds of screeching brakes and sliding tires and the effect of a forward blowing dust cloud during deceleration of the vehicle.

34. A method according to claim 26, wherein the ride experience includes the simulated effect of sliding off the side of a road while in a turn, and wherein the steps of providing scenery, articulating the passenger supporting structure and providing special effects include the steps of:

(a) providing stationary scenery, including the appearance of a ditch at the side of the road on the outside of the turn;

(b) turning the chassis in a direction to follow a curved path corresponding to the direction of the road, while exaggerating the turn using four-wheel steering and causing rotational acceleration of the passenger supporting structure with respect to the chassis outward and rearward along a roll axis and a pitch axis in a direction away from the turn;

(c) introducing the sounds of sliding tires, thumping and scraping as the vehicle simulates the effect of sliding off the road while in the turn; and (d) simulating the effect of sparks flying out from under the vehicle during the turn.

35. A method according to claim 26, wherein the ride experience includes the simulated effect of driving over a log, and wherein the steps of providing scenery, articulating the passenger supporting structure and providing special effects include the steps of:

(a) providing stationary scenery and a log prop across the path that moves out of the way just as the vehicle is about to drive over it;

(b) moving the vehicle forward to a point corresponding to the location of the log, quickly pitching the passenger supporting structure backward and then forward by causing the front end of the passenger supporting structure to quickly raise up and then down as the front of the vehicle passes the point corresponding to the location of the log, waiting for an elapsed distance travelled by the vehicle that corresponds to the rear of the vehicle reaching the log, and then quickly pitching the passenger supporting structure forward and then backward by causing the rear end of the passenger supporting structure to quickly raise up and then down as the vehicle continues to move forward passing the log;

(c) pitching the passenger supporting structure forward and backward for several cycles after the vehicle has passed the log, and decreasing the amplitude of the pitching motion as the distance between the vehicle and the log increases, until the passenger supporting structure is eventually returned to a substantially level position with respect to the chassis; and (d) introducing the sounds of thumping and crashing while the passenger supporting structure is articulated with respect to the chassis as the vehicle simulates the effect of driving over the log.

36. A method according to claim 26, wherein the ride experience includes the simulated effect of driving over a ditch, and wherein the steps of providing scenery, articulating the passenger supporting structure and providing special effects include the steps of:

(a) providing stationary scenery including the appearance of a ditch that appears to be but is not actually present in the path followed by the vehicle;

(b) moving the vehicle forward to a point corresponding to the location of the ditch, raising the rear end of the passenger supporting structure and then dropping it back down as the front of the vehicle passes the point corresponding to the location of the ditch, waiting for an elapsed distance travelled by the vehicle that corresponds to the rear of the vehicle reaching the ditch, and then raising the front end of the vehicle and then moving it back down as the vehicle continues to move forward passing the ditch;

(c) pitching the passenger supporting structure forward and backward for several cycles after the vehicle has passed the ditch, and decreasing the amplitude of the pitching motion as the distance between the vehicle and the ditch increases, until the passenger supporting structure returns substantially to a level position with respect to the chassis;

(d) introducing the sounds of thumping and splashing as the vehicle travels through the ditch; and (e) simulating the effect of dirt flying and water splashing as the vehicle travels through the ditch.

37. A method according to claim 26, wherein the ride experience includes the simulated effect of driving over rocks, and wherein the steps of providing scenery, articulating the passenger supporting structure and providing special effects include the steps of:

(a) providing stationary scenery along the path and rocks in the path of the vehicle that move out of the way just as the vehicle is about to travel over them;

(b) pitching the passenger supporting structure rearward and then forward in combination with outward passenger supporting structure roll away from the location of the rocks in the path as one side of the vehicle travels over the point corresponding to the location of the rocks; and (c) introducing the sounds of thumping and banging as the vehicle passes the location of the rocks.

38. A method according to claim 26, wherein the ride experience includes the simulated effect of driving through a stream, and wherein the steps of providing scenery, articulating the passenger supporting structure and providing special effects include the steps of:

(a) providing a stream that appears to be but is not actually in the path of the vehicle, with water pools on opposite sides of the path corresponding to the appearance of the stream;

(b) pitching the passenger supporting structure in the forward and rearward directions, in combination with outward passenger supporting structure roll from side to side, to create a bouncing and rolling motion of the passenger supporting structure with respect to the chassis as the vehicle travels through the stream;

(c) introducing the sounds of splashing, engine roar and spinning tires as the vehicle travels through the stream; and (d) simulating the effect of spraying water from underneath the vehicle as the vehicle travels through the stream.

39. A method according to claim 26, wherein the ride experience is the simulated effect of cresting a hill and going airborne in the vehicle, and wherein the steps of providing scenery, articulating the passenger supporting structure and providing special effects include the steps of:

(a) providing stationary scenery along the path followed by the vehicle;

(b) moving the vehicle along a path having a hill and pitching the passenger supporting structure backward by raising the front end more than the rear end with respect to the chassis as the chassis begins descending the hill, and thereafter slowly pitching the passenger supporting structure forward so that the front end of the passenger supporting structure is lower than the rear end with respect to the chassis, and then dropping the passenger supporting structure down completely to simulate the effect of a crashing drop;

(c) pitching the passenger supporting structure forward and backward for several cycles after the vehicle has completed its crashing drop, and decreasing the amplitude of the pitching motion as the distance between the vehicle and the hill increases, until the passenger supporting structure is eventually returned to a substantially level position with respect to the chassis;

(d) introducing the sounds of engine roar, free wheeling, crashing and skidding as the vehicle goes airborne and then lands; and (e) simulating the effect of sparks and dirt flying from underneath the vehicle during the crashing drop of the vehicle.

40. A method according to claim 26, wherein the ride experience includes the simulated effect of floating in water, and wherein the steps of providing scenery, articulating the passenger supporting structure and providing special effects include the steps of:

(a) providing stationary scenery including the appearance of water pools that appear to be but are not actually present in the path followed by the vehicle;

(b) elevating the passenger supporting structure with respect to the chassis with gentle forward and rearward pitching in combination with side to side rolling of the passenger supporting structure with respect to the chassis as the vehicle travels through the water;

(c) introducing the sounds of splashing water and waves as the vehicle travels through the water; and (d) simulating the effect of fog in the path followed by the vehicle to create the illusion of water in front of the vehicle.

41. A method according to claim 26, wherein the ride experience includes the simulated effect of flying or falling through the air, and wherein the steps of providing scenery, articulating the passenger supporting structure and providing special effects include the steps of:

(a) projecting rapidly moving scenes on a projection screen located along the path followed by the vehicle;

(b) gently pitching the passenger supporting structure forward and backward and rolling it from side to side with respect to the chassis; and (c) introducing the sounds of whistling air as the vehicle travels past the rapidly moving scenes, while simultaneously introducing actual wind blowing against the passengers in the vehicle.

42. A method according to claim 26, wherein the ride experience includes the simulated effect of driving over a jungle bridge, and wherein the steps of providing scenery, articulating the passenger supporting structure and providing special effects include the steps of:

(a) providing a jungle bridge that appears to sway from side to side as the vehicle passes over it;

(b) driving the vehicle over the bridge and causing the vehicle to move from side to side using four wheel steering; and (c) introducing the sounds of creaking and cracking wood as the vehicle travels over the bridge.

43. A method according to claim 26, wherein the ride experience includes the simulated effect of swerving to miss a falling object, and wherein the steps of providing scenery, articulating the passenger supporting structure and providing special effects include the steps of:

(a) providing stationary scenery and an object that falls into the path of the vehicle;

(b) moving the vehicle along the path and abruptly swerving the vehicle out of the way of the object, and exaggerating that swerving by four wheel steering of the vehicle away from the object; and (c) introducing the sounds of the object crashing and skidding tires of the vehicle.

44. A method according to claim 26, wherein the ride experience includes the simulated effect of being stuck in the mud, and wherein the steps of providing scenery, articulating the passenger supporting structure and providing special effects include the steps of:

(a) providing stationary scenery including the appearance of mud that appears to be but is not actually present in the path followed by the vehicle;

(b) slowly stopping the vehicle as it reaches a position along the path corresponding to the location of the mud, and then imparting a slight rolling motion to the passenger supporting structure with respect to the chassis by using gentle forward and rearward pitching and side to side rolling motion; and (c) introducing the sounds of a roaring engine and spinning tires, and simulating the effect of mud flying away from the vehicle as it is stuck in the mud.

45. A method according to claim 26, wherein the ride experience includes the simulated effect of driving at high speed, and wherein the steps of providing scenery, articulating the passenger supporting structure and providing special effects include the steps of:

(a) projecting images on a projection screen that appear to move rapidly in a rearward direction relative to the vehicle;

(b) gently pitching the passenger supporting structure forward and backward and rolling it from side to side relative to the chassis;

(c) introducing the sounds of a roaring engine and tires spinning at high speed as the vehicle passes the rapidly moving images; and (d) causing actual wind to blow against the passengers in the vehicle.

46. A method according to claim 26, wherein the ride experience includes the simulated effect of driving with a flat tire, and wherein the steps of providing scenery, articulating the passenger supporting structure and providing special effects include the steps of:

(a) providing stationary scenery along the path followed by the vehicle;

(b) using a combination of pitching and rolling movement of the passenger supporting structure with respect to the chassis to cause one corner of the vehicle to bounce up and down in a cyclical manner; and (c) introducing the sounds of a flapping tire as the vehicle moves forward along the path.

47. An amusement park attraction, comprising:

at least one ride vehicle that follows a path within said amusement park attraction, said ride vehicle having a passenger supporting structure that moves along said path with said ride vehicle, a motion base supporting said passenger supporting structure that articulates said passenger supporting structuring in at least one degree of freedom relative to and independent of motion of said ride vehicle along the path, and a variable motive element on said ride vehicle that imparts programmably-defined motion in the form of at least one of variable steering of said ride vehicle, variable velocity of said ride vehicle, and articulation of said passenger supporting structure by the motion base relative to said ride vehicle; and a computer system in communication with said variable motive element and controlling the same in accordance with sequenced program instructions of a ride program stored by said computer system, said sequenced program instructions defining a repeatable pattern of programmably-defined motion.

48. An amusement park attraction according to claim 47, further comprising a show set positioned along said path to present a three dimensional visual image to passengers in said ride vehicle.

49. An amusement park attraction according to claim 48, wherein:

said show set is movable in a predefined pattern of motion in accordance with sequenced program instructions of a show set actuation program; and said amusement park attraction further comprises a show set controller that maintains said show set actuation program and controls the movement of said show set in accordance with said predefined motion pattern.

50. An amusement park attraction according to claim 47, further comprising a plurality of different alternative ride programs stored by said computer system, each one defining an alternative, repeatable pattern of programmably-defined motion.

51. An amusement park attraction, comprising:

at least one ride vehicle that follows a path within said amusement park attraction, said ride vehicle having a passenger supporting structure that moves along said path with said ride vehicle and a motion base supporting said passenger supporting structure that articulates said passenger supporting structure in at least one degree of freedom relative to and independent of motion of said ride vehicle along the path;

at least one show set positioned along said path to present a three dimensional visual image to passengers in said ride vehicle, said at least one show set being movable in at least one programmably-defined pattern in accordance with sequenced program instructions of a show set actuation program; and a show set computer system in communication with said at least one show set and controlling the same in a repeatable motion pattern in accordance with said programmably-defined pattern.

52. An amusement park attraction according to claim 51, further comprising a plurality of different alternative show set actuation programs stored by said computer system, each one of said plurality of different show set actuation programs defining different, alternative programmably-defined patterns of motion.

53. An amusement park attraction according to claim 41, wherein:

said at least one ride vehicle includes a variable motive element that imparts one of variable steering of said ride vehicle, variable velocity to said ride vehicle, and articulation to said passenger supporting structure relative to said ride vehicle by the motion base, and a vehicle computer system in communication with said variable motive element and controlling the same in accordance with sequenced program instructions of a ride program stored by said computer system; and said show set computer system being in communication with said vehicle computer system to thereby synchronize actuation of said variable motive element with movement of said at least one show set in accordance with their respective, associated stored program instructions.

54. An amusement park attraction according to claim 53, wherein:

said amusement park attraction further comprises a plurality of different show set actuation programs stored by said show set computer system;

said amusement park attraction further comprises a plurality of different ride programs stored by said vehicle computer system; and one of said show set computer system and said vehicle computer system includes selection software that selects one of said different show set actuation programs and one of said different ride programs and is in communication with the other of said show set computer system and said vehicle computer system to transmit to the same selection information to thereby synchronize actuation of said variable motive element in accordance with the selected one of said plurality of different ride programs with movement of said at least one show set in accordance with the selected one of said plurality of different show set actuation programs.

55. An amusement park attraction, comprising a plurality of ride vehicles; and a central controller;

wherein each of said plurality of ride vehicles has a passenger holding structure, a motion base supporting said passenger supporting structure that articulates said passenger supporting structure in at least one degree of freedom relative to and independent of motion of said ride vehicle along the path, and an on-board vehicle computer system that controls actions of the particular vehicle in the form of one of steering, velocity and articulation of said motion base according to a programmably-defined motion pattern defined by sequenced program instructions of a ride program, each said vehicle computer system storing at least one said ride program, each vehicle computer system in communication with said central controller.

56. An amusement park attraction according to claim 55, wherein each said vehicle computer system monitors vehicle position and communicates the same to said central controller by wireless communication.

57. An amusement park attraction according to claim 55, wherein:

said amusement park attraction further comprises a path, each of said plurality of ride vehicles following said path through said amusement park attraction, said path including a passenger loading point and a passenger unloading point to allow passengers to load and unload from said ride vehicle; and said plurality of ride vehicles are adapted to be operated concurrently at different locations along said path between said passenger loading point and said passenger unloading point, such that a departure of vehicles from said passenger loading point may be staggered in time.

58. An amusement park attraction according to claim 55, wherein each said vehicle computer system communicates with said central controller by communication that is transmitted between the corresponding vehicle and said central controller by radio frequency electromagnetic communication.

59. An amusement park attraction according to claim 55, wherein each said vehicle computer system communicates with said central controller by communication that is transmitted between the corresponding vehicle and said central controller by infrared light.

60. An amusement park attraction according to claim 55, wherein:

said amusement park attraction further comprises a fixed path having a power bus, each one of said ride vehicles continuously tapping said power bus to receive electricity therefrom; and each said vehicle computer system communicates with said central controller by communication that is electronically transmitted between the corresponding vehicle and said central controller through said power bus.

* * * * *

Disclaimer 5,403,238—Anthony W. Baxter, Anaheim Hills, Ca. AMUSEMENT PARK ATTRACTION. Patented April 4, 1995. Disclaimer filed Sep. 28, 2004, by the assignee The Walt Disney Company.

Hereby enters this disclaimer to claims 1-28; 47-52; and 55-60, of said patent.

*(Official Gazette March 15, 2005)*